US008863839B2

(12) United States Patent
Kaminsky et al.

(10) Patent No.: US 8,863,839 B2
(45) Date of Patent: Oct. 21, 2014

(54) ENHANCED CONVECTION FOR IN SITU PYROLYSIS OF ORGANIC-RICH ROCK FORMATIONS

(75) Inventors: Robert D. Kaminsky, Houston, TX (US); Matthew T. Shanley, Bellaire, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 414 days.

(21) Appl. No.: 12/946,532

(22) Filed: Nov. 15, 2010

(65) Prior Publication Data

US 2011/0146982 A1 Jun. 23, 2011

Related U.S. Application Data

(60) Provisional application No. 61/287,568, filed on Dec. 17, 2009.

(51) Int. Cl.
*E21B 43/24* (2006.01)
*E21B 43/247* (2006.01)

(52) U.S. Cl.
CPC ..... *E21B 43/24* (2013.01); *E21B 43/247* (2013.01)
USPC ..... 166/302; 166/256; 166/260

(58) Field of Classification Search
None
See application file for complete search history.

(56) References Cited

U.S. PATENT DOCUMENTS 363,419 A 5/1887 Poetsch
895,612 A 8/1908 Baker
1,342,780 A 6/1920 Vedder
1,422,204 A 7/1922 Hoover et al.
1,666,488 A 4/1928 Crawshaw (Continued)

FOREIGN PATENT DOCUMENTS

CA 994694 8/1976
CA 1288043 8/1991

(Continued)

OTHER PUBLICATIONS

Ali, A.H.A, et al, (2003) "Watching Rocks Change—Mechanical Earth Modeling", *Oilfield Review*, pp. 22-39.

(Continued)

*Primary Examiner* — Zakiya W Bates
*Assistant Examiner* — Silvana Runyan
(74) *Attorney, Agent, or Firm* — ExxonMobil Upstream Research-Law Department

(57) ABSTRACT

Method for producing hydrocarbon fluids from an organic-rich rock formation include providing a plurality of in situ heat sources configured to generate heat within the formation so as to pyrolyze solid hydrocarbons into hydrocarbon fluids. Preferably, the organic-rich rock formation is heated to a temperature of at least 270° C. Heating of the organic-rich rock formation continues so that heat moves away from the respective heat sources and through the formation at a first value of effective thermal diffusivity, $\alpha_1$. Heating of the formation further continues in situ so that thermal fractures are caused to be formed in the formation or so that the permeability of the formation is otherwise increased. The method also includes injecting a fluid into the organic-rich rock formation. The purpose for injecting the fluid is to increase the value of thermal diffusivity within the subsurface formation to a second value, $\alpha_2$. The second value $\alpha_2$ is at least 50% greater than the first value $\alpha_1$ and, more preferably, is at least 100% greater than $\alpha_1$.

51 Claims, 11 Drawing Sheets

(56) References Cited

U.S. PATENT DOCUMENTS 1,701,884 A 2/1929 Hogle
1,872,906 A 8/1932 Doherty
2,033,560 A 3/1936 Wells
2,033,561 A 3/1936 Wells
2,534,737 A 12/1950 Rose
2,584,605 A 2/1952 Merriam et al.
2,634,961 A 4/1953 Ljungstrom
2,732,195 A 1/1956 Ljungstrom
2,777,679 A 1/1957 Ljungstrom
2,780,450 A 2/1957 Ljungstrom
2,795,279 A 6/1957 Sarapuu
2,812,160 A 11/1957 West et al.
2,813,583 A 11/1957 Marx et al.
2,847,071 A 8/1958 De Priester
2,887,160 A 5/1959 De Priester.
2,895,555 A 7/1959 De Priester
2,923,535 A 2/1960 Ljungstrom
2,944,803 A 7/1960 Hanson
2,952,450 A 9/1960 Purre
2,974,937 A 3/1961 Kiel
3,004,601 A 10/1961 Bodine
3,013,609 A 12/1961 Brink
3,095,031 A 6/1963 Eurenius et al.
3,106,244 A 10/1963 Parker
3,109,482 A 11/1963 O'Brien
3,127,936 A 4/1964 Eurenius
3,137,347 A 6/1964 Parker
3,149,672 A 9/1964 Orkiszewski et al.
3,170,815 A 2/1965 White
3,180,411 A 4/1965 Parker
3,183,675 A 5/1965 Schroeder
3,183,971 A 5/1965 McEver et al.
3,194,315 A 7/1965 Rogers
3,205,942 A 9/1965 Sandberg
3,225,829 A 12/1965 Chown et al.
3,228,869 A 1/1966 Irish
3,241,611 A 3/1966 Dougan
3,241,615 A 3/1966 Brandt et al.
3,254,721 A 6/1966 Smith et al.
3,256,935 A 6/1966 Nabor et al.
3,263,211 A 7/1966 Heidman
3,267,680 A 8/1966 Schlumberger
3,271,962 A 9/1966 Dahms et al.
3,284,281 A 11/1966 Thomas
3,285,335 A 11/1966 Reistle, Jr.
3,288,648 A 11/1966 Jones
3,294,167 A 12/1966 Vogel
3,295,328 A 1/1967 Bishop
3,323,840 A 6/1967 Mason et al.
3,358,756 A 12/1967 Vogel
3,372,550 A 3/1968 Schroeder
3,376,403 A 4/1968 Mircea
3,382,922 A 5/1968 Needham
3,400,762 A 9/1968 Peacock et al.
3,436,919 A 4/1969 Shock et al.
3,439,744 A 4/1969 Bradley
3,455,392 A 7/1969 Prats
3,461,957 A 8/1969 West
3,468,376 A * 9/1969 Slusser et al. ..... 166/272.2
3,494,640 A 2/1970 Coberly et al.
3,500,913 A 3/1970 Nordgren et al.
3,501,201 A 3/1970 Closmann et al.
3,502,372 A 3/1970 Prats
3,513,914 A 5/1970 Vogel
3,515,213 A 6/1970 Prats
3,516,495 A 6/1970 Patton
3,521,709 A 7/1970 Needham
3,528,252 A 9/1970 Gail
3,528,501 A 9/1970 Parker
3,547,193 A 12/1970 Gill
3,559,737 A 2/1971 Ralstin
3,572,838 A 3/1971 Templeton
3,592,263 A 7/1971 Nelson
3,599,714 A 8/1971 Messman
3,602,310 A 8/1971 Halbert
3,613,785 A 10/1971 Closmann et al.
3,620,300 A 11/1971 Crowson
3,642,066 A 2/1972 Gill
3,661,423 A 5/1972 Garret
3,692,111 A 9/1972 Breithaupt et al.
3,695,354 A 10/1972 Dilgren et al.
3,700,280 A 10/1972 Papadopoulos et al.
3,724,225 A 4/1973 Mancini et al.
3,724,543 A 4/1973 Bell et al.
3,729,965 A 5/1973 Gartner
3,730,270 A 5/1973 Allred
3,739,851 A 6/1973 Beard
3,741,306 A * 6/1973 Papadopoulos et al. ... 166/252.1
3,759,328 A 9/1973 Ueber et al.
3,759,329 A 9/1973 Ross
3,759,574 A 9/1973 Beard
3,779,601 A 12/1973 Beard
3,880,238 A 4/1975 Tham et al.
3,882,937 A 5/1975 Robinson
3,882,941 A 5/1975 Pelofsky
3,888,307 A 6/1975 Closmann
3,924,680 A 12/1975 Terry
3,943,722 A 3/1976 Ross
3,948,319 A 4/1976 Pritchett
3,950,029 A 4/1976 Timmins
3,958,636 A 5/1976 Perkins
3,967,853 A 7/1976 Closmann
3,978,920 A 9/1976 Bandyopadhyay et al.
3,999,607 A 12/1976 Pennington et al.
4,003,432 A 1/1977 Paull et al.
4,005,750 A 2/1977 Shuck
4,007,786 A 2/1977 Schlinger
4,008,762 A 2/1977 Fisher et al.
4,008,769 A 2/1977 Chang
4,014,575 A 3/1977 French et al.
4,030,549 A 6/1977 Bouck
4,037,655 A 7/1977 Carpenter
4,043,393 A 8/1977 Fisher et al.
4,047,760 A 9/1977 Ridley
4,057,510 A 11/1977 Crouch et al.
4,065,183 A 12/1977 Hill et al.
4,067,390 A 1/1978 Camacho et al.
4,069,868 A 1/1978 Terry
4,071,278 A 1/1978 Carpenter et al.
4,093,025 A 6/1978 Terry
4,096,034 A 6/1978 Anthony
4,125,159 A 11/1978 Vann
4,140,180 A 2/1979 Bridges et al.
4,148,359 A 4/1979 Laumbach et al.
4,149,595 A 4/1979 Cha
4,160,479 A 7/1979 Richardson et al.
4,163,475 A 8/1979 Cha et al.
4,167,291 A 9/1979 Ridley
4,169,506 A 10/1979 Berry
4,185,693 A 1/1980 Crumb et al.
4,186,801 A 2/1980 Madgavkar et al.
4,193,451 A 3/1980 Dauphine
4,202,168 A 5/1980 Acheson et al.
4,239,283 A 12/1980 Ridley
4,241,952 A 12/1980 Ginsburgh
4,246,966 A 1/1981 Stoddard et al.
4,250,230 A 2/1981 Terry
4,265,310 A 5/1981 Britton et al.
4,271,905 A 6/1981 Redford et al.
4,272,127 A 6/1981 Hutchins
4,285,401 A 8/1981 Erickson
RE30,738 E 9/1981 Bridges et al.
4,318,723 A 3/1982 Holmes et al.
4,319,635 A 3/1982 Jones
4,320,801 A 3/1982 Rowland et al.
4,324,291 A 4/1982 Wong et al.
4,340,934 A 7/1982 Segesman
4,344,485 A 8/1982 Butler
4,344,840 A 8/1982 Kunesh
4,353,418 A 10/1982 Hoekstra et al.
4,358,222 A 11/1982 Landau
4,362,213 A 12/1982 Tabor
4,368,921 A 1/1983 Hutchins
4,369,842 A 1/1983 Cha

(56) References Cited

U.S. PATENT DOCUMENTS 4,372,615 A 2/1983 Ricketts
4,375,302 A 3/1983 Kalmar
4,384,614 A 5/1983 Justheim
4,396,211 A 8/1983 McStravick et al.
4,397,502 A 8/1983 Hines
4,401,162 A 8/1983 Osborne
4,412,585 A 11/1983 Bouck
4,417,449 A 11/1983 Hegarty et al.
4,449,585 A 5/1984 Bridges et al.
4,468,376 A 8/1984 Suggitt
4,470,459 A 9/1984 Copland
4,472,935 A 9/1984 Acheson et al.
4,473,114 A 9/1984 Bell et al.
4,474,238 A 10/1984 Gentry et al.
4,476,926 A 10/1984 Bridges et al.
4,483,398 A 11/1984 Peters et al.
4,485,869 A 12/1984 Sresty et al.
4,487,257 A 12/1984 Dauphine
4,487,260 A 12/1984 Pittman et al.
4,495,056 A 1/1985 Venardos
4,511,382 A 4/1985 Valencia et al.
4,532,991 A 8/1985 Hoekstra et al.
4,533,372 A 8/1985 Valencia et al.
4,537,067 A 8/1985 Sharp et al.
4,545,435 A 10/1985 Bridges et al.
4,546,829 A 10/1985 Martin et al.
4,550,779 A 11/1985 Zakiewicz
4,552,214 A 11/1985 Forgac et al.
4,567,945 A 2/1986 Segalman
4,585,063 A 4/1986 Venardos et al.
4,589,491 A 5/1986 Perkins
4,589,973 A 5/1986 Minden
4,602,144 A 7/1986 Vogel
4,607,488 A 8/1986 Karinthi et al.
4,626,665 A 12/1986 Fort
4,633,948 A 1/1987 Closmann
4,634,315 A 1/1987 Owen et al.
4,637,464 A 1/1987 Forgac et al.
4,640,352 A 2/1987 Vanmeurs et al.
4,671,863 A 6/1987 Tejeda
4,694,907 A 9/1987 Stahl et al.
4,704,514 A 11/1987 Van Egmond et al.
4,705,108 A 11/1987 Little et al.
4,706,751 A 11/1987 Gondouin
4,730,671 A 3/1988 Perkins
4,737,267 A 4/1988 Pao et al.
4,747,642 A 5/1988 Gash et al.
4,754,808 A 7/1988 Harmon et al.
4,776,638 A 10/1988 Hahn
4,779,680 A 10/1988 Sydansk
4,815,790 A 3/1989 Rosar et al.
4,817,711 A 4/1989 Jeambey
4,828,031 A 5/1989 Davis
4,860,544 A 8/1989 Krieg et al.
4,886,118 A 12/1989 Van Meurs et al.
4,923,493 A 5/1990 Valencia et al.
4,926,941 A 5/1990 Glandt et al.
4,928,765 A 5/1990 Nielson
4,929,341 A 5/1990 Thirumalachar et al.
4,954,140 A 9/1990 Kawashima et al.
4,974,425 A 12/1990 Krieg et al.
5,016,709 A 5/1991 Combe et al.
5,036,918 A 8/1991 Jennings et al.
5,050,386 A 9/1991 Krieg et al.
5,051,811 A 9/1991 Williams et al.
5,055,030 A 10/1991 Schirmer
5,055,180 A 10/1991 Klaila
5,082,055 A 1/1992 Hemsath
5,085,276 A 2/1992 Rivas et al.
5,117,908 A 6/1992 Hofmann
5,120,338 A 6/1992 Potts, Jr. et al.
5,217,076 A 6/1993 Masek
5,236,039 A 8/1993 Edelstein
5,255,742 A 10/1993 Mikus
5,275,063 A 1/1994 Steiger et al.
5,277,062 A 1/1994 Blauch et al.
5,297,420 A 3/1994 Gilliland
5,297,626 A 3/1994 Vinegar et al.
5,305,829 A 4/1994 Kumar
5,325,918 A 7/1994 Berryman et al.
5,346,307 A 9/1994 Ramirez et al.
5,372,708 A 12/1994 Gewertz
5,377,756 A 1/1995 Northrop et al.
5,392,854 A 2/1995 Vinegar et al.
5,411,089 A 5/1995 Vinegar et al.
5,416,257 A 5/1995 Peters
5,539,853 A 7/1996 Jamaluddin et al.
5,620,049 A 4/1997 Gipson et al.
5,621,844 A 4/1997 Bridges
5,621,845 A 4/1997 Bridges et al.
5,635,712 A 6/1997 Scott et al.
5,661,977 A 9/1997 Shnell
5,724,805 A 3/1998 Golomb et al.
5,730,550 A 3/1998 Andersland et al.
5,838,634 A 11/1998 Jones et al.
5,844,799 A 12/1998 Joseph et al.
5,868,202 A 2/1999 Hsu
5,899,269 A 5/1999 Wellington et al.
5,905,657 A 5/1999 Celniker
5,907,662 A 5/1999 Buettner
5,938,800 A 8/1999 Verrill et al.
5,956,971 A 9/1999 Cole et al.
6,015,015 A 1/2000 Luft et al.
6,016,867 A 1/2000 Gregoli et al.
6,023,554 A 2/2000 Vinegar et al.
6,055,803 A 5/2000 Mastronarde et al.
6,056,057 A 5/2000 Vinegar et al.
6,079,499 A 6/2000 Mikus et al.
6,112,808 A 9/2000 Isted
6,148,602 A 11/2000 Demetri
6,148,911 A 11/2000 Gipson et al.
6,158,517 A 12/2000 Hsu
6,246,963 B1 6/2001 Cross et al.
6,247,358 B1 6/2001 Dos Santos
6,319,395 B1 11/2001 Kirkbride et al.
6,328,104 B1 12/2001 Graue
6,409,226 B1 6/2002 Slack et al.
6,434,435 B1 8/2002 Tubel et al.
6,434,436 B1 8/2002 Adamy et al.
6,480,790 B1 11/2002 Calvert et al.
6,540,018 B1 4/2003 Vinegar et al.
6,547,956 B1 4/2003 Mukherjee et al.
6,581,684 B2 6/2003 Wellington et al.
6,585,046 B2 7/2003 Neuroth et al.
6,589,303 B1 7/2003 Lokhandwale et al.
6,591,906 B2 7/2003 Wellington et al.
6,607,036 B2 8/2003 Ranson et al.
6,609,735 B1 8/2003 DeLange et al.
6,609,761 B1 8/2003 Ramey et al.
6,659,650 B2 12/2003 Joki et al.
6,659,690 B1 12/2003 Abadi
6,668,922 B2 12/2003 Ziauddin et al.
6,684,644 B2 2/2004 Mittricker et al.
6,684,948 B1 2/2004 Savage
6,708,758 B2 3/2004 Karanikas et al.
6,709,573 B2 3/2004 Smith
6,712,136 B2 3/2004 de Rouffignac et al.
6,715,546 B2 4/2004 Vinegar et al.
6,722,429 B2 4/2004 de Rouffignac et al.
6,740,226 B2 5/2004 Mehra et al.
6,742,588 B2 6/2004 Wellington et al.
6,745,831 B2 6/2004 De Rouffignac et al.
6,745,832 B2 6/2004 Wellington et al.
6,745,837 B2 6/2004 Wellington et al.
6,752,210 B2 6/2004 de Rouffignac et al.
6,754,588 B2 6/2004 Cross et al.
6,764,108 B2 7/2004 Ernst et al.
6,782,947 B2 8/2004 de Rouffignac et al.
6,796,139 B2 9/2004 Briley et al.
6,820,689 B2 11/2004 Sarada
6,832,485 B2 12/2004 Sugarmen et al.
6,854,929 B2 2/2005 Vinegar et al.
6,858,049 B2 2/2005 Mittricker
6,877,555 B2 4/2005 Karanikas et al.

(56) References Cited

U.S. PATENT DOCUMENTS 6,880,633 B2 4/2005 Wellington et al.
6,887,369 B2 5/2005 Moulton et al.
6,896,053 B2 5/2005 Berchenko et al.
6,896,707 B2 5/2005 O'Rear et al.
6,913,078 B2 7/2005 Shahin et al.
6,915,850 B2 7/2005 Vinegar et al.
6,918,442 B2 7/2005 Wellington et al.
6,918,443 B2 7/2005 Wellington et al.
6,918,444 B2 7/2005 Passey et al.
6,923,155 B2 8/2005 Vinegar et al.
6,923,257 B2 8/2005 Wellington et al.
6,923,258 B2 8/2005 Wellington et al.
6,929,067 B2 8/2005 Vinegar et al.
6,932,155 B2 8/2005 Vinegar et al.
6,948,562 B2 9/2005 Wellington et al.
6,951,247 B2 10/2005 De Rouffignac et al.
6,953,087 B2 10/2005 de Rouffignac et al.
6,964,300 B2 11/2005 Vinegar et al.
6,969,123 B2 11/2005 Vinegar et al.
6,988,549 B1 1/2006 Babcock
6,991,032 B2 1/2006 Berchenko et al.
6,991,033 B2 1/2006 Wellington et al.
6,994,160 B2 2/2006 Wellington et al.
6,994,169 B2 2/2006 Zhang et al.
6,997,518 B2 2/2006 Vinegar et al.
7,001,519 B2 2/2006 Linden et al.
7,004,247 B2 2/2006 Cole et al.
7,004,251 B2 2/2006 Ward et al.
7,004,985 B2 2/2006 Wallace et al.
7,011,154 B2 3/2006 Maher et al.
7,013,972 B2 3/2006 Vinegar et al.
7,028,543 B2 4/2006 Hardage et al.
7,032,660 B2 4/2006 Vinegar et al.
7,036,583 B2 5/2006 de Rouffignac et al.
7,040,397 B2 5/2006 Rouffignac et al.
7,040,399 B2 5/2006 Wellington et al.
7,043,920 B2 5/2006 Viteri et al.
7,048,051 B2 5/2006 McQueen
7,051,807 B2 5/2006 Vinegar et al.
7,051,811 B2 5/2006 Rouffignac et al.
7,055,600 B2 6/2006 Messier et al.
7,063,145 B2 6/2006 Veenstra et al.
7,066,254 B2 6/2006 Vinegar et al.
7,073,578 B2 7/2006 Vinegar et al.
7,077,198 B2 7/2006 Vinegar et al.
7,077,199 B2 7/2006 Vinegar et al.
7,090,013 B2 8/2006 Wellington
7,093,655 B2 8/2006 Atkinson
7,096,942 B1 8/2006 de Rouffignac et al.
7,096,953 B2 8/2006 de Rouffignac et al.
7,100,994 B2 9/2006 Vinegar et al.
7,103,479 B2 9/2006 Patwardhan et al.
7,104,319 B2 9/2006 Vinegar et al.
7,121,341 B2 10/2006 Vinegar et al.
7,121,342 B2 10/2006 Vinegar et al.
7,124,029 B2 10/2006 Jammes et al.
7,143,572 B2 12/2006 Ooka et al.
7,165,615 B2 1/2007 Vinegar et al.
7,181,380 B2 2/2007 Dusterhoft et al.
7,198,107 B2 4/2007 Maguire
7,219,734 B2 5/2007 Bai et al.
7,225,866 B2 6/2007 Berchenko et al.
7,243,618 B2 7/2007 Gurevich
7,255,727 B2 8/2007 Monereau et al.
7,322,415 B2 1/2008 de St. Remey
7,331,385 B2 2/2008 Symington et al.
7,353,872 B2 4/2008 Sandberg
7,357,180 B2 4/2008 Vinegar et al.
7,405,243 B2 7/2008 Lowe et al.
7,441,603 B2 10/2008 Kaminsky et al.
7,461,691 B2 12/2008 Vinegar et al.
7,472,748 B2 1/2009 Gdanski et al.
7,484,561 B2 2/2009 Bridges
7,516,785 B2 4/2009 Kaminsky
7,516,786 B2 4/2009 Dallas et al.
7,516,787 B2 4/2009 Kaminsky
7,546,873 B2 6/2009 Kim et al.
7,549,470 B2 6/2009 Vinegar et al.
7,556,095 B2 7/2009 Vinegar
7,591,879 B2 9/2009 Sundaram et al.
7,604,054 B2 10/2009 Hocking
7,617,869 B2 11/2009 Carney et al.
7,631,691 B2 12/2009 Symington et al.
7,637,984 B2 12/2009 Adamopoulos
7,644,993 B2 1/2010 Kaminsky et al.
7,647,971 B2 1/2010 Kaminsky
7,647,972 B2 1/2010 Kaminsky
7,857,056 B2 1/2010 Kaminsky et al.
7,654,320 B2 2/2010 Payton
7,669,657 B2 3/2010 Symington et al.
7,743,826 B2 6/2010 Harris et al.
7,798,221 B2 9/2010 Vinegar et al.
7,832,483 B2 11/2010 Trent
7,860,377 B2 12/2010 Vinegar et al.
7,905,288 B2 3/2011 Kinkead
8,087,460 B2 1/2012 Kaminsky
8,127,865 B2 3/2012 Watson et al.
8,176,982 B2 5/2012 Gil et al.
8,356,935 B2 1/2013 Arora et al.
8,540,020 B2 9/2013 Stone et al.
8,596,355 B2 12/2013 Kaminsky et al.
8,608,249 B2 12/2013 Vinegar et al.
8,616,280 B2 12/2013 Kaminsky et al.
8,622,127 B2 1/2014 Kaminsky
8,662,175 B2 3/2014 Karanikas et al.
2001/0049342 A1 12/2001 Passey et al.
2002/0013687 A1 1/2002 Ortoleva
2002/0023751 A1 2/2002 Neuroth et al.
2002/0029882 A1 3/2002 Rouffignac et al.
2002/0049360 A1 4/2002 Wellington et al.
2002/0077515 A1 6/2002 Wellington et al.
2002/0099504 A1 7/2002 Cross et al.
2003/0070808 A1 4/2003 Allison
2003/0080604 A1 5/2003 Vinegar et al.
2003/0085570 A1 5/2003 Ernst et al.
2003/0111223 A1 6/2003 Rouffignac et al.
2003/0131994 A1 7/2003 Vinegar et al.
2003/0131995 A1 7/2003 de Rouffignac et al.
2003/0178195 A1 9/2003 Agee et al.
2003/0183390 A1 10/2003 Veenstra et al.
2003/0192691 A1 10/2003 Vinegar et al.
2003/0196788 A1 10/2003 Vinegar et al.
2003/0196789 A1 10/2003 Wellington
2003/0209348 A1 11/2003 Ward et al.
2003/0213594 A1 11/2003 Wellington et al.
2004/0020642 A1 2/2004 Vinegar et al.
2004/0040715 A1 3/2004 Wellington et al.
2004/0140095 A1 7/2004 Vinegar et al.
2004/0198611 A1 10/2004 Atkinson
2004/0200618 A1 10/2004 Piekenbrock
2004/0211557 A1 10/2004 Cole et al.
2005/0051327 A1 3/2005 Vinegar et al.
2005/0194132 A1 9/2005 Dudley et al.
2005/0211434 A1 9/2005 Gates et al.
2005/0211569 A1 9/2005 Botte et al.
2005/0229491 A1 10/2005 Loffler
2005/0252656 A1 11/2005 Maguire
2005/0252832 A1 11/2005 Doyle et al.
2005/0252833 A1 11/2005 Doyle et al.
2005/0269077 A1 12/2005 Sandberg
2005/0269088 A1 12/2005 Vinegar et al.
2006/0021752 A1 2/2006 de St. Remey
2006/0100837 A1 5/2006 Symington et al.
2006/0102345 A1 5/2006 McCarthy et al.
2006/0106119 A1 5/2006 Guo et al.
2006/0199987 A1 9/2006 Kuechler et al.
2006/0213657 A1 9/2006 Berchenko et al.
2007/0000662 A1 1/2007 Symington et al.
2007/0023186 A1 2/2007 Kaminsky et al.
2007/0045265 A1 3/2007 McKinzie, II
2007/0045267 A1 3/2007 Vinegar et al.
2007/0084418 A1 4/2007 Gurevich
2007/0095537 A1 5/2007 Vinegar
2007/0102359 A1 5/2007 Lombardi et al.

(56) References Cited

U.S. PATENT DOCUMENTS

| | | | | |
|---|---|---|---|---|
| 2007/0131415 | A1 | 6/2007 | Vinegar et al. | |
| 2007/0137869 | A1 | 6/2007 | MacDougall et al. | |
| 2007/0144732 | A1 | 6/2007 | Kim et al. | |
| 2007/0209799 | A1* | 9/2007 | Vinegar et al. | 166/302 |
| 2007/0246994 | A1 | 10/2007 | Kaminsky et al. | |
| 2008/0087420 | A1 | 4/2008 | Kaminsky et al. | |
| 2008/0087421 | A1 | 4/2008 | Kaminsky | |
| 2008/0087422 | A1 | 4/2008 | Kobler et al. | |
| 2008/0087426 | A1 | 4/2008 | Kaminsky | |
| 2008/0087427 | A1 | 4/2008 | Kaminsky et al. | |
| 2008/0087428 | A1 | 4/2008 | Symington et al. | |
| 2008/0127632 | A1 | 6/2008 | Finkenrath | |
| 2008/0173443 | A1 | 7/2008 | Symington et al. | |
| 2008/0185145 | A1 | 8/2008 | Carney et al. | |
| 2008/0207970 | A1 | 8/2008 | Meurer et al. | |
| 2008/0230219 | A1 | 9/2008 | Kaminsky | |
| 2008/0271885 | A1 | 11/2008 | Kaminsky | |
| 2008/0283241 | A1 | 11/2008 | Kaminsky et al. | |
| 2008/0289819 | A1 | 11/2008 | Kaminsky et al. | |
| 2008/0290719 | A1 | 11/2008 | Kaminsky et al. | |
| 2008/0314593 | A1 | 12/2008 | Vinegar et al. | |
| 2009/0032251 | A1 | 2/2009 | Cavender et al. | |
| 2009/0038795 | A1 | 2/2009 | Kaminsky et al. | |
| 2009/0050319 | A1* | 2/2009 | Kaminsky et al. | 166/257 |
| 2009/0101346 | A1* | 4/2009 | Vinegar et al. | 166/302 |
| 2009/0101348 | A1 | 4/2009 | Kaminsky | |
| 2009/0107679 | A1 | 4/2009 | Kaminsky | |
| 2009/0133935 | A1 | 5/2009 | Kinkead | |
| 2009/0145598 | A1 | 6/2009 | Symington et al. | |
| 2009/0200290 | A1 | 8/2009 | Cardinal et al. | |
| 2009/0211754 | A1 | 8/2009 | Verret et al. | |
| 2009/0308608 | A1 | 12/2009 | Kaminsky et al. | |
| 2010/0038083 | A1 | 2/2010 | Bicerano | |
| 2010/0078169 | A1 | 4/2010 | Symington et al. | |
| 2010/0089575 | A1 | 4/2010 | Kaminsky et al. | |
| 2010/0089585 | A1 | 4/2010 | Kaminsky | |
| 2010/0095742 | A1 | 4/2010 | Symington et al. | |
| 2010/0101793 | A1 | 4/2010 | Symington et al. | |
| 2010/0133143 | A1 | 6/2010 | Roes et al. | |
| 2010/0218946 | A1 | 9/2010 | Symington et al. | |
| 2010/0276983 | A1 | 11/2010 | Dunn et al. | |
| 2010/0282460 | A1 | 11/2010 | Stone et al. | |
| 2010/0307744 | A1 | 12/2010 | Cochet et al. | |
| 2010/0314108 | A1 | 12/2010 | Crews et al. | |
| 2010/0319909 | A1 | 12/2010 | Symington et al. | |
| 2011/0000221 | A1 | 1/2011 | Minta et al. | |
| 2011/0000671 | A1 | 1/2011 | Hershkowitz | |
| 2011/0146981 | A1 | 6/2011 | Diehl | |
| 2011/0146982 | A1 | 6/2011 | Kaminsky et al. | |
| 2011/0257944 | A1 | 10/2011 | Du et al. | |
| 2011/0290490 | A1 | 12/2011 | Kaminsky et al. | |
| 2011/0309834 | A1 | 12/2011 | Homan et al. | |
| 2012/0012302 | A1 | 1/2012 | Vogel et al. | |
| 2012/0267110 | A1 | 10/2012 | Meurer et al. | |
| 2012/0325458 | A1 | 12/2012 | El-Rabaa et al. | |
| 2013/0043029 | A1 | 2/2013 | Vinegar et al. | |
| 2013/0106117 | A1 | 5/2013 | Sites | |
| 2013/0112403 | A1 | 5/2013 | Meurer et al. | |
| 2013/0277045 | A1 | 10/2013 | Parsche | |
| 2013/0292114 | A1 | 11/2013 | Lin et al. | |
| 2013/0292177 | A1 | 11/2013 | Meurer et al. | |
| 2013/0319662 | A1 | 12/2013 | Alvarez et al. | |

FOREIGN PATENT DOCUMENTS

| | | |
|---|---|---|
| CA | 2377467 | 1/2001 |
| CA | 2560223 | 3/2007 |
| EP | 0387846 | 9/1990 |
| FR | EP 0866212 | 9/1998 |
| GB | 855408 | 11/1960 |
| GB | 1454324 | 11/1976 |
| GB | 1463444 | 2/1977 |
| GB | 1 478 880 | 7/1977 |
| GB | 1501310 | 2/1978 |
| GB | 1559948 | 1/1980 |
| GB | 1595082 | 8/1981 |
| GB | 2430454 | 3/2007 |
| WO | WO 82/01408 | 4/1982 |
| WO | WO 90/06480 | 6/1990 |
| WO | WO 99/67504 | 12/1999 |
| WO | WO 01/78914 | 10/2001 |
| WO | WO 01/81505 | 11/2001 |
| WO | WO 02/085821 | 10/2002 |
| WO | WO 03/035811 | 5/2003 |
| WO | WO 2005/010320 | 2/2005 |
| WO | WO 2005/045192 | 5/2005 |
| WO | WO 2005/091883 | 10/2005 |
| WO | WO 2006/115943 | 11/2006 |
| WO | WO 2007/033371 | 3/2007 |
| WO | WO 2007/050445 | 5/2007 |
| WO | WO 2007/050479 | 5/2007 |
| WO | WO 2010/011402 | 1/2010 |
| WO | WO 2010/047859 | 4/2010 |
| WO | WO 2011/116148 | 9/2011 |
| WO | WO2011/116148 | 9/2011 |
| WO | WO 2011/153339 | 12/2011 |
| WO | WO 2014/028834 | 2/2014 |

OTHER PUBLICATIONS

Allred, (1964) "Some Characteristic Properties of Colorado Oil Shale Which May Influence in Situ Processing," *Quarterly Colo. School of Mines*, 1st *Symposium Oil Shale*, v.59. No. 3, pp. 47-75.

Asquith, G., et al., (2004) *Basic Well Log Analysis*, Second Ed., Chapter 1, pp. 1-20.

Ball, J.S., et al. (1949) "Composition of Colorado Shale-Oil Naphtha", *Industrial and Engineering Chemistry*, vol. 41, No. 3 pp. 581-587.

Barnes, A. L. et al. (1968) "Quarterly of the Colorado School of Mines" *Fifth Symposium on Oil Shale*, v. 63(4), Oct. 1968, pp. 83-108.

Bastow, T.P., (1998) Sedimentary Processes Involving Aromatic Hydrocarbons >>. Thesis (PhD in Applied Chemistry) Curtin University of Technology (Australia), December, p. 102.

Baugman, G. L. (1978) *Synthetic Fuels Data Handbook*, Second Edition, Cameron Engineers Inc.

Berry, K. L., et al. (1982) "Modified in situ retorting results of two field retorts", Gary, J. H., ed., 15th Oil Shale Symp., CSM, pp. 385-396.

Blanton, T. L. et al, (1999) "Stress Magnitudes from Logs: Effects of Tectonic Strains and Temperature", *SPE Reservoir Eval. & Eng. 2*, vol. 1, February, pp. 62-68.

Boyers, H. E. et al. (1985) "Chapter 16: Heat-Resistant Materials," *Metals Handbook*, American Society for Metals, 16 pages.

Brandt, A. R., "*Converting Oil Shale to Liquid Fuels: Energy Inputs and Greenhouse Gas Emissions of the Shell in Situ Conversion Process*," Environ. Sci. Technol. 2008, 42, pp. 7489-7495.

Brandt, H. et al. (1965) "Stimulating Heavy Oil Reservoirs With Downhole Air-Gas Burners," *World Oil*, (Sep. 1965), pp. 91-95.

Bridges, J. E., et al. (1983) "The IITRI in situ fuel recovery process", *J. Microwave Power*, v. 18, pp. 3-14.

Burnham, A. K. et al. (1983) "High-Pressure Pyrolysis of Green River Oil Shale" in Geochemistry and Chemistry of Oil Shales: ACS Symposium Series.

Burwell, E. L. et al. (1970) "Shale Oil Recovery by In-Situ Retorting—A Pilot Study" Journal of Petroleum Engr., Dec. 1970, pp. 1520-1524.

Charlier, R. et al, (2002) "Numerical Simulation of the Coupled Behavior of Faults During the Depletion of a High-Pressure/High-Temperature Reservoir", *Society of Petroleum Engineers*, SPE 78199, pp. 1-12.

Chute, F. S., and Vermeulen, F. E., (1988) "Present and potential applications of electromagnetic heating in the in situ recovery of oil", AOSTRA J. Res., v. 4, pp. 19-33.

Chute, F. S. and Vermeulen, F.E., (1989) "Electrical heating of reservoirs", Hepler, L., and Hsi, C., eds., AOSTRA Technical Handbook on Oil Sands, Bitumens, and Heavy Oils, Chapt. 13, pp. 339-376.

Cipolla, C.L., et al. (1994), "Practical Application of in-situ Stress Profiles", *Society of Petroleum Engineers*, SPE 28607, pp. 487-499.

(56) References Cited

OTHER PUBLICATIONS

Cook, G. L. et al. (1968) "The Composition of Green River Shale Oils" United Nations Symposium of the Development and Utilization of Oil Shale Resources, 23 pgs.
Covell, J. R., et al. (1984) "Indirect in situ retorting of oil shale using the TREE process", Gary, J. H., ed., 17th Oil Shale Symposium Proceedings, Colorado School of Mines, pp. 46-58.
Cummins, J. J. et al. (1972) "Thermal Degradation of Green River Kerogen at 150 to 350C: Rate of Product Formation, Report of Investigation 7620," *US Bureau of Mines*, 1972.
Day, R. L., (1998) "Solution Mining of Colorado Nahcolite, Wyoming State Geological Survey Public Information Circular 40," *Proceedings of the First International Soda Ash Conference*, V.II (Rock Springs, Wyoming, Jun. 10-12) pp. 121-130.
DePriester, C. et al. (1963) "Well Stimulation by Downhole Gas-Air Burner," *Jml. Petro. Tech.*, (Dec. 1963), pp. 1297-1302.
Domine, F. et al. (2002) "Up to What Temperature is Petroleum Stable? New Insights from a 5200 Free Radical Reactions Model", *Organic Chemistry*, 33, pp. 1487-1499.
Dougan, P. M. et al. (1981) "BX In Situ Oil Shale Project," *Colorado School of Mines; Fourteenth Oil Shale Symposium Proceedings*, 1981, pp. 118-127.
Dougan, P. M. (1979) "The BX In Situ Oil Shale Project," *Chem. Engr. Progress*, pp. 81-84.
Duncan, D. C., (1967) "Geologic Setting of Oil Shale Deposits and World Prospects," in *Proceedings of the Seventh World Petroleum Congress*, v.3, Elsevier Publishing, pp. 659-667.
Dunks, G. et al. (1983) "Electrochemical Studies of Molten Sodium Carbonate," *Inorg. Chem.*, 22, pp. 2168-2177.
Dusseault, M.B. (1998) "Casing Shear: Causes, Cases, Cures", Society of Petroleum Engineers, SPE 48,864 pp. 337-349.
Dyni, J. R., (1974) "Stratigraphy and Nahcolite Resources of the Saline Facies of the Green River Formation in Northwest Colorado," in D.K. Murray (ed.), *Guidebook to the Energy Resources of the Piceance Creek Basin Colorado, Rocky Mountain Association of Geologists*, Guidebook, pp. 111-122.
Fainberg, V. et al. (1998) "Integrated Oil Shale Processing Into Energy and Chemicals Using Combined-Cycle Technology," *Energy Sources*, v.20.6, Abstract, 1 page.
Farouq Ali, S. M., (1994), "Redeeming features of in situ combustion", DOE/NIPER *Symposium on In Situ Combustion Practices-Past, Present, and Future Application*, Tulsa, OK, Apr. 21-22, No. ISC 1, p. 3-8.
Fisher, S. T. (1980) "A Comparison of Eleven Processes for Production of Energy from the Solid Fossil Fuels of North America," *SPE* 9098, pp. 1-27.
Fox, J. P, (1980) "Water-related Impacts of In-Situ Oil Shale Processing," *California Univ., Berkeley, Lawrence Berkeley Lab*, Chapters 6-7.
Fredrich, J. T. et al, (1996) "Three-Dimensional Geomechanical Simulation of Reservoir Compaction and Implications for Well Failures in the Belridge Diatomite", *Society of Petroleum Engineers* SPE 36698, pp. 195-210.
Fredrich, J. T. et al, (2000) "Geomechanical Modeling of Reservoir Compaction, Surface Subsidence, and Casing Damage at the Belridge Diatomite Field", *SPE Reservoir Eval. & Eng.3*, vol. 4, August, pp. 348-359.
Fredrich, J. T. et al, (2003) "Stress Perturbations Adjacent to Salt Bodies in the Deepwater Gulf of Mexico", *Society of Petroleum Engineers* SPE 84554, pp. 1-14.
Frederiksen, S. et al, (2000) "A Numerical Dynamic Model for the Norwegian-Danish Basin", *Tectonophysics*, 343, 2001, pp. 165-183.
Freund, H. et al., (1989) "Low-Temperature Pyrolysis of Green River Kerogen", *The American Association of Petroleum Geologists Bulletin*, v. 73, No. 8 (August) pp. 1011-1017.
Gatens III, J. M. et al, (1990) "In-Situ Stress Tests and Acoustic Logs Determine Mechanical Properties and Stress Profiles in the Devonian Shales", *SPE Formation Evaluation* SPE 18523, pp. 248-254.
Garthoffner, E. H., (1998), "Combustion front and burned zone growth in successful California ISC projects", SPE 46244, pp. 1-11.
Greaves, M., et al. (1994) "In situ combustion (ISC) processes: 3D studies of vertical and horizontal wells", *Europe Comm. Heavy Oil Technology in a Wider Europe Symposium*, Berlin, Jun. 7-8, p. 89-112.
Hansen, K. S. et al, (1989) "Earth Stress Measurements in the South Belridge Oil Field, Kern County, California", *SPE Formation Evaluation*, December pp. 541-549.
Hansen, K. S. et al, (1993) "Finite-Element Modeling of Depletion-Induced Reservoir Compaction and Surface Subsidence in the South Belridge Oil Field, California", SPE 26074, pp. 437-452.
Hansen, K. S. et al, (1995) "Modeling of Reservoir Compaction and Surface Subsidence at South Belridge", *SPE Production & Facilities*, August pp. 134-143.
Hardy, M. et al. (2003) "Solution Mining of Nahcolite at the American Soda Project, Piceance Creek, Colorado," *SME Annual Mtg.*, Feb. 24-26, Cincinnati, Ohio, Preprint 03-105.
Hardy, M., et al. (2003) "Solution Mining of Nahcolite at American Soda's Yankee Gulch Project," *Mining Engineering*, Oct. 2003, pp. 23-31.
Henderson, W, et al. (1968) "Thermal Alteration as a Contributory Process to the Genesis of Petroleum", *Nature* vol. 219, pp. 1012-1016.
Hilbert, L. B. et al, (1999) "Field-Scale and Wellbore Modeling of Compaction-Induced Casing Failures", *SPE Drill. & Completion*, 14(2), June pp. 92-101.
Hill, G.R. et al. (1967) "The Characteristics of a Low Temperature In Situ Shale Oil," *4th Symposium on Oil Shale, Quarterly of the Colorado School of Mines*, v.62(3), pp. 641-656.
Hill, G. R. et al. (1967) "Direct Production of a Low Pour Point High Gravity Shale Oil", *I&EC Product Research and Development*, 6(1), March pp. 52-59.
Holditch, S. A., (1989) "Pretreatment Formation Evaluation", *Recent Advances in Hydraulic Fracturing*, SPE Monograph vol. 12, Chapter 2 (Henry L. Doherty Series), pp. 39-56.
Holmes, A. S. et al. (1982) "Process Improves Acid Gas Separation," *Hydrocarbon Processing*, pp. 131-136.
Holmes, A. S. et al. (1983) "Pilot Tests Prove Out Cryogenic Acid-Gas/Hydrocarbon Separation Processes," *Oil & Gas Journal*, pp. 85-91.
Humphrey, J. P. (1978) "Energy from in situ processing of Antrim oil shale", *DOE Report FE-2346-29*.
Ingram, L. L. et al. (1983) "Comparative Study of Oil Shales and Shale Oils from the Mahogany Zone, Green River Formation (USA) and Kerosene Creek Seam, Rundle Formation (Australia)," *Chemical Geology*, 38, pp. 185-212.
Ireson, A. T. (1990) "Review of the Soluble Salt Process for In-Situ Recovery of Hydrocarbons from Oil Shale with Emphasis on Leaching and Possible Beneficiation," *23rd Colorado School of Mines Oil Shale Symposium* (Golden, Colorado), 152-161.
Jacobs, H. R. (1983) "Analysis of the Effectiveness of Steam Retorting of Oil Shale", *AIChE Symposium Series—Heat Transfer*—Seattle 1983 pp. 373-382.
Johnson, D. J. (1966) "Decomposition Studies of Oil Shale," *University of Utah*, May 1966.
Katz, D.L. et al. (1978) "*Predicting Phase Behavior of Condensate/Crude-Oil Systems Using Methane Interaction Coefficients, J. Petroleum Technology*", pp. 1649-1655.
Kenter, C. J. et al, (2004) "Geomechanics and 4D: Evaluation of Reservoir Characteristics from Timeshifts in the Overburden", *Gulf Rocks 2004, 6th North America Rock Mechanics Symposium (NARMS): Rock Mechanics Across Borders and Disciplines*, Houston, Texas, Jun. 5-9, ARMA/NARMS 04-627.
Kuo, M. C. T. et al (1979) "Inorganics leaching of spent shale from modified in situ processing," J. H. Gary (ed.) *Twelfth Oil Shale Symposium Proceedings*, Colorado School of Mines, Golden CO., Apr. 18-20, pp. 81-93.
Laughrey, C. D. et al. (2003) "Some Applications of Isotope Geochemistry for Determining Sources of Stray Carbon Dioxide Gas," *Environmental Geosciences*, 10(3), pp. 107-122.
Lekas, M. A. et al. (1991) "Initial evaluation of fracturing oil shale with propellants for in situ retorting—Phase 2", *DOE Report DOE/MC/11076-3064*.

(56) References Cited

OTHER PUBLICATIONS

Le Pourhiet, L. et al, (2003) "Initial Crustal Thickness Geometry Controls on the Extension in a Back Arc Domain: Case of the Gulf of Corinth", *Tectonics*, vol. 22, No. 4, pp. 6-1-6-14.
Lundquist, L. (1951) "Refining of Swedish Shale Oil", *Oil Shale Cannel Coal Conference*, vol./Issue: 2, pp. 621-627.
Marotta, A. M. et al, (2003) "Numerical Models of Tectonic Deformation at the Baltica-Avalonia Transition Zone During the Paleocene Phase of Inversion", *Tectonophysics*, 373, pp. 25-37.
Miknis, F.P, et al (1985) "Isothermal Decomposition of Colorado Oil Shale", DOE/FE/60177-2288 (DE87009043) May 1985.
Mohammed, Y.A., et al (2001) "A Mathematical Algorithm for Modeling Geomechanical Rock Properties of the Khuff and PreKhuff Reservoirs in Ghawar Field", *Society of Petroleum Engineers* SPE 68194, pp. 1-8.
Molenaar, M. M. et al, (2004) "Applying Geo-Mechanics and 4D: '4D In-Situ Stress' as a Complementary Tool for Optimizing Field Management", *Gulf Rocks 2004, 6th North America Rock Mechanics Symposium (NARMS): Rock Mechanics Across Borders and Disciplines*, Houston, Texas, Jun. 5-9, ARMA/NARMS 04-639, pp. 1-7.
Moschovidis, Z. (1989) "Interwell Communication by Concurrent Fracturing—a New Stimulation Technique", *Joum. of Canadian Petro. Tech*. 28(5), pp. 42-48.
Motzfeldt, K. (1954) "The Thermal Decomposition of Sodium Carbonate by the Effusion Method," *Jml. Phys. Chem*., v. LIX, pp. 139-147.
Mut, Stephen (2005) "The Potential of Oil Shale," *Shell Oil Presentation at National Academies, Trends in Oil Supply Demand*, in Washington, DC, Oct. 20-21, 2005, 11 pages.
Needham, et al (1976) "Oil Yield and Quality from Simulated In-Situ Retorting of Green River Oil Shale", Society of Petroleum Engineers of American Institute of Mining, Metallurgical and Petroleum Engineers, Inc. SPE 6069.
Newkirk, A. E. et al. (1958) "Drying and Decomposition of Sodium Carbonate," *Anal. Chem*., 30(5), pp. 982-984.
Nielsen, K. R., (1995) "Colorado Nahcolite: A Low Cost Source of Sodium Chemicals," *7th Annual Canadian Conference on Markets for Industrial Minerals*, (Vancouver, Canada, Oct. 17-18) pp. 1-9.
Nottenburg, R.N. et al. (1979) "Temperature and stress dependence of electrical and mechanical properties of Green River oil shale," *Fuel*, 58, pp. 144-148.
Nowacki, P. (ed.), (1981) *Oil Shale Technical Handbook*, Noyes Data Corp.
Pattillo, P. D. et al, (1998) "Reservoir Compaction and Seafloor Subsidence at Valhall", SPE 47274, 1998, pp. 377-386.
Pattillo, P. D. et al, (2002) "Analysis of Horizontal Casing Integrity in the Valhall Field", SPE 78204, pp. 1-10.
Persoff, P. et al. (1979) "Control strategies for abandoned in situ oil shale retorts," J. H. Gary (ed.), *12th Oil Shale Symposium Proceedings*, Colorado School of Mines, Golden, CO., Apr. 18-20, pp. 72-80.
Peters, G., (1990) "The Beneficiation of Oil Shale by the Solution Mining of Nahcolite," *23rd Colorado School of Mines Oil Shale Symposium* (Golden, CO) pp. 142-151.
Plischke, B., (1994) "Finite Element Analysis of Compaction and Subsidence—Experience Gained from Several Chalk Fields", *Society of Petroleum Engineers*, SPE 28129, 1994, pp. 795-802.
Prats, M. et al. (1975) "The Thermal Conductivity and Diffusivity of Green River Oil Shales", *Journal of Petroleum Technology*, pp. 97-106, Jan. 1975.
Prats, M., et al. (1977) "Soluble-Salt Processes for In-Situ Recovery of Hydrocarbons from Oil Shale," *Journal of Petrol. Technol*., pp. 1078-1088.
Rajeshwar, K. et al. (1979) "Review: Thermophysical Properties of Oil Shales", *Journal of Materials Science*, v.14, pp. 2025-2052.
Ramey, M. et al. (2004) "The History and Performance of Vertical Well Solution Mining of Nahcolite ($NaHCO_3$) in the Piceance Basin, Northwestern, Colorado, USA," *Solution Mining Research Institute: Fall 2004 Technical Meeting* (Berlin, Germany).
Reade Advanced Materials; Electrical resistivity of materials. Retrieved from internet: http://www.reade.com/Particle%5FBriefings/elec%5Fres.html.
Riva, D. et al. (1998) "Suncor down under: the Stuart Oil Shale Project", Annual Meeting of the *Canadian Inst. of Mining, Metallurgy, and Petroleum*, Montreal, May 3-7.
Rupprecht, R. (1979) "Application of the Ground-Freezing Method to Penetrate a Sequence of Water-Bearing and Dry Formations—Three Construction Cases," *Engineering Geology*, 13, pp. 541-546.
Ruzicka, D.J. et al. (1987) "Modified Method Measures Bromine Number of Heavy Fuel Oils", *Oil & Gas Journal*, 85(31), Aug. 3, pp. 48-50.
Salamonsson, G. (1951) "The Ljungstrom In Situ Method for Shale-Oil Recovery," *2nd Oil Shale and Cannel Coal Conference*, 2, Glasgow, Scotland, Inst. of Petrol., London, pp. 260-280.
Sahu, D. et al. (1988) "Effect of Benzene and Thiophene on Rate of Coke Formation During Naphtha Pyrolysis", *Canadian Journ. of Chem. Eng*., 66, Oct. pp. 808-816.
Sandberg, C. R. et al. (1962) "In-Situ Recovery of Oil from Oil Shale—A Review and Summary of Field and Laboratory Studies," RR62.039FR, Nov. 1962.
Sierra, R. et al. (2001) "Promising Progress in Field Application of Reservoir Electrical Heating Methods," *SPE 69709*, SPE Int'l Thermal Operations and Heavy Oil Symposium, Venezuela, Mar. 2001, 17 pages.
Siskin, M. et al. (1995) "Detailed Structural Characterization of the Organic Material in Rundel Ramsay Crossing and Green River Oil Shales," *Kluwer Academic Publishers*, pp. 143-158.
Smart, K. J. et al, (2004) "Integrated Structural Analysis and Geomechanical Modeling: an Aid to Reservoir Exploration and Development", *Gulf Rocks 2004, 6th North America Rock Mechanics Symposium (NARMS): Rock Mechanics Across Borders and Disciplines*, Houston, Texas, Jun. 5-9, ARMA/NARMS 04-470.
Smith, F. M. (1966) "A Down-hole Burner—Versatile Tool for Well Heating," *25th Tech. Conf. on Petroleum Production*, Pennsylvania State Univ., pp. 275-285.
Sresty, G. C.; et al. (1982) "Kinetics of Low-Temperature Pyrolysis of Oil Shale by the IITRI RF Process," *Colorado School of Mines; Fifteenth Oil Shale Symposium Proceedings*, Aug. 1982, pp. 411-423.
Stevens, A. L., and Zahradnik, R. L. (1983) "Results from the simultaneous processing of modified in situ retorts 7& 8", Gary, J. H., ed., *16th Oil Shale Symp*., CSM, p. 267-280.
Stoss, K. et al. (1979) "Uses and Limitations of Ground Freezing With Liquid Nitrogen," *Engineering Geology*, 13, pp. 485-494.
Symington, W.A., et al (2006) ExxonMobil's electrofrac process for in situ oil shale conversion 26th Oil Shale Symposium, Colorado School of Mines.
Syunyaev, Z.I. et al. (1965) "Change in the Resistivity of Petroleum Coke on Calcination," Chemistry and Technology of Fuels and Oils, 1(4), pp. 292-295.
Templeton, C. C. (1978) "Pressure-Temperature Relationship for Decomposition of Sodium Bicarbonate from 200 to 600° F.," *J. of Chem. and Eng. Data*, 23(1), pp. 7-8.
Thomas, A. M. (1963) "Thermal Decomposition of Sodium Carbonate Solutions," *J. of Chem. and Eng. Data*, 8(1), pp. 51-54.
Thomas, G. W. (1964) "A Simplified Model of Conduction Heating in Systems of Limited Permeability," *Soc.Pet. Engineering Journal*, Dec. 1964, pp. 335-344.
Thomas, G. W. (1966) "Some Effects of Overburden Pressure on Oil Shale During Underground Retorting," *Society of Petroleum Engineers Journal*, pp. 1-8, Mar. 1966.
Tihen, S. S. et al. (1967) "Thermal Conductivity and Thermal Diffusivity of Green River Oil Shale," *Thermal Conductivity: Proceedings of the Seventh Conference* (Nov. 13-16, 1967), *NBS Special Publication* 302, pp. 529-535, 1968.
Tisot, P. R. et al. (1970) "Structural Response of Rich Green River Oil Shales to Heat and Stress and Its Relationship to Induced Permeability," *Journal of Chemical Engineering Data*, v. 15(3), pp. 425-434.
Tisot, P. R. et al. (1971) "Structural Deformation of Green River Oil Shale as It Relates to In Situ Retorting," *US Bureau of Mines Report of Investigations 7576*, 1971.

(56) References Cited

OTHER PUBLICATIONS

Tisot, P. R. (1975) "Structural Response of Propped Fractures in Green River Oil Shale as It Relates to Underground Retorting," *US Bureau of Mines Report of Investigations 8021*.
Tissot, B. P., and Welte, D. H. (1984) *Petroleum Formation and Occurrence*, New York, Springer-Verlag, p. 160-174, 175-198 and 254-266.
Tissot, B. P., and Welte, D. H. (1984) *Petroleum Formation and Occurrence*, New York, Springer-Verlag, p. 267-289 and 470-492.
Turta, A., (1994), "In situ combustion—from pilot to commercial application", *DOE/NIPER Symposium on In Situ Combustion Practices-Past, Present, and Future Application*, Tulsa, OK, Apr. 21-22, No. ISC 3, p. 15-39.
Tyner, C. E. et al. (1982) "Sandia/Geokinetics Retort 23: a horizontal in situ retorting experiment", Gary, J. H., ed., *15th Oil Shale Symp*., CSM, p. 370-384.
Tzanco, E. T., et al. (1990), "Laboratory Combustion Behavior of Countess B Light Oil", *Petroleum Soc. of CIM and SPE*, Calgary, Jun. 10-13, No. CIM/SPE 90-63, p. 63.1-63.16.
Veatch, Jr. R.W. and Martinez, S.J., et al. (1990) "Hydraulic Fracturing: Reprint Series No. 28", *Soc. of Petroleum Engineers* SPE 14085, Part I, Overview.
Warpinski, N.R., (1989) "Elastic and Viscoelastic Calculations of Stresses in Sedimentary Basins", *SPE Formation Evaluation*, vol. 4, pp. 522-530.
Yen, T. F. et al. (1976) *Oil Shale*, Amsterdam, Elsevier, p. 216-267.
Yoon, E. et al. (1996) "High-Temperature Stabilizers for Jet Fuels and Similar Hydrocarbon Mixtures. 1. Comparative Studies of Hydrogen Donors", *Energy & Fuels*, 10, pp. 806-811.
Oil & Gas Journal, 1998, "Aussie oil shale project moves to Stage 2", Oct. 26, p. 42.
"Encyclopedia of Chemical Technology" ($4^{th}$ ed.), *Alkali and Chlorine Products*, pp. 1025-1039 (1998).
EP Search Report dated Dec. 29, 2003 (RS 110243, Corresponding to US Pat 7,331,385).
EP Search Report dated Mar. 17, 2004 (RS 110686, Corresponding to U.S. Patent 7,441,603).
EP Search Report, Supplementary dated Apr. 10, 2007 (EP 04 77 9878 Corresponding to U.S. Patent 7,441,603).
EP Search Report dated Apr. 29, 2005 (RS 112183, Corresponding to U.S. Appl. No. 11/250,804, Published as US 2006/0100837 on May 11, 2008).
EP Search Report dated Jun. 2, 2006 (RS113865, corresponding to U.S. Appl. No. 11/726,651).
EP Search Report dated Feb. 16, 2007 (RS 114808, Corresponding to U.S. Appl. No. 11/973,746, Published as US 2008/0087420 on May 17, 2008).
EP Search Report dated Feb. 16, 2007 (RS 114804, Corresponding to U.S. Appl. No. 11/973,750, Published as US 2008/0087427 on Apr. 17, 2008).
EP Search Report dated Mar. 21, 2007 (RS 114890, Corresponding to U.S. Patent 7,516,787).
EP Search Report dated Feb. 16, 2007 (RS 114807, Corresponding to U.S. Patent 7,669,657).
EP Search Report dated Nov. 13, 2007 (RS 115479, Corresponding to U.S. Appl. No. 12/148,414).
EP Search Report dated Aug. 29, 2007 (No. RS115553, Corresponding to U.S. Appl. No. 12/148,388).
EP Search Report dated Jul. 4, 2007 ( RS 115341 Corresponding to U.S. Appl. No. 12/074,899).
EP Search Report dated Jul. 5, 2007 (RS 115432 Corresponding to U.S. Appl. No. 12/075,087).
EP Search Report dated Mar. 12, 2009 (EP 08 00 3956,—Corresponding to U.S. Appl. No. 12/271,521).
EP Search Report dated Aug. 29, 2007 (RS 1155554, Corresponding to U.S. Appl. No. 12/154,238).
EP Search Report dated Aug. 28, 2007 (RS 1155555, Corresponding to U.S. Appl. No. 12/154,256).
International Search Report for PCT/US01/09247 Jun. 20, 2001.
International Search Report for PCT/US04/11508, Jan. 5, 2005.
International Search Report for PCT/US08/88045, Feb. 12, 2009.
International Search Report for PCT/US04/24947 Mar. 10 2005.
International Search Report for PCT/US07/07133, Jan. 4, 2008.
International Search Report for PCT/US07/21673 Jun. 24, 2008.
International Search Report for PCT/US07/21668 Apr. 29, 2008.
International Search Report for PCT/US07/21666 Apr. 4, 2008.
International Search Report for PCT/US07/21669, Apr. 29, 2008.
International Search Report for PCT/US07/21660 Apr. 4, 2008.
International Search Report for PCT/US07/021968, May 14, 2008.
International Search Report for PCT/US07/021968, May 21, 2008.
International Search Report for PCT/US08/005008, Aug. 29, 2008.
International Search Report for PCT/US08/05056, Aug. 25, 2008.
International Search Report for PCT/US/08/003069, Jun. 25, 2008.
International Search Report for PCT/US08/003043, Jul. 2, 2008.
International Search Report for PCT/US08/083815, Mar. 20, 2009.
International Search Report for PCT/US08/006462 Sep. 22, 2008.
International Search Report for PCT/US08/006463 Aug. 22, 2008.
International Search Report for PCT/US07/21645 Apr. 21, 2008.
International Search Report for PCT/US09/037419 Jul. 7, 2009.
International Search Report for PCT/US09/055403, Oct. 22, 2009.
International Search Report for PCT/US10/20342 Feb. 26, 2010.
International Search Report for PCT/US10/031910 Aug. 3, 2010.
International Search Report for PCT/US10/057204 Jan. 27, 2011.
U.S. Appl. No. 12/630,636 Office Action mailed Oct. 27, 2010.
U.S. Appl. No. 11/250,804 Office Action mailed Oct. 16, 2008.
U.S. Appl. No. 11/250,804 Office Action mailed Jun. 11, 2009.
U.S. Appl. No. 11/973,746 Office Action mailed Jun. 25, 2009.
U.S. Appl. No. 11/973,746 Office Action mailed Nov. 8, 2010.
U.S. Appl. No. 11/973,750 Office Action mailed Dec. 4, 2008.
U.S. Appl. No. 11/973,750 Office Action mailed Jul. 22, 2009.
U.S. Appl. No. 12/638,630 Office Action mailed Mar. 16, 2011.
U.S. Appl. No. 12/712,904 Office Action mailed Nov. 10, 2010.
U.S. Appl. No. 12/148,414 Office Action mailed May 19, 2010.
U.S. Appl. No. 12/148,414 Office Action mailed Oct. 22, 2010.
U.S. Appl. No. 12/148,388 Office Action mailed Jun. 10, 2010.
U.S. Appl. No. 12/148,388 Office Action mailed Nov. 19, 2010.
U.S. Appl. No. 12/074,899 Office Action mailed Dec. 16, 2009.
U.S. Appl. No. 12/074,899 Office Action mailed Jul. 26, 2010.
U.S. Appl. No. 12/074,899 Office Action mailed Jan. 4, 2011.
U.S. Appl. No. 12/075,087 Office Action mailed Oct. 12, 2010.
U.S. Appl. No. 12/075,087 Office Action mailed Mar. 7, 2011.
U.S. Appl. No. 12/271,521 Office Action mailed Nov. 2, 2010.
U.S. Appl. No. 11/973,898 Office Action mailed May 6, 2010.
U.S. Appl. No. 11/973,898 Office Action mailed Dec. 20, 2010.
U.S. Appl. No. 12/405,901 Office Action mailed Feb. 14, 2011.
U.S. Appl. No. 12/154,238 Office Action mailed Apr. 22, 2011.
U.S. Pat No. 6,918,444—Office Action mailed Sep. 16, 2004.
US Pat No. 7,331,385—Office Action mailed Jul. 12, 2007.
U.S. Pat No. 7,631,691—Office Action mailed Mar. 18, 2009.
U.S. Pat No. 7,441,603—Office Action mailed Feb. 25, 2008.
U.S. Pat No. 7,857,056—Office Action mailed Mar. 19, 2010.
US Pat No. 7,516,785—Office Action mailed Apr. 2, 2008.
US Pat No. 7,516,787—Office Action mailed Apr. 3, 2008.
U.S. Pat No. 7,647,972—Office Action mailed May 19, 2009.
U.S. Pat No. 7,647,971—Office Action mailed May 21, 2009.
U.S. Pat No. 7,669,657—Office Action mailed Jun. 26, 2008.
U.S. Pat No. 7,669,657—Office Action mailed Dec. 15, 2008.
U.S. Pat No. 7,669,657—Office Action mailed Sep. 15, 2009.
US Pat No. 7,644,993—Office Action mailed Jun. 24, 2009.
Anderson, R., et al (2003) "Power Generation with 100% Carbon Capture Sequestration" $2^{nd}$ Annual Conference on Carbon Sequestration, Alexandria, VA.
Bridges, J.E., (2007) "Wind Power Energy Storage for In Situ Shale Oil Recovery With Minimal CO2 Emissions", IEEE Transactions on Energy Conversion, vol. 22, No. 1 Mar. 2007, pp. 103-109.
Fox, J. P., et al. (1979) "Partitioning of major, minor, and trace elements during simulated in situ oil shale retorting in a controlled-state retort", Twelfth Oil Shale Symposium Proceedings, Colorado School of Mines, Golden Colorado, Apr. 18-20, 1979, p. 58-71.
Garland, T. R., et al. (1979) "Influence of irrigation and weathering reactions on the composition of percolates from retorted oil shale in field lysimeters", Twelfth Oil Shale Symposium Proceedings, Colorado School of Mines, Golden Colorado, Apr. 18-20, 1979, pp. 52-57.

(56) References Cited

OTHER PUBLICATIONS

Kilkelly, M. K., et al. (1981), "Field Studies on Paraho Retorted Oil Shale Lysimeters: Leachate, Vegetation, Moisture, Salinity and Run-off, 1977-1980", prepared for Industrial Environmental Research Laboratory, U. S. Environmental Protection Agency, Cincinnati, OH.
Nordin, J. S, et al. (1988), "Groundwater studies at Rio Blanco Oil Shale Company's retort 1 at Tract C-a", DOE/MC/11076-2458.
Poulson, R. E., et al. (1985), "Organic Solute Profile of Water from Rio Blanco Retort 1", DOE/FE/60177-2366.
Rio Blanco Oil Shale Company, (1986), "MIS Retort Abandonment Program" Jun. 1986 Pumpdown Operation.
Robson, S. G. et al., (1981), "Hydrogeochemistry and simulated solute transport, Piceance Basin, northwestern Colorado", U. S. G. S. Prof. Paper 1196.
Stanford University, (2008) "Transformation of Resources to Reserves: Next Generation of Heavy-Oil Recovery Techniques", Prepared for U.S. Department of Energy, National Energy Technology Laboratory, DOE Award No. DE-FC26-04NT15526, Mar. 28, 2008.
Taylor, O. J., (1987), "Oil Shale, Water Resources and Valuable Minerals of the Piceance Basin, Colorado: The Challenge and Choices of Development". U. S. Geol. Survey Prof. Paper 1310, pp. 63-76.

* cited by examiner

ENHANCED CONVECTION FOR IN SITU PYROLYSIS OF ORGANIC-RICH ROCK FORMATIONS

CROSS REFERENCE TO RELATED APPLICATIONS

This application claims the benefit under 35 U.S.C. §119 (e) of U.S. Provisional Patent Application No. 61/287,568, which was filed on 17 Dec. 2009, which was entitled "Enhanced Convection for In Situ Pyrolysis of Organic-Rich Rock Formations."

This application is related to U.S. patent application Ser. No. 12/074,899, which was filed on Mar. 7, 2008. Application Ser. No. 12/074,899 is entitled "Granular Electrical Connections for In Situ Formation Heating," has issued as U.S. Pat. No. 8,087,460, and is incorporated herein in its entirety by reference. That application claimed the benefit of U.S. Provisional Patent Application No. 60/919,391, which was filed on Mar. 22, 2007. That provisional application was also entitled "Granular Electrical Connections for In Situ Formation Heating."

BACKGROUND

1. Technical Field

This description relates to the field of hydrocarbon recovery from subsurface formations. More specifically, this description relates to the in situ recovery of hydrocarbon fluids from organic-rich rock formations including, for example, oil shale formations, coal formations and tar sands formations. This description also relates to methods for providing enhanced thermal convection through organic-rich rock formations during the pyrolysis process.

2. General Discussion of Technology

Certain geological formations are known to contain an organic matter known as "kerogen." Kerogen is a solid, carbonaceous material. When kerogen is imbedded in rock formations, the mixture is referred to as oil shale. This is true whether or not the mineral is, in fact, technically shale, that is, a rock formed from compacted clay.

Kerogen is subject to decomposing upon exposure to heat over a period of time. Upon heating, kerogen molecularly decomposes to produce oil, gas, and carbonaceous coke. Small amounts of water may also be generated. The oil, gas and water fluids become mobile within the rock matrix, while the carbonaceous coke remains essentially immobile.

Oil shale formations are found in various areas worldwide, including the United States. Such formations are notably found in Wyoming, Colorado, and Utah. Oil shale formations tend to reside at relatively shallow depths and are often characterized by limited permeability. Some consider oil shale formations to be hydrocarbon deposits which have not yet experienced the years of heat and pressure thought to be required to create conventional oil and gas reserves.

The decomposition rate of kerogen to produce mobile hydrocarbons is temperature dependent. Temperatures generally in excess of 270° C. (518° F.) over the course of many months may be required for substantial conversion. At higher temperatures substantial conversion may occur within shorter times. When kerogen is heated to the necessary temperature, chemical reactions break the larger molecules forming the solid kerogen into smaller molecules of oil and gas. The thermal conversion process is referred to as pyrolysis or retorting.

Attempts have been made for many years to extract oil from oil shale formations. Near-surface oil shales have been mined and retorted at the surface for over a century. In 1862, James Young began processing Scottish oil shales. The industry lasted for about 100 years. Commercial oil shale retorting through surface mining has been conducted in other countries as well. Such countries include Australia, Brazil, China, Estonia, France, Russia, South Africa, Spain, Jordan and Sweden. However, the practice has been mostly discontinued in recent years because it proved to be uneconomical or because of environmental constraints on spent shale disposal. (See T. F. Yen, and G. V. Chilingarian, "*Oil Shale,*" Amsterdam, Elsevier, p. 292, the entire disclosure of which is incorporated herein by reference.) Further, surface retorting requires mining of the oil shale, which limits that particular application to very shallow formations.

In the United States, the existence of oil shale deposits in northwestern Colorado has been known since the early 1900's. While research projects have been conducted in this area from time to time, no serious commercial development has been undertaken. Most research on oil shale production was carried out in the latter half of the 1900's. The majority of this research was on shale oil geology, geochemistry, and retorting in surface facilities.

In 1947, U.S. Pat. No. 2,732,195 issued to Fredrik Ljungstrom. That patent, entitled "Method of Treating Oil Shale and Recovery of Oil and Other Mineral Products Therefrom," proposed the application of heat at high temperatures to the oil shale formation in situ. The purpose of such in situ heating was to distill hydrocarbons and produce them to the surface. The '195 Ljungstrom patent is incorporated herein in its entirety by reference.

Ljungstrom coined the phrase "heat supply channels" to describe bore holes drilled into the formation. The bore holes received an electrical heat conductor which transferred heat to the surrounding oil shale. Thus, the heat supply channels served as early heat injection wells. The electrical heating elements in the heat injection wells were placed within sand or cement or other heat-conductive material to permit the heat injection wells to transmit heat into the surrounding oil shale while substantially preventing the inflow of fluid. According to Ljungstrom, the subsurface "aggregate" was heated to between 500° and 1,000° C. in some applications.

Along with the heat injection wells, fluid producing wells were completed in near proximity to the heat injection wells. As kerogen was pyrolyzed upon heat conduction into the aggregate or rock matrix, the resulting oil and gas would be recovered through the adjacent production wells.

Ljungstrom applied his approach of thermal conduction from heated wellbores through the Swedish Shale Oil Company. A full-scale plant was developed that operated from 1944 into the 1950's. (See G. Salamonsson, "The Ljungstrom In Situ Method for Shale-Oil Recovery," $2^{nd}$ Oil Shale and Cannel Coal Conference, v. 2, Glasgow, Scotland, Institute of Petroleum, London, p. 260-280 (1951), the entire disclosure of which is incorporated herein by reference.)

Additional in situ methods have been proposed. These methods generally involve the injection of heat and/or solvent into a subsurface oil shale formation. Heat may be in the form of heated methane (see U.S. Pat. No. 3,241,611 to J. L. Dougan), flue gas, or superheated steam (see U.S. Pat. No. 3,400,762 to D. W. Peacock). Heat may also be in the form of electric resistive heating, dielectric heating, radio frequency (RF) heating (U.S. Pat. No. 4,140,180, assigned to the ITT Research Institute in Chicago, Ill.) or oxidant injection to support in situ combustion. In some instances, artificial permeability has been created in the matrix to aid the movement of pyrolyzed fluids upon heating. Permeability generation methods include mining, rubblization, hydraulic fracturing (see U.S. Pat. No. 3,468,376 to M. L. Slusser and U.S. Pat. No. 3,513,914 to J. V. Vogel), explosive fracturing (see U.S. Pat. No. 1,422,204 to W. W. Hoover, et al.), heat fracturing (see U.S. Pat. No. 3,284,281 to R. W. Thomas), and steam fracturing (see U.S. Pat. No. 2,952,450 to H. Purre).

It has been disclosed to run alternating current or radio frequency electrical energy between stacked conductive fractures or electrodes in the same well in order to heat a subterranean formation. See U.S. Pat. No. 3,149,672 titled "Method and Apparatus for Electrical Heating of Oil-Bearing Formations;" U.S. Pat. No. 3,620,300 titled "Method and Apparatus for Electrically Heating a Subsurface Formation;" U.S. Pat. No. 4,401,162 titled "In Situ Oil Shale Process;" and U.S. Pat. No. 4,705,108 titled "Method for In Situ Heating of Hydrocarbonaceous Formations." U.S. Pat. No. 3,642,066 titled "Electrical Method and Apparatus for the Recovery of Oil," provides a description of resistive heating within a subterranean formation by running alternating current between different wells. Others have described methods to create an effective electrode in a wellbore. See U.S. Pat. No. 4,567,945 titled "Electrode Well Method and Apparatus;" and U.S. Pat. No. 5,620,049 titled "Method for Increasing the Production of Petroleum from a Subterranean Formation Penetrated by a Wellbore."

U.S. Pat. No. 3,137,347 titled "In Situ Electrolinking of Oil Shale," describes a method by which electric current is flowed through a fracture connecting two wells to get electric flow started in the bulk of the surrounding formation. Heating of the formation occurs primarily due to the bulk electrical resistance of the formation. F. S. Chute and F. E. Vermeulen, *Present and Potential Applications of Electromagnetic Heating in the In Situ Recovery of Oil*, AOSTRA J. Res., v. 4, p. 19-33 (1988) describes a heavy-oil pilot test where "electric preheat" was used to flow electric current between two wells to lower viscosity and create communication channels between wells for follow-up with a steam flood.

In 1989, U.S. Pat. No. 4,886,118 issued to Shell Oil Company. That patent, entitled "Conductively Heating a Subterranean Oil Shale to Create Permeability and Subsequently Produce Oil," declared that "[c]ontrary to the implications of . . . prior teachings and beliefs . . . the presently described conductive heating process is economically feasible for use even in a substantially impermeable subterranean oil shale." (col. 6, ln. 50-54). Despite this declaration, it is noted that few, if any, commercial in situ shale oil operations have occurred other than Ljungstrom's. The '118 patent proposed controlling the rate of heat conduction within the rock surrounding each heat injection well to provide a uniform heat front. The '118 Shell patent is incorporated herein in its entirety by reference.

Additional history behind oil shale retorting and shale oil recovery can be found in co-owned U.S. Pat. No. 7,331,385 entitled "Methods of Treating a Subterranean Formation to Convert Organic Matter into Producible Hydrocarbons," and in U.S. Pat. No. 7,441,603 entitled "Hydrocarbon Recovery from Impermeable Oil Shales." The Backgrounds and technical disclosures of these two patent publications are incorporated herein by reference.

A need exists for improved processes for the production of shale oil. In addition, a need exists for improved methods for heating organic-rich rock formations in connection with an in situ pyrolyzation process. Further, a need exists for a process that enhances the effective thermal diffusivity within a formation undergoing pyrolysis, and which may be employed ancillary to various heating techniques.

SUMMARY

The methods described herein have various benefits in improving the recovery of hydrocarbon fluids from an organic-rich rock formation such as a formation containing solid hydrocarbons or heavy hydrocarbons. In various embodiments, such benefits may include increased production of hydrocarbon fluids from an organic-rich rock formation, and providing a source of electrical energy for the recovery operation, such as a shale oil production operation.

In one general aspect, a method for producing hydrocarbon fluids from an organic-rich rock formation to a surface facility includes providing at least one production well adjacent at least one in situ heat source, each in situ heat source configured to generate heat within the organic-rich rock formation so as to pyrolyze solid hydrocarbons into hydrocarbon fluids. The organic-rich rock formation is heated in situ so that a temperature of at least 270° C. is created within the organic-rich rock formation proximal the at least one heat source. The organic-rich rock formation is continually heated in situ so that heat moves away from the at least one heat source and through the formation at a first value of effective thermal diffusivity, $\alpha_1$. The organic-rich rock formation is further heated in situ so that permeability is increased and thermal fractures are caused to be formed in the formation adjacent the production wells. A gas is injected into the organic-rich rock formation in order to increase the value of effective thermal diffusivity within the formation to an adjusted second value, $\alpha_2$, wherein $\alpha_2$ is at least 50% greater than the first value $\alpha_1$. Production fluids are produced from the organic-rich rock formation through the at least one production well.

Implementations of this aspect may include one or more of the following features. For example, the organic-rich rock formation may include heavy hydrocarbons or solid hydrocarbons. The organic-rich rock formation may be an oil shale formation. The oil shale formation may have an initial permeability of less than about 10 millidarcies. The thermal fractures may be formed adjacent the plurality of production wells before gas is injected into the oil shale formation. A substantial portion of the gas may be injected through the thermal fractures. The second effective thermal diffusivity value $\alpha_2$ may be at least 100% greater than the first effective thermal diffusivity value $\alpha_1$. Each heat source may include an electrically conductive heater, such as electrical resistance wellbore heater or electrically conductive fracture. Each heat source may include an electrical resistance heater, (i) wherein resistive heat is generated within a wellbore, (ii) wherein resistive heat is generated primarily from a conductive material within a wellbore, and/or (iii) wherein resistive heat is generated primarily from a conductive material disposed within the organic-rich rock formation.

Each heat source may include (i) a downhole combustion well wherein hot flue gas is circulated within a wellbore or through fluidly connected wellbores, and/or (ii) a closed-loop circulation of hot fluid through the organic-rich rock formation. Injecting a gas into the oil shale formation may further include injecting the gas through wellbores associated with the respective heat sources and/or separate wellbores. Injecting a gas into the oil shale formation may include forming a plurality of gas injection wells, each gas injection well being formed closer to a wellbore associated with a heat source than to a wellbore associated with an adjacent production well. The temperature of the oil shale formation may be estimated at two or more points in the formation. One or more thermal diffusivities in the formation may be estimated using estimated formation temperatures. An injection rate of injected gas into one or more gas injection wells may be adjusted so as to modify the second value of effective thermal diffusivity, $\alpha_2$. The estimation of temperatures may include obtaining measurements from sensors associated with three or more of the plurality of production wells. The estimation of temperatures may include obtaining measurements from sensors associated with monitoring wells, heater wells or dedicated gas injection wells.

The gas at the surface facility may be heated before injecting the gas into the oil shale formation. The gas may be heated either by passing the gas through a burner, or by passing the gas through a heat exchanger wherein the gas is heat-exchanged with the production fluids. The gas may be injected into the organic-rich rock formation only after production fluids are produced from at least two of the plurality of production wells. The injected gas may be substantially non-reactive in the organic-rich rock formation. The injected gas may include one or more of (i) nitrogen, (ii) carbon dioxide, (iii) methane, and/or (iv) combinations thereof. The injected gas may include hydrocarbon gas produced from the production wells. A production rate from one or more of the plurality of production wells may be adjusted so as to further modify the second value of effective thermal diffusivity, $\alpha_2$.

In another general aspect, a method of causing pyrolysis of formation hydrocarbons within an oil shale formation, the oil shale formation having an initial permeability of less than about 10 millidarcies, includes providing a plurality of in situ heat sources, each heat source configured to generate heat within the oil shale formation so as to pyrolyze solid hydrocarbons into hydrocarbon fluids. A plurality of production wells are provided adjacent selected heat sources, and the oil shale formation is heated in situ so that a temperature of at least 270° C. is created within the oil shale formation proximal the heat source. The oil shale formation is heated in situ so that heat moves away from the respective heat sources and through the formation at a first value of effective thermal diffusivity, $\alpha_1$. The oil shale formation is further heated in situ so that thermal fractures are caused to be formed in the formation adjacent the production wells. A gas is injected into the oil shale formation in order to increase the value of effective thermal diffusivity within the formation to a second value, $\alpha_2$, wherein $\alpha_2$ is at least 50% greater than the first value $\alpha_1$.

Implementations of this aspect may include one or more of the following features. For example, hydrocarbon fluids may be produced from the oil shale formation through the plurality of production wells. The thermal fractures may be formed adjacent the plurality of production wells before gas is injected into the oil shale formation. A substantial portion of the gas may be injected through the thermal fractures. Each heat source may include (i) an electrical resistance heater wherein resistive heat is generated primarily from an elongated metallic member, (ii) an electrical resistance heater wherein resistive heat is generated primarily from a conductive granular material within a wellbore, (iii) an electrical resistance heater wherein resistive heat is generated primarily from a conductive granular material disposed within the oil shale formation, (iv) a downhole combustion well wherein hot flue gas is circulated within a wellbore, and/or (v) a closed-loop circulation of hot fluid through the organic-rich rock formation. The gas may be injected through wellbores associated with the respective heat sources. A plurality of gas injection wells may be formed, each gas injection well being formed closer to a wellbore associated with a heat source than to a wellbore associated with an adjacent producer well.

The temperature of the oil shale formation may be monitored using sensors placed within wellbores associated with at least three of the plurality of production wells. An injection rate of injected gas into one or more gas injection wells may be adjusted so as to modify the second value of effective thermal diffusivity, $\alpha_2$ and thereby heat the oil shale formation more uniformly. The gas at the surface facility may be heated before injecting the gas into the oil shale formation. The gas may be heated at the surface to a temperature between about 150° C. and 270° C. The injected gas may include one or more of (i) nitrogen, (ii) carbon dioxide, (iii) methane, (iv) hydrocarbon gas produced from the production wells, (v) hydrogen, and/or (v) combinations thereof. Temperatures of produced fluids may be monitored from at least three of the plurality of production wells. A rate of injection of gas into the oil shale formation may be adjusted in response to monitored temperature(s). In response to the monitoring, production rates may be adjusted from one or more production wells so as to more uniformly or selectively heat the oil shale formation.

The second value of effective thermal diffusivity, $\alpha_2$, may be determined by estimating in situ temperatures for at least two points within the oil shale formation, modeling thermal behavior within the oil shale formation using a computer-based model which incorporates gas flow as a mechanism of heat transfer, and fitting the thermal model to the in situ temperature estimates by adjusting a thermal diffusivity parameter in the model to obtain an adjusted value of effective thermal diffusivity ($\alpha_2$). The adjusted thermal diffusivity parameter value ($\alpha_2$) to a value ($\alpha_1$) estimated or determined empirically for a case with no gas injection.

In another general aspect, a system for producing hydrocarbon fluids from an organic-rich rock formation to a surface facility includes at least one in situ heat source. Each in situ heat source is configured to generate heat within the organic-rich rock formation so as to pyrolyze solid hydrocarbons into hydrocarbon fluids and to heat the organic-rich rock formation in situ so that a temperature of at least 270° C. is created within the organic-rich rock formation proximal the at least one heat source, so that heat moves away from the at least one in situ heat source, and so that permeability is increased. At least one production well is provided adjacent at least one in situ heat source. At least one gas injection wellbore is configured to inject gas into the organic-rich rock formation in order to increase the value of effective thermal diffusivity within the formation from a first value of effective thermal diffusivity, $\alpha_1$ to an adjusted second value, $\alpha_2$, wherein $\alpha_2$ is at least 50% greater than the first value $\alpha_1$.

Implementations of this aspect may include one or more of the following features. For example, the at least one in situ heat may include an electrical conductive heater, electrically conductive fracture, and/or an electrically resistive wellbore heater. The electrically resistive wellbore heater may be positioned within a wellbore, the wellbore being configured to also operate as the at least one gas injection wellbore.

A method for producing hydrocarbon fluids from an organic-rich rock formation to a surface facility is first provided. The organic-rich rock formation comprises formation hydrocarbons such as solid hydrocarbons or heavy hydrocarbons. In one aspect, the organic-rich rock formation is an oil shale formation. Preferably, the formation has an initial permeability of about less than 10 millidarcies.

The method includes providing a plurality of in situ heat sources. Each heat source is configured to generate heat within the organic-rich rock formation so as to pyrolyze solid hydrocarbons into hydrocarbon fluids. Various types of heat sources may be used. These may include one or more of (i) an electrical resistance heater wherein resistive heat is generated from an elongated metallic member within a wellbore, and where an electrical circuit is formed using granular material within the wellbore, (ii) an electrical resistance heater wherein resistive heat is generated primarily from a conductive granular material within a wellbore, (iii) an electrical resistance heater wherein resistive heat is generated primarily from a conductive granular material disposed within the organic-rich rock formation between two or more adjacent wellbores to form an electrical circuit, (iv) an electrical resistance heater wherein heat is generated primarily from elongated, electrically conductive metallic members in adjacent wellbores, and where an electrical circuit is formed using granular material within the formation between the adjacent wellbores, (v) a downhole combustion well wherein hot flue gas is circulated within a wellbore or between connected wellbores, (v) a closed-loop circulation of hot fluid through the organic-rich rock formation, and/or (vi) combinations thereof.

The method also includes heating the organic-rich rock formation in situ. The purpose of heating is to cause pyrolysis of formation hydrocarbons. Preferably, the organic-rich rock formation is heated to a temperature of at least 270° C. Heating of the organic-rich rock formation continues so that heat moves away from the respective heat sources and through the formation at a first value of effective diffusivity, $\alpha_1$.

The method also includes providing a plurality of production wells adjacent selected heat sources. As heating of the organic-rich rock formation continues, thermal fractures are caused to be formed in the formation adjacent the production wells. This allows fluid communication to be created or enhanced within the subsurface formation.

The method also includes injecting a gas into the organic-rich rock formation. The injected gas is preferably substantially non-reactive in the organic-rich rock formation. The injected gas may be, for example, (i) nitrogen, (ii) carbon dioxide, (iii) methane, or (iv) combinations thereof. Alternatively, the injected gas may be hydrocarbon gas produced from production wells in the area. The purpose for injecting the gas is to increase the value of effective thermal diffusivity within the subsurface formation to a second value, $\alpha_2$. The second value $\alpha_2$ is at least 50% greater than the first value $\alpha_1$ and, more preferably, is at least 100% greater than $\alpha_1$.

In one aspect, the thermal fractures are formed adjacent the plurality of production wells before gas is injected into the oil shale or other formation. Here, injecting a gas comprises injecting a substantial portion of the gas through the thermal fractures.

The method also includes producing production fluids from the organic-rich rock formation through the plurality of production wells. The production fluids have been at least partially generated as a result of pyrolysis of the formation hydrocarbons located in the organic-rich rock formation. The production fluids may have both condensable (liquid) and noncondensable (gas) components.

In one embodiment of the method, injecting a gas into the formation comprises injecting the gas through wellbores associated with the respective heat sources. In another embodiment, injecting a gas into the formation comprises forming a plurality of gas injection wells, with each gas injection well being formed closer to a wellbore associated with a heat source than to a wellbore associated with an adjacent producer well. In this instance, gas is injected through the dedicated gas injection wells.

In one aspect, the method further includes monitoring the temperature of the oil shale formation using sensors placed within wellbores associated with at least three of the plurality of production wells. The rate of injection for the injected gas through one or more gas injection wells may then be adjusted in response to measurements by the sensors. This serves to modify the second value of effective thermal diffusivity, $\alpha_2$.

The injected gas is preferably heated before injection. In one arrangement, the gas is heated at the surface facility before it is injected into the oil shale or other subsurface formation. The gas may be heated, for example, by passing the gas through a burner at the surface facility, or by passing the gas through a heat exchanger wherein the gas is heat-exchanged with the production fluids at the surface facility. Preferably, the gas is heated to a temperature between about 150° C. and 270° C. before injection.

A method of causing pyrolysis of formation hydrocarbons within an oil shale formation is also provided. In one aspect, the method includes providing a plurality of in situ heat sources. Each heat source is configured to generate heat within the oil shale formation so as to pyrolyze solid hydrocarbons into hydrocarbon fluids. Various types of heat sources may be used as listed above.

The method also includes heating the oil shale formation in situ. The purpose of heating is to cause pyrolysis of formation hydrocarbons. Preferably, the organic-rich rock formation is heated to a temperature of at least 270° C. Heating of the organic-rich rock formation continues so that heat moves away from the respective heat sources and through the formation at a first value of effective thermal diffusivity, $\alpha_1$.

The method also includes providing a plurality of production wells adjacent selected heat sources. As heating of the oil shale formation continues, thermal fractures are caused to be formed in the formation adjacent the production wells. The thermal fractures enhance permeability of the oil shale formation. In one aspect, the initial permeability of the oil shale formation is less than about 10 millidarcies.

The method also includes injecting a gas into the organic-rich rock formation. The injected gas is preferably substantially non-reactive in the organic-rich rock formation. The injected gas may be, for example, (i) nitrogen, (ii) carbon dioxide, (iii) methane, or (iv) combinations thereof. Alternatively, the injected gas may be hydrocarbon gas produced from the production wells. The purpose for injecting the gas is to increase the value of effective thermal diffusivity within the subsurface formation to a second value, $\alpha_2$. The second value $\alpha_2$ is at least 50% greater than the first value $\alpha_1$ and, more preferably, is at least 100% greater than $\alpha_1$.

In one aspect, the second value of effective thermal diffusivity, $\alpha_2$, is an adjusted effective thermal diffusivity value that is determined by:

- estimating in situ temperatures for at least two points within the oil shale formation;
- modeling thermal behavior within the oil shale formation using a computer-based model which employs gas injection as a thermal diffusion mechanism of heat transfer; and
- fitting the thermal model to the in situ temperature estimates by adjusting a thermal diffusivity parameter in the model to obtain an adjusted value of effective thermal diffusivity ($\alpha_2$).

The operator may then compare the adjusted thermal diffusivity parameter value ($\alpha_2$) to a base value ($\alpha_1$) estimated or empirically determined for a case with no gas injection.

In another general aspect, a method for producing hydrocarbon fluids from an organic-rich rock formation to a surface facility includes providing at least one production well in proximity of at least one in situ heat source, each in situ heat source configured to generate heat within the organic-rich rock formation so as to pyrolyze solid hydrocarbons into hydrocarbon fluids. The at least one in situ heat source comprises an electrical resistance heater. The organic-rich rock formation is first heated in situ with the at least one in situ heat source so that a temperature of at least 270° C. is created within the organic-rich rock formation proximal the at least one heat source, so that heat moves away from the at least one heat source and through the formation so that permeability is increased and thermal fractures are caused to be formed in the formation adjacent the production wells. A hot fluid is injected, e.g., of at least 270° C., into the thermal fractures of the organic-rich rock formation after permeability has been increased through heating by the at least one in situ heat source. Production fluids are produced from the organic-rich rock formation through the at least one production well.

Implementations of this aspect may include one or more of the following features. For example, the organic-rich rock formation may include heavy hydrocarbons or solid hydrocarbons. The organic-rich rock formation may be an oil shale formation. The oil shale formation may have an initial permeability of less than about 10 millidarcies. Injecting the hot fluid into the oil shale formation may also include injecting the fluid through perforated wellbores associated with the at least one in situ heat source. The wellbores may be perforated prior to inserting an electrical resistance heater so that any fluids produced in the vicinity of the heater wellbore may be produced up through the heater wellbore to relieve surrounding pressure caused by thermal expansion and the conversion of organic rich rock into various fluids. Production fluids may be produced up through a variety of ways, including, but not limited to through an annulus or one or more separate tubing strings provided for the production of fluids through the wellbore. Injecting the hot fluid into the oil shale formation further comprises injecting the fluid through injection wellbores adjacent to wellbores associated with the at least one in situ heat source. Producing production fluids may include producing production fluids through wellbores associated with the at least one in situ heat source, and injecting the hot fluid into the oil shale formation may include injecting the hot fluid into the oil shale formation through the wellbores associated with the at least one in situ heat source after production fluids have been produced through the wellbore.

The electrical resistance heater may provide one or more of the following types of heat, e.g., (i) resistive heat generated within a wellbore, (ii) resistive heat generated primarily from a conductive material within a wellbore, and/or (iii) resistive heat generated primarily from a conductive material disposed within the organic-rich rock formation. The fluid injected into the formation may comprise any combination of steam, flue gas, methane, and/or naptha. The electrical resistance heat generation rate may be controlled to zero during a period of time when injecting the heated fluid. The fluid may be heated at least partially using exhaust from a gas turbine powering electricity generation. The fluid may be heated at least partially using produced fluids. The hot fluid may be injected into the organic-rich rock formation only after production fluids are produced from at least two of the plurality of production wells. The injected fluid may include a hot gas comprising (i) nitrogen, (ii) carbon dioxide, (iii) methane, or (iv) combinations thereof. The existence of the creation of sufficient permeability may be ascertained in several ways. For example, a test injection of heated fluid may be initiated, whereby a prescribed injectivity index, e.g., a predetermined amount of fluid per change in pressure, is obtained through a test injection that would demonstrate ample permeability has been obtained. A pressure pulse test between an injection and a production point could be conducted and the results analyzed to determine apparent permeability achieved from initial heating with electrical resistance heating. A specified fraction of the estimated in situ kerogen within a certain area could be utilized as a metric to ensure that a minimum amount of fluids are produced that are indicative of ample permeability increases to support fluid flow in the formation. A specified flow rate at one or more wells during or shortly after electrical in situ heating can be utilized as a way of ascertaining if ample permeability has been achieved in the formation.

BRIEF DESCRIPTION OF THE DRAWINGS

So that the present inventions can be better understood, certain drawings, charts, graphs and flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION

Definitions

Figure 1:
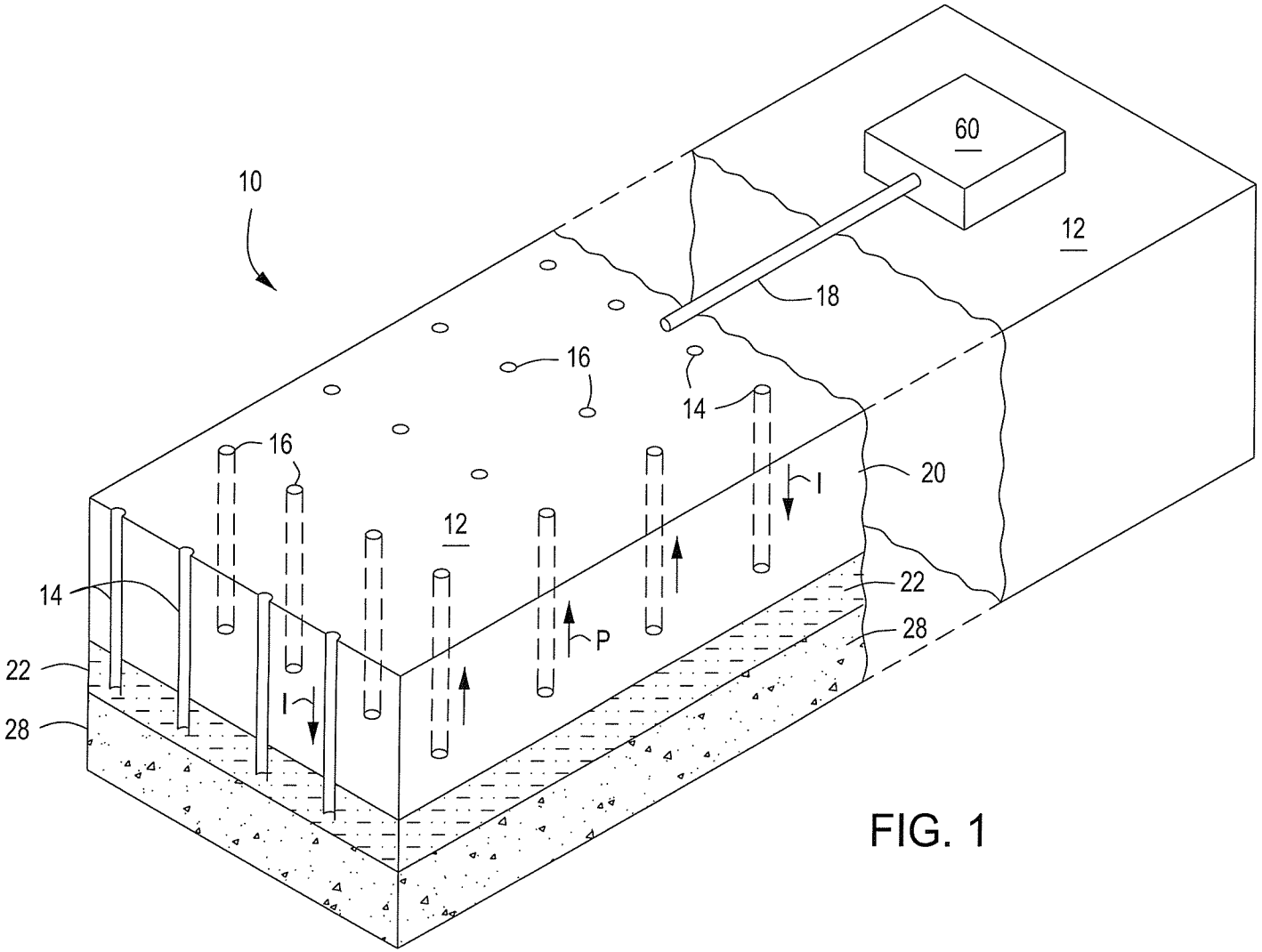
FIG. 1 is a three-dimensional isometric view of an illustrative hydrocarbon development area. The development area includes an organic-rich rock matrix that defines a subsurface formation.

As used herein, the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, pyrolyzed shale oil, synthesis gas, a pyrolysis product of coal, carbon dioxide, hydrogen sulfide and water (including steam).

As used herein, the term "fluid" refers to gases, liquids, and combinations of gases and liquids, as well as to combinations of gases and solids, and combinations of liquids and solids.

As used herein, the term "gas" refers to a fluid that is in its vapor phase at 1 atm and 15° C.

As used herein, the term "condensable hydrocarbons" means those hydrocarbons that condense to a liquid at about 15° C. and one atmosphere absolute pressure. Condensable hydrocarbons may include a mixture of hydrocarbons having carbon numbers greater than 4.

As used herein, the term "non-condensable" means those chemical species that do not condense to a liquid at about 15° C. and one atmosphere absolute pressure. Non-condensable species may include non-condensable hydrocarbons and non-condensable non-hydrocarbon species such as, for example, carbon dioxide, hydrogen, carbon monoxide, hydrogen sulfide, and nitrogen. Non-condensable hydrocarbons may include hydrocarbons having carbon numbers less than 5.

As used herein, the term "heavy hydrocarbons" refers to hydrocarbon fluids that are highly viscous at ambient conditions (15° C. and 1 atm pressure). Heavy hydrocarbons may include highly viscous hydrocarbon fluids such as heavy oil, tar, and/or asphalt. Heavy hydrocarbons may include carbon and hydrogen, as well as smaller concentrations of sulfur, oxygen, and nitrogen. Additional elements may also be present in heavy hydrocarbons in trace amounts. Heavy hydrocarbons may be classified by API gravity. Heavy hydrocarbons generally have an API gravity below about 20 degrees. Heavy oil, for example, generally has an API gravity of about 10-20 degrees, whereas tar generally has an API gravity below about 10 degrees. The viscosity of heavy hydrocarbons is generally greater than about 100 centipoise at about 15° C.

As used herein, the term "solid hydrocarbons" refers to any hydrocarbon material that is found naturally in substantially solid form at formation conditions. Non-limiting examples include kerogen, coal, shungites, asphaltites, and natural mineral waxes.

As used herein, the term "formation hydrocarbons" refers to both heavy hydrocarbons and solid hydrocarbons that are contained in an organic-rich rock formation. Formation hydrocarbons may be, but are not limited to, kerogen, oil shale, coal, bitumen, tar, natural mineral waxes, and asphaltites.

As used herein, the term "tar" refers to a viscous hydrocarbon that generally has a viscosity greater than about 10,000 centipoise at 15° C. The specific gravity of tar generally is greater than 1.000. Tar may have an API gravity less than 10 degrees. "Tar sands" refers to a formation that has tar in it.

As used herein, the term "kerogen" refers to a solid, insoluble hydrocarbon that principally contains carbon, hydrogen, nitrogen, oxygen, and sulfur.

As used herein, the term "bitumen" refers to a non-crystalline solid or viscous hydrocarbon material that is substantially soluble in carbon disulfide.

As used herein, the term "oil" refers to a hydrocarbon fluid containing primarily a mixture of condensable hydrocarbons.

As used herein, the term "subsurface" refers to geologic strata occurring below the earth's surface.

As used herein, the term "hydrocarbon-rich formation" refers to any formation that contains more than trace amounts of hydrocarbons. For example, a hydrocarbon-rich formation may include portions that contain hydrocarbons at a level of greater than 5 percent by volume. The hydrocarbons located in a hydrocarbon-rich formation may include, for example, oil, natural gas, heavy hydrocarbons, and solid hydrocarbons.

As used herein, the term "organic-rich rock" refers to any rock matrix holding solid hydrocarbons and/or heavy hydrocarbons. Rock matrices may include, but are not limited to, sedimentary rocks, shales, siltstones, sands, silicilytes, carbonates, and diatomites. Organic-rich rock may contain kerogen.

As used herein, the term "formation" refers to any definable subsurface region. The formation may contain one or more hydrocarbon-containing layers, one or more non-hydrocarbon containing layers, an overburden, and/or an underburden of any geologic formation. An "overburden" and/or an "underburden" is geological material above or below the formation of interest.

An overburden or underburden may include one or more different types of substantially impermeable materials. For example, overburden and/or underburden may include sandstone, shale, mudstone, or wet/tight carbonate (i.e., an impermeable carbonate without hydrocarbons). An overburden and/or an underburden may include a hydrocarbon-containing layer that is relatively impermeable. In some cases, the overburden and/or underburden may be permeable.

As used herein, the term "organic-rich rock formation" refers to any formation containing organic-rich rock. Organic-rich rock formations include, for example, oil shale formations, coal formations, and tar sands formations.

As used herein, the term "pyrolysis" refers to the breaking of chemical bonds through the application of heat. For example, pyrolysis may include transforming a compound into one or more other substances by heat alone or by heat in combination with an oxidant. Pyrolysis may include modifying the nature of the compound by addition of hydrogen atoms which may be obtained from molecular hydrogen, water, carbon dioxide, or carbon monoxide. Heat may be transferred to a section of the formation to cause pyrolysis.

As used herein, the term "water-soluble minerals" refers to minerals that are soluble in water. Water-soluble minerals include, for example, nahcolite (sodium bicarbonate), soda ash (sodium carbonate), dawsonite ($NaAl(CO_3)(OH)_2$), or combinations thereof. Substantial solubility may require heated water and/or a non-neutral pH solution.

As used herein, the term "formation water-soluble minerals" refers to water-soluble minerals that are found naturally in a formation.

As used herein, the term "subsidence" refers to a downward movement of an earth surface relative to an initial elevation of the surface.

As used herein, the term "thickness" of a layer refers to the distance between the upper and lower boundaries of a cross section of a layer, wherein the distance is measured normal to the average tilt of the cross section.

As used herein, the term "thermal fracture" refers to fractures created in a formation caused directly or indirectly by expansion or contraction of a portion of the formation and/or fluids within the formation, which in turn is caused by increasing/decreasing the temperature of the formation and/or fluids within the formation, and/or by increasing/decreasing a pressure of fluids within the formation due to heating. Thermal fractures may propagate into or form in neighboring regions significantly cooler than the heated zone.

As used herein, the term "hydraulic fracture" refers to a fracture at least partially propagated into a formation, wherein the fracture is created through injection of pressurized fluids into the formation. The fracture may be artificially held open by injection of a proppant material. Hydraulic fractures may be substantially horizontal in orientation, substantially vertical in orientation, or oriented along any other plane.

As used herein, the term "wellbore" refers to a hole in the subsurface made by drilling or insertion of a conduit into the subsurface. A wellbore may have a substantially circular cross section, or other cross-sectional shape (e.g., an oval, a square, a rectangle, a triangle, or other regular or irregular shapes). As used herein, the term "well", when referring to an opening in the formation, may be used interchangeably with the term "wellbore."

DESCRIPTION OF EXEMPLARY EMBODIMENTS

The inventions are described herein in connection with certain specific embodiments. However, to the extent that the following detailed description is specific to a particular embodiment or a particular use, such is intended to be illustrative only and is not to be construed as limiting the scope of the inventions.

As discussed herein, some embodiments of the inventions include or have application related to an in situ method of recovering natural resources. The natural resources may be recovered from a formation containing organic-rich rock including, for example, an oil shale formation. The organic-rich rock may include formation hydrocarbons such as kerogen, coal, or heavy hydrocarbons. In some embodiments of the inventions the natural resources may include hydrocarbon fluids including, for example, products of the pyrolysis of formation hydrocarbons such as shale oil. In some embodiments of the inventions the natural resources may also include water-soluble minerals including, for example, nahcolite (sodium bicarbonate, or $2NaHCO_3$), soda ash (sodium carbonate, or $Na_2CO_3$) and dawsonite ($NaAl(CO_3)(OH)_2$).

FIG. 1 presents a perspective view of an illustrative oil shale development area 10. A surface 12 of the development area 10 is indicated. Below the surface 12 are various subsurface strata 20. The strata 20 include, for example, an organic-rich rock formation 22 and a non-organic-rich rock formation 28 or underburden there below. The illustrative organic-rich rock formation 22 contains formation hydrocarbons (such as, for example, kerogen) and possibly valuable water-soluble minerals (such as, for example, nahcolite).

It is understood that the representative formation 22 may be any organic-rich rock formation, including a rock matrix containing coal or tar sands, for example. In addition, the rock matrix making up the formation 22 may be permeable, semi-permeable or non-permeable. The present inventions are particularly advantageous in shale oil development areas initially having very limited or effectively no fluid permeability. For example, initial permeability may be less than 500 millidarcies.

In order to access the organic-rich rock formation 22 and recover natural resources therefrom, a plurality of wellbores is formed. First, certain wellbores 14 are shown along a periphery of the development area 12. These wellbores 14 are designed originally to serve as heater wells. The heater wells provide heat to pyrolyze hydrocarbon solids in the organic-rich rock formation 22. In some embodiments, a well spacing of 15 to 25 feet is provided for the heater wells 14. Subsequent to the pyrolysis process, the peripheral wellbores 14 may be converted to water injection wells. Selected injection wells 14 are denoted with a downward arrow "I."

The illustrative wellbores 14 are presented in so-called "line drive" arrangements. However, as discussed more fully in connection with FIG. 4, various other arrangements may be provided. The inventions disclosed herein are not limited to the arrangement of or method of selection for heater wells or water injection wells.

Additional wellbores 16 are shown internal to the development area 10. These represent production wells. The representative wellbores 16 for the production wells are essentially vertical in orientation relative to the surface 12. However, it is understood that some or all of the wellbores 16 for the production wells could deviate into an obtuse or even horizontal orientation. Selected production wells 16 are denoted with an upward arrow "P."

In the arrangement of FIG. 1, each of the wellbores 14 and 16 is completed in the oil shale formation 22. The completions may be either open or cased hole. The well completions for the production wells 16 may also include propped or unpropped hydraulic fractures emanating therefrom as a result of a hydraulic fracturing operation. Subsequent to production, some of these internal wellbores 16 may be converted to water production wells.

In the view of FIG. 1, only eight wellbores 14 are shown for the injection wells and only twelve wellbores 16 are shown for the production wells. However, it is understood that in an oil shale development project, numerous additional wellbores 14, 16 will be drilled. The wellbores 16 for the production wells may be located in relatively close proximity, being from 300 feet down to 10 feet in separation. In some embodiments, a well spacing of 15 to 25 feet is provided.

Typically, the wellbores 14, 16 are completed at shallow depths. Completion depths may range from 200 to 5,000 feet at true vertical depth. In some embodiments the oil shale formation targeted for in situ retorting is at a depth greater than 200 feet below the surface, or alternatively 400 feet below the surface. Alternatively, conversion and production occur at depths between 500 and 2,500 feet.

As suggested briefly above, the wellbores 14 and 16 may be selected for certain initial functions before being converted to water injection wells and oil production wells and/or water-soluble mineral solution production wells. In one aspect, the wellbores 14 and 16 are originally drilled to serve two, three, or four different purposes in designated sequences. Suitable tools and equipment may be sequentially run into and removed from the wellbores 14 and 16 to serve the various purposes.

A production fluids processing facility 60 is also shown schematically in FIG. 1. The processing facility 60 is equipped to receive fluids produced from the organic-rich rock formation 22 through one or more pipelines or flow lines 18. The fluid processing facility 60 may include equipment suitable for receiving and separating oil, gas, and water produced from the heated formation 22. The fluids processing facility 60 may further include equipment for separating out dissolved water-soluble minerals and/or migratory contaminant species, including, for example, dissolved organic contaminants, metal contaminants, or ionic contaminants in the produced water recovered from the organic-rich rock formation 22. If the pyrolysis is performed in the absence of oxygen or air, the contaminant species may include aromatic hydrocarbons. These may include, for example, benzene, toluene, xylene, and tri-methylbenzene. The contaminants may also include polyaromatic hydrocarbons such as anthracene, naphthalene, chrysene and pyrene. Metal contaminants may include species containing arsenic, chromium, mercury, selenium, lead, vanadium, nickel, cobalt, molybdenum, or zinc. Ionic contaminant species may include, for example, sulfates, chlorides, fluorides, lithium, potassium, aluminum, ammonia, and nitrates. Other species such as sulfates, ammonia, aluminum, potassium, magnesium, chlorides, flourides and phenols may also exist. If oxygen or air is employed, contaminant species may also include ketones, alcohols, and cyanides. Further, the specific migratory contaminant species present may include any subset or combination of the above-described species.

Figure 2A:
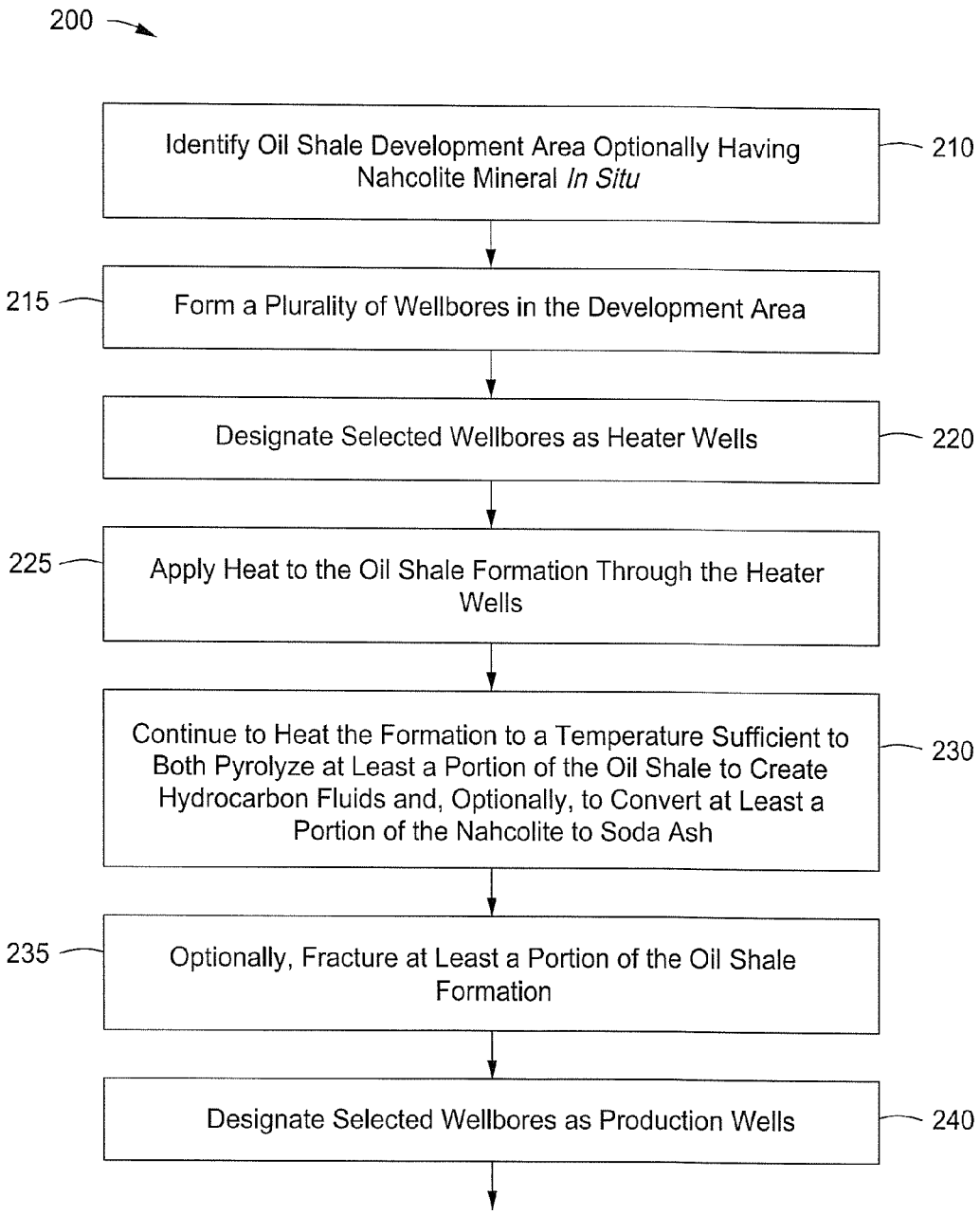
FIGS. 2A-2B present a unified flow chart demonstrating a general method of in situ thermal recovery of oil and gas from an organic-rich rock formation, in one embodiment.
Figure 2B:
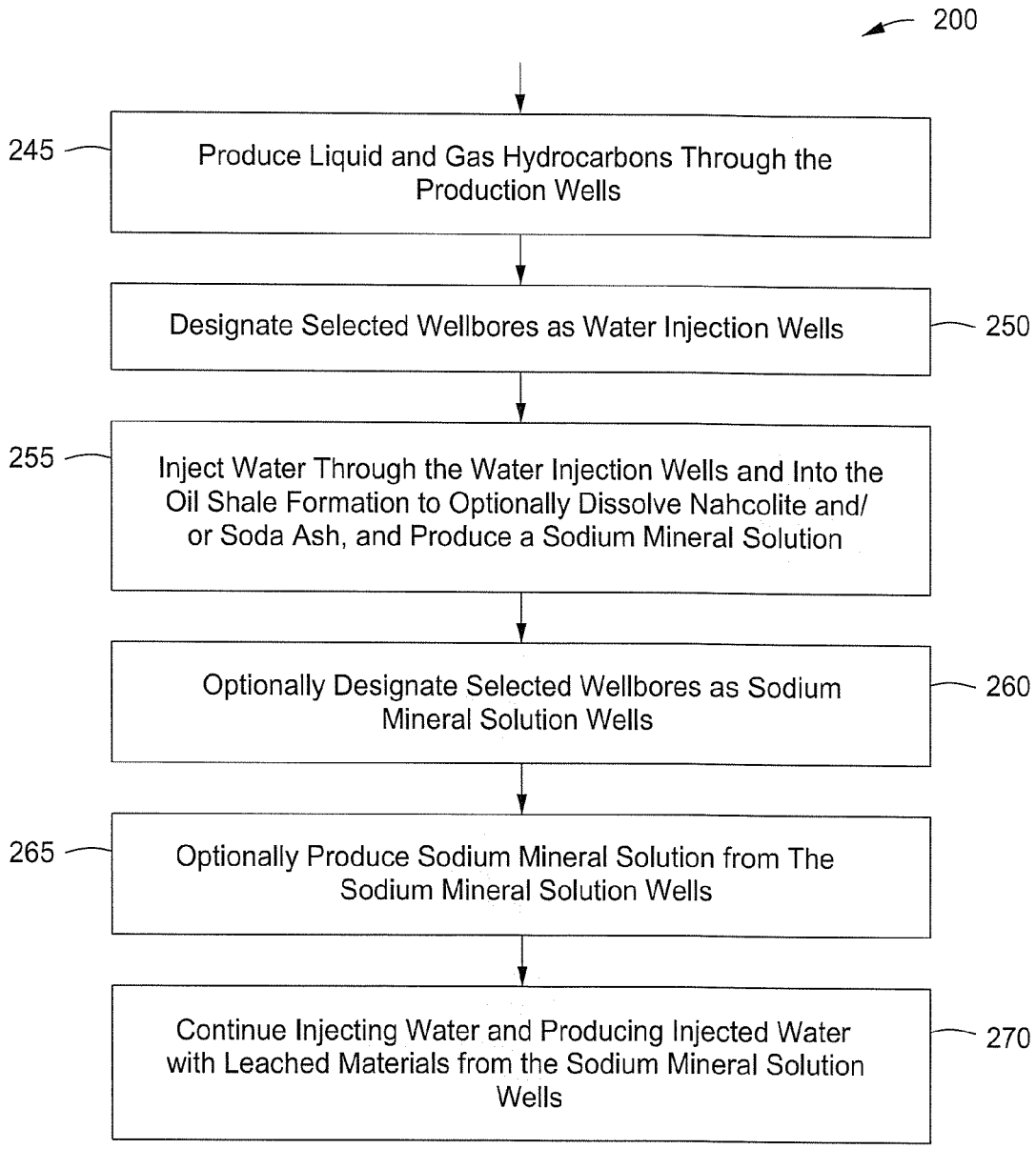

In order to recover oil, gas, and sodium (or other) water-soluble minerals, a series of steps may be undertaken. FIGS. 2A and 2B together presents a flow chart demonstrating a method 200 of in situ thermal recovery of oil and gas from an organic-rich rock formation, in one embodiment. It is understood that the order of some of the steps from FIGS. 2A and 2B may be changed, and that the sequence of steps is merely for illustration.

First, an oil shale development area 10 is identified. This step is shown in Box 210. The oil shale development area includes an oil shale (or other organic-rich rock) formation 22. Optionally, the oil shale formation 22 contains nahcolite or other sodium minerals.

The targeted development area 10 within the oil shale formation 22 may be identified by measuring or modeling the depth, thickness and organic richness of the oil shale as well as evaluating the position of the formation 22 relative to other rock types, structural features (e.g. faults, anticlines or synclines), or hydrogeological units (i.e. aquifers). This is accomplished by creating and interpreting maps and/or models of depth, thickness, organic richness and other data from available tests and sources. This may involve performing geological surface surveys, studying outcrops, performing seismic surveys, and/or drilling boreholes to obtain core samples from subsurface rock.

In some fields, formation hydrocarbons such as oil shale may exist in more than one subsurface formation. In some instances, the organic-rich rock formations may be separated by rock layers that are hydrocarbon-free or that otherwise have little or no commercial value. Therefore, it may be desirable for the operator of a field under hydrocarbon development to undertake an analysis as to which of the subsurface, organic-rich rock formations to target or in which order they should be developed.

The organic-rich rock formation may be selected for development based on various factors. One such factor is the thickness of the hydrocarbon-containing layer within the formation. Greater pay zone thickness may indicate a greater potential volumetric production of hydrocarbon fluids. Each of the hydrocarbon-containing layers may have a thickness that varies depending on, for example, conditions under which the formation hydrocarbon-containing layer was formed. Therefore, an organic-rich rock formation 22 will typically be selected for treatment if that formation includes at least one formation hydrocarbon-containing layer having a thickness sufficient for economical production of hydrocarbon fluids.

An organic-rich rock formation 22 may also be chosen if the thickness of several layers that are closely spaced together is sufficient for economical production of produced fluids. For example, an in situ conversion process for formation hydrocarbons may include selecting and treating a layer within an organic-rich rock formation having a thickness of greater than about 5 meters, 10 meters, 50 meters, or even 100 meters. In this manner, heat losses (as a fraction of total injected heat) to layers formed above and below an organic-rich rock formation may be less than such heat losses from a thin layer of formation hydrocarbons. A process as described herein, however, may also include incidentally selecting and treating layers that may include layers substantially free of formation hydrocarbons or thin layers of formation hydrocarbons.

The richness of one or more organic-rich rock formations may also be considered. For an oil shale formation, richness is generally a function of the kerogen content. The kerogen content of the oil shale formation may be ascertained from outcrop or core samples using a variety of data. Such data may include organic carbon content, hydrogen index, and modified Fischer Assay analyses. The Fischer Assay is a standard method which involves heating a sample of a formation hydrocarbon containing layer to approximately 500° C. in one hour, collecting fluids produced from the heated sample, and quantifying the amount of fluids produced.

Richness may depend on many factors including the conditions under which the formation hydrocarbon-containing layer was formed, an amount of formation hydrocarbons in the layer, and/or a composition of formation hydrocarbons in the layer. A thin and rich formation hydrocarbon layer may be able to produce significantly more valuable hydrocarbons than a much thicker but less-rich formation hydrocarbon layer. Of course, producing hydrocarbons from a formation that is both thick and rich is desirable.

Subsurface permeability may also be assessed via rock samples, outcrops, or studies of ground water flow. Furthermore, the connectivity of the development area to ground water sources may be assessed. An organic-rich rock formation may be chosen for development based on the permeability or porosity of the formation matrix even if the thickness of the formation is relatively thin. Reciprocally, an organic-rich rock formation may be rejected if there appears to be vertical continuity with groundwater.

Other factors known to petroleum engineers may be taken into consideration when selecting a formation for development. Such factors include depth of the perceived pay zone, continuity of thickness, and other factors. For instance, the organic content or richness of rock within a formation will also effect eventual volumetric production.

Next, a plurality of wellbores 14, 16 is formed across the targeted development area 10. This step is shown schematically in Box 215. For purposes of the wellbore formation step of Box 215, only a portion of the wellbores 14, 16 need be completed initially. For instance, at the beginning of the project heat injection wells 14 are needed, while a majority of the hydrocarbon production wells 16 are not yet needed. Production wells may be brought in once conversion begins, such as after 4 to 12 months of heating.

The purpose for heating the organic-rich rock formation is to pyrolyze at least a portion of the solid formation hydrocarbons to create hydrocarbon fluids. The solid formation hydrocarbons may be pyrolyzed in situ by raising the organic-rich rock formation, (or heated zones within the formation), to a pyrolyzation temperature. In certain embodiments, the temperature of the formation may be slowly raised through the pyrolysis temperature range. For example, an in situ conversion process may include heating at least a portion of the organic-rich rock formation to raise the average temperature of the zone above about 270° C. at a rate less than a selected amount (e.g., about 10° C., 5° C.; 3° C., 1° C., 0.5° C., or 0.1° C.) per day. In a further embodiment, the portion may be heated such that an average temperature of the selected zone may be less than about 375° C. or, in some embodiments, less than about 400° C.

The formation may be heated such that a temperature within the formation reaches (at least) an initial pyrolyzation temperature, that is, a temperature at the lower end of the temperature range where pyrolyzation begins to occur. The pyrolysis temperature range may vary depending on the types of formation hydrocarbons within the formation, the heating methodology, and the distribution of heating sources. For example, a pyrolysis temperature range may include temperatures between about 270° C. and about 900° C. Alternatively, the bulk of the target zone of the formation may be heated to between 300° to 600° C. In an alternative embodiment, a pyrolysis temperature range may include temperatures between about 270° C. to about 500° C.

It is understood that petroleum engineers will develop a strategy for the best depth and arrangement for the wellbores 14, 16 depending upon anticipated reservoir characteristics, economic constraints, and work scheduling constraints. In addition, engineering staff will determine what wellbores 14 shall be used for initial formation 22 heating. This selection step is represented by Box 220.

Concerning heat injection wells, there are various methods for applying heat to the organic-rich rock formation 22. The methods disclosed herein are not limited to the heating technique employed unless specifically so stated in the claims. The heating step is represented generally by Box 225. Box 225 specifically references an oil shale formation, but it is understood that the steps of FIGS. 2A through 2B may be used for pyrolyzation or loosening of any solid hydrocarbon or heavy hydrocarbon material.

The organic-rich rock formation 22 is heated to a temperature sufficient to pyrolyze at least a portion of the oil shale in order to convert the kerogen (or other solid hydrocarbons) to hydrocarbon fluids. The conversion step is represented in FIG. 2 by Box 230. The resulting liquids and hydrocarbon gases may be refined into products which resemble common commercial petroleum products. Such liquid products include transportation fuels such as diesel, jet fuel and naphtha. Generated gases include light alkanes, light alkenes, $H_2$, $CO_2$, CO, and $NH_3$.

Preferably, for in situ processes the heating and conversion steps of Boxes 225 and 230 occur over a lengthy period of time. In one aspect, the heating period is from three months to four or more years. Alternatively, the formation may be heated for one to fifteen years, alternatively, 3 to 10 years, 1.5 to 7 years, or 2 to 5 years. Also as an optional part of Box 230, the formation 22 may be heated to a temperature sufficient to convert at least a portion of nahcolite, if present, to soda ash. In this respect, heat applied to mature the oil shale and recover oil and gas will also convert nahcolite to sodium carbonate (soda ash), a related sodium mineral. The process of converting nahcolite (sodium bicarbonate) to soda ash (sodium carbonate) is described herein.

Some production procedures include in situ heating of an organic-rich rock formation that contains both formation hydrocarbons and formation water-soluble minerals prior to substantial removal of the formation water-soluble minerals from the organic-rich rock formation. In some embodiments of the invention there is no need to partially, substantially or completely remove the water-soluble minerals prior to in situ heating.

Conversion of oil shale into hydrocarbon fluids will create permeability in rocks in the formation 22 that were originally substantially impermeable. For example, permeability may increase due to formation of thermal fractures within a heated portion caused by application of heat. As the temperature of the heated portion increases, water may be removed due to vaporization. The vaporized water may escape and/or be removed from the formation. In addition, permeability of the heated portion may also increase as a result of production of hydrocarbon fluids from pyrolysis of at least some of the formation hydrocarbons within the heated portion on a macroscopic scale.

In one embodiment, the organic-rich rock formation has an initial total permeability less than 1 millidarcy, alternatively less than 0.1 or even 0.01 millidarcies, before heating the organic-rich rock formation. Permeability of a selected zone within the heated portion of the organic-rich rock formation 22 may rapidly increase while the selected zone is heated by conduction. For example, pyrolyzing at least a portion of an organic-rich rock formation may increase permeability within a selected zone to about 1 millidarcy, alternatively, greater than about 10 millidarcies, 50 millidarcies, 100 millidarcies, 1 Darcy, 10 Darcies, 20 Darcies, or 50 Darcies. Therefore, a permeability of a selected zone of the portion may increase by a factor of more than about 10, 100, 1,000, 10,000, or 100,000.

In connection with the heating steps 225 and 230, the organic-rich rock formation 22 may optionally be fractured to aid heat transfer or later hydrocarbon fluid production. The optional fracturing step is shown in Box 235. Fracturing may be accomplished by creating thermal fractures within the formation through application of heat. Thermal fracturing can occur both in the immediate region undergoing heating, and in cooler neighboring regions. The thermal fracturing in the neighboring regions is due to propagation of fractures and tension stresses developed due to matrix expansion in the hotter zones. Thus, by both heating the organic-rich rock and transforming the kerogen to oil and gas, the permeability is increased not only from fluid formation and vaporization, but also via thermal fracture formation. The increased permeability aids fluid flow within the formation and production of the hydrocarbon fluids generated from the kerogen.

Alternatively, a process known as hydraulic fracturing may be used. Hydraulic fracturing is a process known in the art of oil and gas recovery where an injection fluid is pressurized within the wellbore above the fracture pressure of the formation, thus developing fracture planes within the formation to relieve the pressure generated within the wellbore. Hydraulic fractures may be used to create additional permeability in portions of the formation 22 and/or be used to provide a planar source for heating.

U.S. Pat. No. 7,331,385 entitled "Methods of Treating a Subterranean Formation to Convert Organic Matter into Producible Hydrocarbons" describes one use of hydraulic fracturing, and is incorporated herein by reference in its entirety. This patent teaches the use of electrically conductive fractures to heat oil shale. A heating element is constructed by forming wellbores and then hydraulically fracturing the oil shale formation around the wellbores. The fractures are filled with an electrically conductive material which forms the heating element. Calcined petroleum coke is an exemplary suitable conductant material. Preferably, the fractures are created in a vertical orientation extending from horizontal wellbores. Electricity may be conducted through the conductive fractures from the heel to the toe of each well. The electrical circuit may be completed by an additional transverse horizontal well that intersects one or more of the vertical fractures near the toe to supply the opposite electrical polarity. The process of U.S. Pat. No. 7,331,385 creates an "in situ toaster" that artificially matures oil shale through the application of electric heat. Thermal conduction heats the oil shale to conversion temperatures in excess of about 300° C., causing artificial maturation.

U.S. Pat. No. 7,441,603 teaches an alternative heating means that employs the circulation of a heated fluid within an oil shale formation. In the process of U.S. Pat. No. 7,441,603, supercritical heated naphtha may be circulated through fractures in the formation. This means that the oil shale is heated by circulating a dense, hot hydrocarbon vapor through sets of closely-spaced hydraulic fractures. In one aspect, the fractures are horizontally formed and conventionally propped. Fracture temperatures of 320°-400° C. are maintained for up to five to ten years. Vaporized naphtha may be the preferred heating medium due to its high volumetric heat capacity, ready availability and relatively low degradation rate at the heating temperature. In the process of U.S. Pat. No. 7,441,603, as the kerogen (or other solid hydrocarbon) matures, fluid pressure will drive the generated oil to the heated fractures where it will be produced with the cycling hydrocarbon vapor.

As part of the hydrocarbon fluid production process 200, certain wellbores 16 may be designated as oil and gas production wells. This step is depicted by Box 240. Oil and gas production might not be initiated until it is determined that the kerogen has been sufficiently retorted to allow a steady flow of oil and gas from the formation 22. In some instances, dedicated production wells are not drilled until after heat injection wells 14 (Box 230) have been in operation for a period of several weeks or months. Thus, Box 240 may include the formation of additional wellbores 16 for production. In other instances, selected heater wells are converted to production wells.

After certain wellbores have been designated as oil and gas production wells, oil and/or gas is produced from the wellbores 14. The oil and/or gas production process is shown at Box 245. At this stage (Box 245), any water-soluble minerals, such as nahcolite and converted soda ash likely remain substantially trapped in the organic-rich rock formation 22 as finely disseminated crystals or nodules within the oil shale beds, and are not produced. However, some nahcolite and/or soda ash may be dissolved in the water created during heat conversion (Box 230) within the formation. Thus, production fluids may contain not only hydrocarbon fluids, but also aqueous fluid containing water-soluble minerals. In such a case, the production fluids may be separated into a hydrocarbon stream and an aqueous stream at the surface production fluids processing facility 60. Thereafter, the water-soluble minerals and any migratory contaminant species may be recovered from the aqueous stream as discussed more fully below.

Box 250 presents an optional next step in the oil and gas recovery method 100. Here, certain wellbores 14 are designated as water or aqueous fluid injection wells. This is preferably done after the production wells have ceased operation.

The aqueous fluids used for the injection wells are solutions of water with other species. The water may constitute "brine," and may include dissolved inorganic salts of chloride, sulfates and carbonates of Group I and II elements of The Periodic Table of Elements. Organic salts can also be present in the aqueous fluid. The water may alternatively be fresh water containing other species. The other species may be present to alter the pH. Alternatively, the other species may reflect the availability of brackish water not saturated in the species wished to be leached from the subsurface. Preferably, wellbores used for the water injection wells are selected from some or all of the wellbores 14 initially used for heat injection or the wellbores 16 used initially for oil and/or gas production. However, the scope of the step of Box 250 may include the drilling of yet additional wellbores for use as dedicated water injection wells. Injection wells drilled at a periphery of a development area will serve to create a boundary of high pressure.

Next, water or an aqueous fluid may be injected through the water injection wells and into the oil shale formation 22. This step is shown at Box 255. The water may be in the form of steam or pressurized hot water. Alternatively, the injected water may be cool and becomes heated as it contacts the previously heated formation. The injection process may further induce fracturing. This process may create fingered caverns and brecciated zones in the nahcolite-bearing intervals some distance, for example up to 200 feet out, from the water injection wellbores. In one aspect, a gas cap, such as nitrogen, may be maintained at the top of each "cavern" to prevent vertical growth.

Along with the designation of certain wellbores as water injection wells, the design engineers may also designate certain wellbores as water production wells. This step is shown in Box 260. The water production wells may be selected from the wells used to previously produce hydrocarbons. The water production wells may be used to produce an aqueous solution of dissolved water-soluble minerals and other species, including, for example, migratory contaminant species. For example, the solution may be one primarily of dissolved soda ash. This step is shown in Box 265. Alternatively, single wellbores may be used to both inject water and then later to recover a sodium mineral solution. Thus, Box 265 includes the option of using the same wellbores for both water injection and water or aqueous solution production (Box 265).

Where the water production wells produce dissolved water-soluble minerals, they may be referred to as sodium mineral solution wells. Box 270 demonstrates that water may continue to be injected and then produced by the sodium mineral solution wells. In this way, water-soluble minerals are leached from the shale oil formation 22. Continued water circulation may further circulate out migratory contaminant species which may be removed at the surface facility 60.

As noted above, wellbores may be used for sequentially different purposes. The use of wellbores for more than one purpose helps to lower project costs and/or decrease the time required to perform certain tasks. For example, one or more of the production wells may subsequently be used as injection wells for later injecting water into the organic-rich rock formation. Alternatively, one or more of the production wells may also be used as water production wells for later circulating an aqueous solution through the organic-rich rock formation in order to leach out minerals and migratory contaminant species.

In other aspects, production wells (and in some circumstances heater wells) may initially be used as dewatering wells (e.g., before heating is begun and/or when heating is initially started). In addition, in some circumstances dewatering wells can later be used as production wells (and in some circumstances heater wells). As such, the dewatering wells may be placed and/or designed so that such wells can be later used as production wells and/or heater wells. The heater wells may be placed and/or designed so that such wells can be later used as production wells and/or dewatering wells. The production wells may be placed and/or designed so that such wells can be later used as dewatering wells and/or heater wells. Similarly, injection wells may be wells that initially were used for other purposes (e.g., heating, production, dewatering, monitoring, etc.), and injection wells may later be used for other purposes. Similarly, monitoring wells may be wells that initially were used for other purposes (e.g., heating, production, dewatering, injection, etc.). Finally, monitoring wells may later be used for other purposes such as water production.

Figure 3:
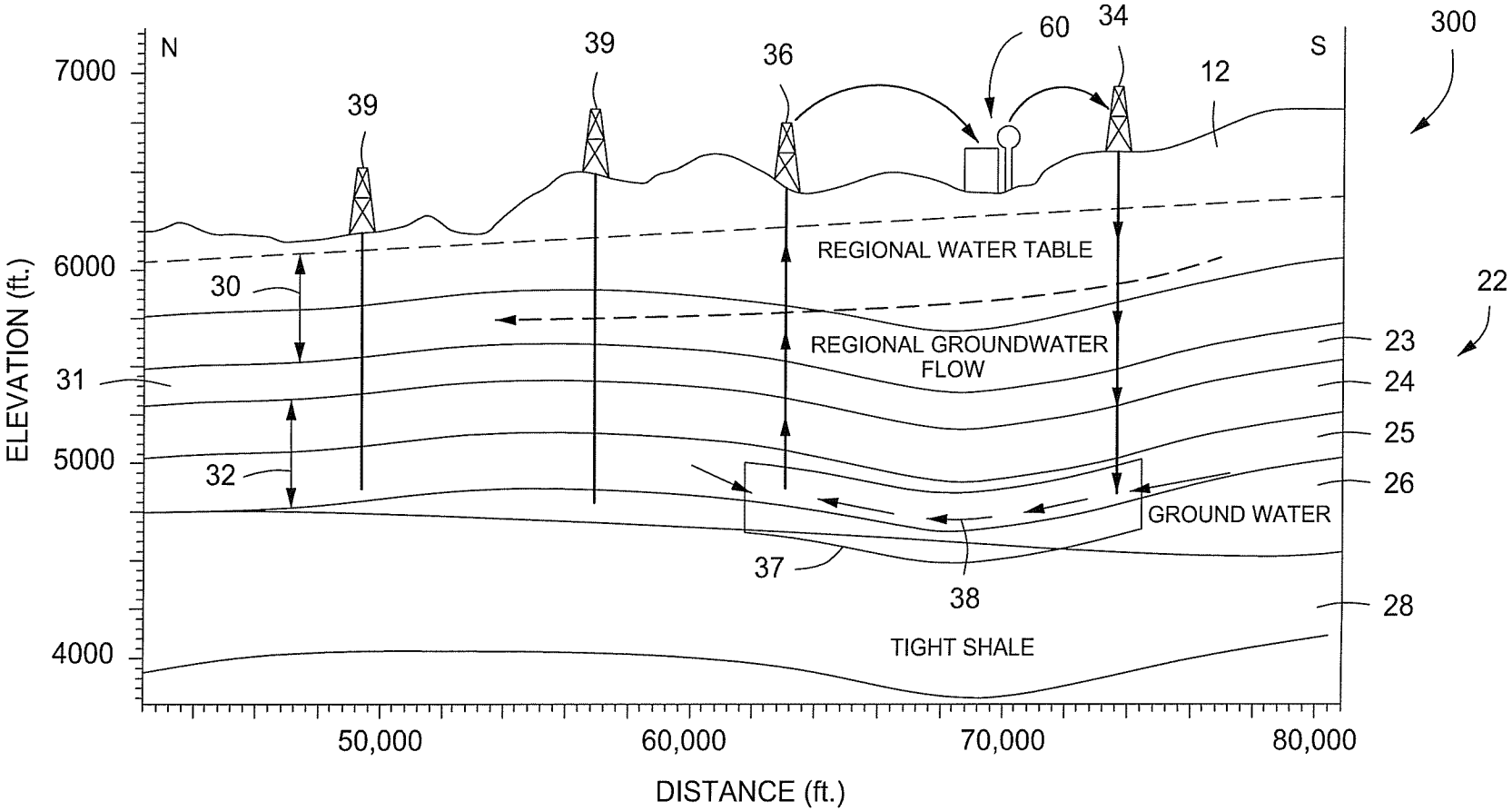
FIG. 3 is a cross-sectional side view of an illustrative oil shale formation that is within or connected to groundwater aquifers and a formation leaching operation.

The circulation of water through a shale oil formation is shown in one embodiment in FIG. 3. FIG. 3 presents a field 300 under hydrocarbon development. A cross-sectional view of an illustrative oil shale formation 22 is seen within the field 300. Four separate oil shale formation zones 23, 24, 25 and 26 are depicted within the oil shale formation 22. This includes an oil shale area 37 within zones 25 and 26.

The formation 22 is within or connected to ground water aquifers and a formation leaching operation. The water aquifers are below the ground surface 12, and are categorized as an upper aquifer 30 and a lower aquifer 32. Intermediate the upper 30 and lower 32 aquifers is an aquitard 31. It can be seen that certain zones of the formation 22 are both aquifers or aquitards and oil shale zones.

A pair of wells 34, 36 is shown traversing vertically downward through the aquifers 30, 32. One of the wells is serving as a water injection well 34, while another is serving as a water production well 36. In this way, water is circulated 38 through at least the lower aquifer 32. A tight shale" formation 28 underlies the aquifers 30, 32.

FIG. 3 shows diagrammatically water circulating 38 through an oil shale volume 37 that was heated, that resides within or is connected to the lower aquifer 32, and from which hydrocarbon fluids were previously recovered. Introduction of water via the water injection well 34 forces water into the previously heated oil shale 37. Water-soluble minerals and migratory contaminants species are swept to the water production well 36. The water may then be processed in a water treatment facility (not shown) wherein the water-soluble minerals (e.g. nahcolite or soda ash) and the migratory contaminants may be substantially removed from the water stream. The migratory contaminant species may be removed through use of, for example, an adsorbent material, reverse osmosis, chemical oxidation, bio-oxidation, hot lime softening and/or ion exchange. Exemplary adsorbent materials may include activated carbon, clay, or fuller's earth.

In one aspect, an operator may calculate a pore volume of the oil shale formation after hydrocarbon production is completed. The operator will then circulate an amount of water equal to one pore volume for the primary purpose of producing the aqueous solution of dissolved soda ash and other water-soluble sodium minerals. The operator may then circulate an amount of water equal to two, three, four or even five additional pore volumes for the purpose of leaching out any remaining water-soluble minerals and other non-aqueous species, including, for example, remaining hydrocarbons and migratory contaminant species. The produced water is carried through the water treatment facility. The step of injecting water and then producing the injected water with leached minerals is again demonstrated in Box 270.

Water is re-injected into the oil shale volume 37 and the formation leaching is repeated. This leaching with water is preferably intended to continue until levels of migratory contaminant species are at environmentally acceptable levels within the previously heated oil shale zone 37. This may require one cycle, two cycles, five cycles or more cycles of formation leaching, where a single cycle indicates injection and production of approximately one pore volume of water.

The injected water may be treated to increase the solubility of the migratory contaminant species and/or the water-soluble minerals. The adjustment may include the addition of an acid or base to adjust the pH of the solution. The resulting aqueous solution may then be produced from the organic-rich rock formation to the surface 12 for processing.

The circulation of water through the oil shale volume 37 is preferably completed after a substantial portion of the hydrocarbon fluids have been produced from the matured organic-rich rock in the formation 22. In some embodiments, the circulation step (Box 270) may be delayed after the hydrocarbon fluid production step (Box 245). The circulation, or "leaching," may be delayed to allow heat generated from the heating step to migrate deeper into surrounding unmatured organic-rich rock zones to convert nahcolite within the surrounding unmatured organic-rich rock zones to soda ash. Alternatively, the leaching may be delayed to allow heat generated from the heating step to generate permeability within the surrounding unmatured organic-rich rock zones. Further, the leaching may be delayed based on current and/or forecast market prices of sodium bicarbonate or soda ash.

The water-soluble minerals that are leached from the formation 37 may include sodium. The water-soluble minerals may also include nahcolite (sodium bicarbonate), soda ash (sodium carbonate), dawsonite ($NaAl(CO_3)(OH)_2$), or combinations thereof. After partial or complete removal of the water-soluble minerals, at least some of the aqueous solution may be re-injected into a subsurface formation where it may be sequestered. The subsurface formation may be the same as or different from the original organic-rich rock formation. Assuming that state environmental standards are met, other circulated water may be released into the local watershed or a nearby stream.

The step of producing a sodium mineral solution (Box 265) may include processing an aqueous solution containing water-soluble minerals in a surface facility 60 to remove a portion of the water-soluble minerals therein. The processing step may include removing the water-soluble minerals by precipitation caused by altering the temperature of the aqueous solution. The surface processing may convert soda ash to sodium bicarbonate (nahcolite) in the surface facility by reaction with $CO_2$.

The impact of heating oil shale to produce oil and gas prior to producing nahcolite is to convert the nahcolite to a more recoverable form (soda ash), and provide permeability facilitating its subsequent recovery. Water-soluble mineral recovery may take place as soon as the retorted oil is produced, or it may be left for a period of years for later recovery. If desired, the soda ash can be readily converted back to nahcolite on the surface. The ease with which this conversion can be accomplished makes the two minerals effectively interchangeable.

During the pyrolysis and water circulation processes, migration of hydrocarbon fluids and migratory contaminant species may be contained by creating a peripheral area in which the temperature of the formation is maintained below a pyrolysis temperature. Preferably, the temperature of the formation is maintained below the freezing temperature of in situ water. The use of subsurface freezing to stabilize poorly consolidated soils or to provide a barrier to fluid flow is generally known in the art. Shell Exploration and Production Company has discussed the use of freeze walls for oil shale production in several patents, including U.S. Pat. No. 6,880,633 and U.S. Pat. No. 7,032,660. Shell's '660 patent uses subsurface freezing to prevent groundwater flow and protect against groundwater contamination during in situ shale oil production. Additional patents that disclose the use of so-called freeze walls are U.S. Pat. No. 3,528,252, U.S. Pat. No. 3,943,722, U.S. Pat. No. 3,729,965, U.S. Pat. No. 4,358,222, and U.S. Pat. No. 4,607,488.

Freeze walls may be formed by circulating refrigerant through peripheral wells to substantially reduce the temperature of the rock formation 22. This, in turn, prevents the pyrolyzation of kerogen present at the periphery of the field 10 and the outward migration of oil and gas. Freeze walls may also cause native water in the formation along the periphery to freeze. This serves to prevent the migration of pyrolyzed fluids into ground water outside of the development or field 10.

Once production of hydrocarbons begins, control of the migration of hydrocarbons and migratory contaminant species can also be obtained via selective placement of injection 16 and production wells 16 such that fluid flow out of the heated zone is minimized. Typically, this involves placing injection wells 14 at the periphery of a heated zone so as to cause pressure gradients which prevent flow inside the heated zone from leaving the zone. The injection wells 14 may inject water, steam, $CO_2$, heated methane, or other fluids to drive cracked kerogen fluids inwardly towards production wells 16.

Referring again to FIG. 3, it is understood that there may be numerous water injection 34 and water production 36 wells in an actual oil shale development 300. Moreover, the development 300 may include one or more monitoring wells 39 disposed at selected points in the field. The monitoring wells 39 can be utilized during the oil shale heating phase, the shale oil production phase, the leaching phase, or during any combination of these phases to monitor for migratory contaminant species and/or water-soluble minerals. Further, the monitoring wells 39 may be configured with one or more devices that measure a temperature, a pressure, and/or a property of a fluid in the wellbore. In some instances, a production well may also serve as a monitoring well, or otherwise be instrumented.

As noted above, several different types of wells may be used in the development of an organic-rich rock formation, including, for example, an oil shale field. For example, the heating of the organic-rich rock formation may be accomplished through the use of heater wells. The heater wells may include, for example, electrical resistance heating elements. Electrical resistance heating involves directly passing electricity through a conductive material such that resistive losses cause it to heat the conductive material. A review of application of electrical heating methods for heavy oil reservoirs is given by R. Sierra and S. M. Farouq Ali, "*Promising Progress in Field Application of Reservoir Electrical Heating Methods*", Society of Petroleum Engineers Paper No. 69709 (2001). An early patent disclosing the use of electrical resistance heaters to produce oil shale in situ is U.S. Pat. No. 1,666,488. The '488 patent issued to Crawshaw in 1928. Since 1928, various designs for downhole electrical heaters have been proposed. Illustrative designs are presented in U.S. Pat. No. 1,701,884, U.S. Pat. No. 3,376,403, U.S. Pat. No. 4,626,665, U.S. Pat. No. 4,704,514, and U.S. Pat. No. 6,023,554).

In one aspect, an electrically resistive heater may be formed by providing electrically conductive members within individual wellbores. The electrically conductive members may be metal rods, metal bars, metal pipes, wires or insulated cables. An electrically conductive granular material is placed in the lower end of each wellbore in electrical communication with the electrically conductive members. A passage is formed in the subsurface between a first wellbore and a second wellbore. The passage is located at least partially within the subsurface formation in or near a stratum to be heated. In one aspect, the passage comprises one or more connecting fractures. The electrically conductive granular material is additionally placed within the fractures to provide electrical communication between the electrically conductive members of the adjacent wellbores.

A current is passed between the electrically conductive members. Passing current through the electrically conductive members and the intermediate granular material causes resistive heat to be generated primarily from the electrically conductive members within the wellbores. This arrangement for generating heat is disclosed and described in U.S. Patent Publ. No. 2008/0271885 published on Nov. 6, 2008. This publication is entitled "Granular Electrical Connections for In Situ Formation Heating." FIGS. 30A and 31 and associated text are incorporated herein by reference.

U.S. Patent Publ. No. 2008/0271885 describes certain embodiments wherein the passage between adjacent wellbores is a drilled passage. In this manner, the lower ends of wellbores are in fluid communication. The conductive granular material is then poured or otherwise placed in the passage such that granular material resides in both the wellbores and the drilled passage. Passing current through the electrically conductive members and the intermediate granular material again causes resistive heat to be generated primarily from the electrically conductive members within the wellbores. This arrangement for generating heat is disclosed and described in connection with FIGS. 30B, 32, and 33.

In another aspect, an electrically resistive heater may be formed by providing electrically conductive piping or other members within individual wellbores. More specifically, an electrically conductive first member and an electrically conductive second member may be disposed in each wellbore. A conductive granular material is then placed between the conductive members within the wellbores to provide electrical communication. The granular material may be mixed with materials of greater or lower conductivity to adjust the bulk resistivity. Materials with greater conductivity may include metal filings or shot; materials with lower conductivity may include quartz sand, ceramic particles, clays, gravel, or cement.

A current is passed through the conductive members and the granular material. Passing current through the conductive members and the intermediate granular material causes resistive heat to be generated primarily from the electrically resistive granular material within the respective wellbores. In one embodiment, the electrically conductive granular material is interspersed with slugs of highly conductive granular material in regions where minimal or no heating is desired. This heater well arrangement is disclosed and described in U.S. Patent Publ. No. 2008/0230219 published on Sep. 25, 2008. This publication is titled "Resistive Heater for In Situ Formation Heating." FIGS. 30A, 31A, 32 and 33 and associated text are incorporated herein by reference.

In still another aspect, an electrically resistive heater may be formed by providing electrically conductive members within adjacent wellbores. The adjacent wellbores are connected at lower ends through drilled passageways. A conductive granular material is then poured or otherwise placed in the passage ways such that the granular material is located in the respective passageways and at least partially in each of the corresponding wellbores. A current is passed between the wellbores through the granular material. Passing current through the pipes and the intermediate granular material causes resistive heat to be generated through the subsurface primarily from the electrically resistive granular material. Such an arrangement is also disclosed and described in U.S. Patent Publ. No. 2008/0230219, particularly in connection with FIGS. 34A and 34B. FIGS. 34A and 34B and associated text are likewise incorporated herein by reference.

In any of these instances, thermal energy is transported to the formation by thermal conduction to heat the organic-rich rocks. The use of electrical resistors in which an electrical current is passed through a resistive material which dissipates the electrical energy as heat is distinguished from dielectric heating in which a high-frequency oscillating electric current induces electrical currents in nearby materials and causes them to heat.

Co-owned U.S. Pat. Appl. No. 61/109,369 is also instructive. That application was filed on Oct. 29, 2008 and is entitled "Electrically Conductive Methods for Heating a Subsurface Formation to Convert Organic Matter into Hydrocarbon Fluids." The application teaches the use of two or more materials placed within an organic-rich rock formation and having varying properties of electrical resistance. An electrical current is passed through the materials in the formation to generate resistive heat. The materials placed in situ provide for resistive heat without creating hot spots near the wellbores. This patent application is incorporated herein by reference in its entirety.

It is desirable to arrange the heater wells and production wells for an oil shale field in a pre-planned pattern. For instance, heater wells may be arranged in a variety of patterns including, but not limited to, triangles, squares, hexagons, and other polygons. The pattern may include a regular polygon to promote uniform heating through at least the portion of the formation in which the heater wells are placed. The pattern may also be a line drive pattern. A line drive pattern generally includes a first linear array of heater wells, a second linear array of heater wells, and a production well or a linear array of production wells between the first and second linear array of heater wells. Injection wells may likewise be disposed within a repetitive pattern of units. The pattern may be similar to or different from that used for the heater wells.

The arrays of heater wells may be disposed such that a distance between each heater well is less than about 70 feet (21 meters). A portion of the formation may be heated with heater wells disposed substantially parallel to a boundary of the hydrocarbon formation. In alternative embodiments, the array of heater wells may be disposed such that a distance between each heater well may be less than about 100 feet, or 50 feet, or 30 feet. Regardless of the arrangement of or distance between the heater wells, in certain embodiments, a ratio of heater wells to production wells disposed within a organic-rich rock formation may be greater than about 5, 8, 10, 20, or more.

In one pattern, individual production wells are surrounded by a layer of heater wells. This may include arrangements such as 5-spot, 7-spot, or 9-spot arrays, with alternating rows of production and heater wells. In another embodiment, two layers of heater wells may surround a production well, but with the heater wells staggered so that a clear pathway exists for the majority of flow away from the further heater wells. Flow and reservoir simulations may be employed to assess the pathways and temperature history of hydrocarbon fluids generated in situ as they migrate from their points of origin to production wells.

Figure 4:
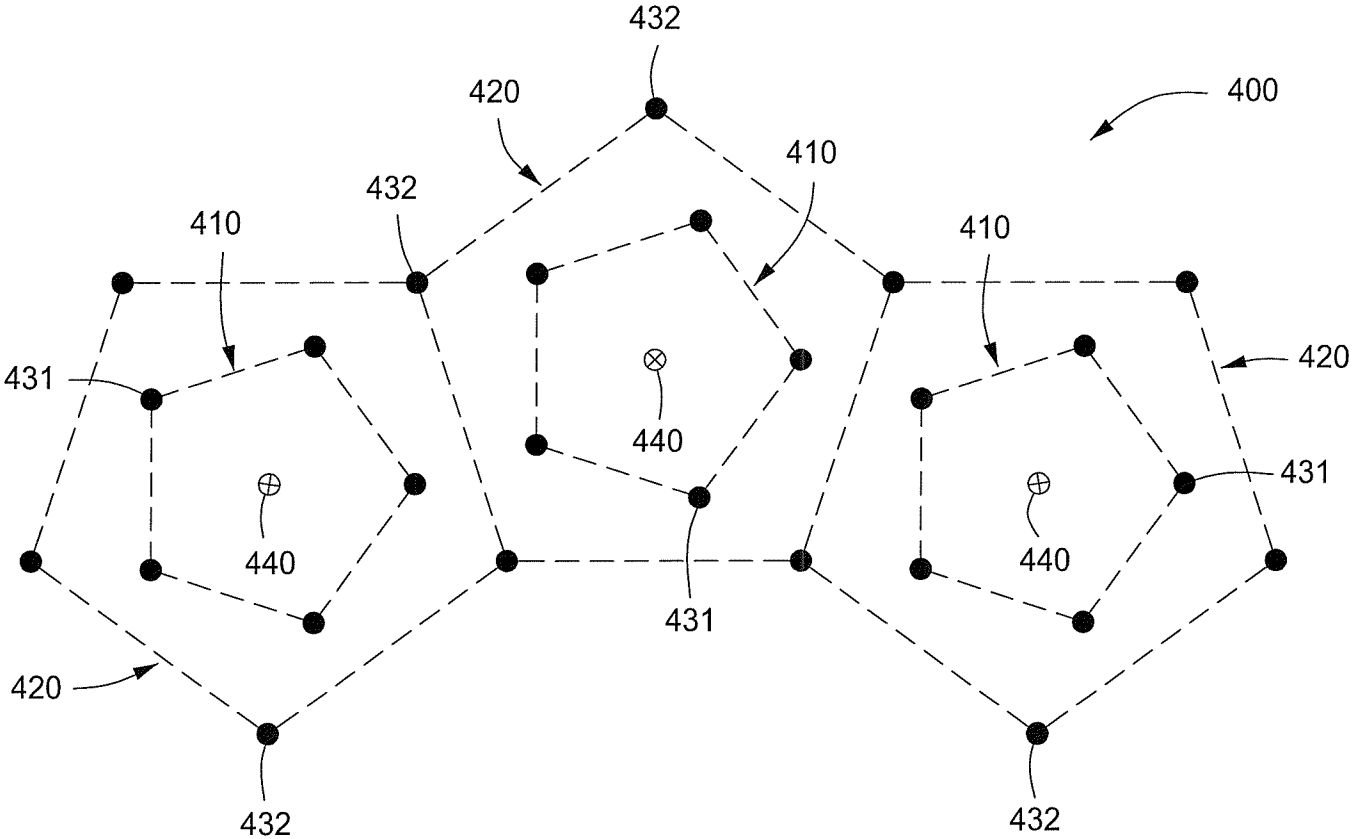
FIG. 4 provides a plan view of an illustrative heater well pattern. Two layers of heater wells are shown surrounding respective production wells.

FIG. 4 provides a plan view of an illustrative heater well arrangement using more than one layer of heater wells. The heater well arrangement is used in connection with the production of hydrocarbons from a shale oil development area 400. In FIG. 4, the heater well arrangement employs a first layer of heater wells 410, surrounded by a second layer of heater wells 420. The heater wells in the first layer 410 are referenced at 431, while the heater wells in the second layer 420 are referenced at 432.

A production well 440 is shown central to the well layers 410 and 420. It is noted that the heater wells 432 in the second layer 420 of wells are offset from the heater wells 431 in the first layer 410 of wells, relative to the production well 440. The purpose is to provide a flowpath for converted hydrocarbons that minimizes travel near a heater well in the first layer 410 of heater wells. This, in turn, minimizes secondary cracking of hydrocarbons converted from kerogen as hydrocarbons flow from the second layer of wells 420 to the production wells 440.

The heater wells 431, 432 in the two layers 410, 420 also may be arranged such that the majority of hydrocarbons generated by heat from each heater well 432 in the second layer 420 are able to migrate to a production well 440 without passing substantially near a heater well 431 in the first layer 410. The heater wells 431, 432 in the two layers 410, 420 further may be arranged such that the majority of hydrocarbons generated by heat from each heater well 432 in the second layer 420 are able to migrate to the production well 440 without passing through a zone of substantially increasing formation temperature.

In the illustrative arrangement of FIG. 4, the first layer 410 and the second layer 420 each defines a 5-spot pattern. However, it is understood that other patterns may be employed, such as 3-spot or 6-spot patterns. In any instance, a plurality of heater wells 431 comprising a first layer of heater wells 410 is placed around a production well 440, with a second plurality of heater wells 432 comprising a second layer of heater wells 420 placed around the first layer 410.

In some instances it may be desirable to use well patterns that are elongated in a particular direction, particularly in a direction determined to provide the most efficient thermal conductivity. Heat convection may be affected by various factors such as bedding planes and stresses within the formation. For instance, heat convection may be more efficient in the direction perpendicular to the least horizontal principal stress on the formation. In some instances, heat convection may be more efficient in the direction parallel to the least horizontal principal stress. Elongation may be practiced in, for example, line drive patterns or spot patterns.

In connection with the development of a shale oil field, it may be desirable that the progression of heat through the subsurface in accordance with steps 225 and 230 be uniform. However, for various reasons the heating and maturation of formation hydrocarbons in a subsurface formation may not proceed uniformly despite a regular arrangement of heater and production wells. Heterogeneities in the oil shale properties and formation structure may cause certain local areas to be more or less productive. Moreover, formation fracturing which occurs due to the heating and maturation of the oil shale can lead to an uneven distribution of preferred pathways and, thus, increase flow to certain production wells and reduce flow to others. Uneven fluid maturation may be an undesirable condition since certain subsurface regions may receive more heat energy than necessary where other regions receive less heat energy than desired. This, in turn, leads to the uneven flow and recovery of production fluids. Produced oil quality, overall production rate, and/or ultimate recoveries may be reduced.

To detect uneven flow conditions, production and heater wells may be instrumented with sensors. Sensors may include equipment to measure temperature, pressure, flow rates, and/or compositional information. Data from these sensors can be processed via simple rules or input to detailed simulations to reach decisions on how to adjust heater and production wells to improve subsurface performance. Production well performance may be adjusted by controlling backpressure or throttling on the well. Heater well performance may also be adjusted by controlling energy input. Sensor readings may also sometimes imply mechanical problems with a well or downhole equipment which requires repair, replacement, or abandonment.

In one embodiment, flow rate, compositional, temperature and/or pressure data are utilized from two or more wells as inputs to a computer algorithm to control heating rate and/or production rates. Unmeasured conditions at or in the neighborhood of the well are then estimated and used to control the well. For example, in situ fracturing behavior and kerogen maturation are estimated based on thermal, flow, and compositional data from a set of wells. In another example, well integrity is evaluated based on pressure data, well temperature data, and estimated in situ stresses. In a related embodiment the number of sensors is reduced by equipping only a subset of the wells with instruments, and using the results to interpolate, calculate, or estimate conditions at uninstrumented wells. Certain wells may have only a limited set of sensors (e.g., wellhead temperature and pressure only) where others have a much larger set of sensors (e.g., wellhead temperature and pressure, bottomhole temperature and pressure, production composition, flow rate, electrical signature, casing strain, etc.).

As noted above, there are various methods for applying heat to an organic-rich rock formation. The use of electrical resistance heaters disposed in a wellbore or outside of a wellbore was discussed above. Other heating methods include the use of downhole combustors, in situ combustion, radio-frequency (RF) electrical energy, or microwave energy. Still others include injecting a hot fluid into the oil shale formation to directly heat it. The hot fluid may or may not be circulated.

In certain embodiments of the methods of the present invention, downhole burners may be used to heat a targeted oil shale zone. Downhole burners of various designs have been discussed in the patent literature for use in oil shale and other largely solid hydrocarbon deposits. Examples include U.S. Pat. No. 2,887,160; U.S. Pat. No. 2,847,071; U.S. Pat. No. 2,895,555; U.S. Pat. No. 3,109,482; U.S. Pat. No. 3,225,829; U.S. Pat. No. 3,241,615; U.S. Pat. No. 3,254,721; U.S. Pat. No. 3,127,936; U.S. Pat. No. 3,095,031; U.S. Pat. No. 5,255,742; and U.S. Pat. No. 5,899,269. Downhole burners operate through the transport of a combustible fuel (typically natural gas) and an oxidizer (typically oxygen-enriched air) to a subsurface position in a wellbore. The fuel and oxidizer react downhole to generate heat. The combustion gases are removed, typically by transport to the surface, but possibly via injection into the formation. Oftentimes, downhole burners utilize pipe-in-pipe arrangements to transport fuel and oxidizer downhole, and then to remove the flue gas back up to the surface through the annulus. Some downhole burners generate a flame, while others may not.

Downhole burners have advantages over electrical heating methods due to the reduced infrastructure cost. In this respect, there is no need for an expensive electrical power plant and distribution system. Moreover, there is increased thermal efficiency because the energy losses inherently experienced during electrical power generation are avoided.

Few applications of downhole burners exist due to various design issues. Downhole burner design issues include temperature control and metallurgy limitations. In this respect, the flame temperature can overheat the tubular and burner hardware and cause them to fail via melting, thermal stresses, severe loss of tensile strength, or creep. Certain stainless steels, typically with high chromium content, can tolerate temperatures up to ~700° C. for extended periods. (See for example H. E. Boyer and T. L. Gall (eds.), *Metals Handbook*, "Chapter 16: Heat-Resistant Materials", American Society for Metals, (1985.) The existence of flames can cause hot spots within the burner and in the formation surrounding the burner. This is due to radiant heat transfer from the luminous portion of the flame. However, a typical gas flame can produce temperatures up to about 1,650° C. Materials of construction for the burners must be sufficient to withstand the temperatures of these hot spots. The heaters are therefore more expensive than a comparable heater without flames.

For downhole burner applications, heat transfer can occur in one of several ways. These include conduction, convection, and radiative methods. Radiative heat transfer can be particularly strong for an open flame. Additionally, the flue gases can be corrosive due to the $CO_2$ and water content. Use of refractory metals or ceramics can help solve these problems, but typically at a higher cost. Ceramic materials with acceptable strength at temperatures in excess of 900° C. are generally high alumina content ceramics. Other ceramics that may be useful include chrome oxide, zirconia oxide, and magnesium oxide based ceramics.

Heat transfer in a pipe-in-pipe arrangement for a downhole burner can also lead to difficulties. The down going fuel and air will heat exchange with the up going hot flue gases. In a well there is minimal room for a high degree of insulation and hence significant heat transfer is typically expected. This cross heat exchange can lead to higher flame temperatures as the fuel and air become preheated. Additionally, the cross heat exchange can limit the transport of heat downstream of the burner since the hot flue gases may rapidly lose heat energy to the rising cooler flue gases.

Improved downhole burners are offered in co-owned U.S. Patent Publ. No. 2008/0283241. That application published on Nov. 20, 2008, and is entitled "Downhole Burner Wells for In Situ Conversion of Organic-Rich Formations." The teachings pertaining to improved downhole burner wells are incorporated herein by reference.

In the published application, wellbores may be intersected to form a single heater well. The wellbore pairs are in fluid communication such that a first wellbore and a second wellbore together form the single heater well. An oxidant and a first combustible fuel are injected into the first wellbore. Hardware is provided in the first wellbore so as to cause the oxidant and the first combustible fuel to mix and to combust at substantially the depth of the organic-rich rock formation. Hot flue gas from the ignited fuel flows through a horizontal portion of the first wellbore within the formation. This creates a first heat profile. The hot flue gas then flows into and up the second wellbore. In this way, a second heat profile is created from the second wellbore. The first heat profile mates with the second heat profile after flowing the combustion products for a period of time so as to form a substantially continuous pyrolysis zone of formation hydrocarbons within a substantial portion of the organic-rich rock formation between the first and second wellbores. The location and depth of the burner, the intensity of the heat, the composition of the tubulars forming the wellbores, and the spacing of the wellbores all provide variables that determine how well the heat profiles from the two wellbores "mate."

The use of downhole burners is an alternative to another form of downhole heat generation called steam generation. In downhole steam generation, a combustor in the well is used to boil water placed in the wellbore for injection into the formation. Applications of the downhole heat technology have been described in F. M. Smith, "A Down-Hole Burner—Versatile Tool for Well Heating," 25$^{th}$ Technical Conference on Petroleum Production, Pennsylvania State University, pp 275-285 (Oct. 19-21, 1966); H. Brandt, W. G. Poynter, and J. D. Hummell, "Stimulating Heavy Oil Reservoirs with Downhole Air-Gas Burners," World Oil, pp. 91-95 (September 1965); and C. I. DePriester and A. J. Pantaleo, "Well Stimulation by Downhole Gas-Air Burner," Journal of Petroleum Technology, pp. 1297-1302 (December 1963).

The process of heating formation hydrocarbons within an organic-rich rock formation, for example, by pyrolysis, may generate fluids. The heat-generated fluids may include water which is vaporized within the formation. In addition, the action of heating kerogen produces pyrolysis fluids which tend to expand upon heating. The produced pyrolysis fluids may include not only water, but also, for example, hydrocarbons, oxides of carbon, ammonia, molecular nitrogen, and molecular hydrogen. Therefore, as temperatures within a heated portion of the formation increase, a pressure within the heated portion may also increase as a result of increased fluid generation, molecular expansion, and vaporization of water. Thus, some corollary exists between subsurface pressure in an oil shale formation and the fluid pressure generated during pyrolysis. This, in turn, indicates that formation pressure may be monitored to detect the progress of a kerogen conversion process.

The pressure within a heated portion of an organic-rich rock formation depends on other reservoir characteristics. These may include, for example, formation depth, distance from a heater well, a richness of the formation hydrocarbons within the organic-rich rock formation, the degree of heating, and/or a distance from a producer well.

It may be desirable for the developer of an oil shale field to monitor formation pressure during development. Pressure within a formation may be determined at a number of different locations. Such locations may include, but may not be limited to, at a wellhead and at varying depths within a wellbore. In some embodiments, pressure may be measured at a producer well. In an alternate embodiment, pressure may be measured at a heater well. In still other embodiments, pressure may be measured downhole of a dedicated monitoring well.

The process of heating an organic-rich rock formation to a pyrolysis temperature range will not only increase formation pressure, but will also increase formation permeability. The pyrolysis temperature range should be reached before substantial permeability has been generated within the organic-rich rock formation. An initial lack of permeability may prevent the transport of generated fluids from a pyrolysis zone within the formation. In this manner, as heat is initially transferred from a heater well to an organic-rich rock formation, a fluid pressure within the organic-rich rock formation may increase proximal to that heater well.

Alternatively, pressure generated by expansion of pyrolysis fluids or other fluids generated in the formation may be allowed to increase. This assumes that an open path to a production well or other pressure sink does not yet exist in the formation. In one aspect, a fluid pressure may be allowed to increase to or above a lithostatic stress. In this instance, fractures in the hydrocarbon containing formation may form when the fluid pressure equals or exceeds the lithostatic stress. For example, fractures may form from a heater well to a production well. The generation of fractures within the heated portion may reduce pressure within the portion due to the production of produced fluids through a production well.

Once pyrolysis has begun within an organic-rich rock formation, fluid pressure may vary depending upon various factors. These include, for example, thermal expansion of hydrocarbons, generation of pyrolysis fluids, rate of conversion, and withdrawal of generated fluids from the formation. For example, as fluids are generated within the formation, fluid pressure within the pores may increase. Removal of generated fluids from the formation may then decrease the fluid pressure within the near wellbore region of the formation.

In certain embodiments, a mass of at least a portion of an organic-rich rock formation may be reduced due, for example, to pyrolysis of formation hydrocarbons and the production of hydrocarbon fluids from the formation. As such, the permeability and porosity of at least a portion of the formation will increase. Any in situ method that effectively produces oil and gas from oil shale or other solid hydrocarbon material will create permeability in what was originally a very low permeability rock. The extent to which this will occur is illustrated by the large amount of expansion that must be accommodated if fluids generated from kerogen are not produced. The concept is illustrated in FIG. 5.

Figure 5:
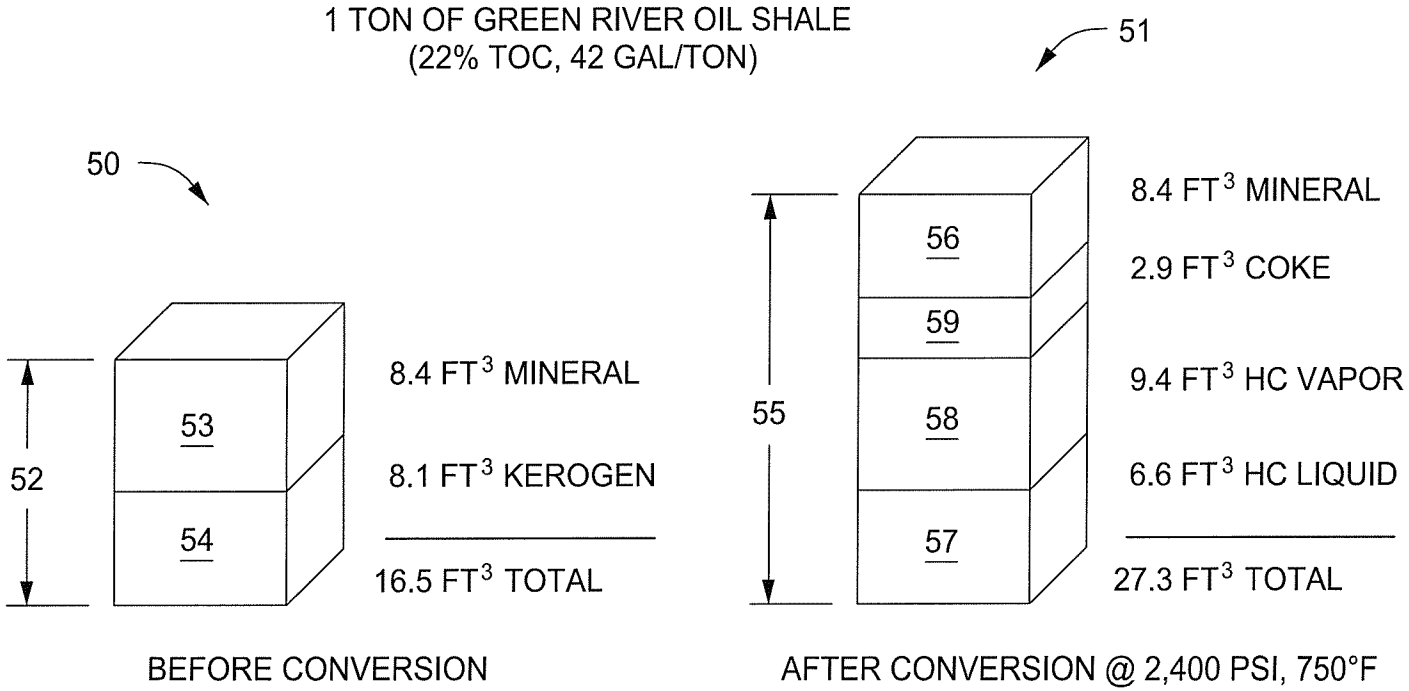
FIG. 5 is a bar chart comparing one ton of Green River oil shale before and after a simulated in situ, retorting process.

FIG. 5 provides a bar chart comparing one ton of Green River oil shale before 50 and after 51 a simulated in situ, retorting process. The simulated process was carried out at 2,400 psi and 750° F. on oil shale having a total organic carbon content of 22 wt. % and a Fisher Assay of 42 gallons/ton. Before the conversion, a total of 16.5 ft3 of rock matrix 52 existed. This matrix comprised 8.4 ft3 of mineral 53, i.e., dolomite, limestone, etc., and 8.1 ft3 of kerogen 54 imbedded within the shale. As a result of the conversion the material expanded to 27.3 ft3 55. This represented 8.4 ft3 of mineral 56 (the same number as before the conversion), 6.6 ft3 of hydrocarbon liquid 57, 9.4 ft3 of hydrocarbon vapor 58, and 2.9 ft3 of coke 59. It can be seen that substantial volume expansion occurred during the conversion process. This, in turn, increases permeability of the rock structure.

In some embodiments, compositions and properties of the hydrocarbon fluids produced by an in situ conversion process may vary depending on, for example, conditions within an organic-rich rock formation. Controlling heat and/or heating rates of a selected section in an organic-rich rock formation may increase or decrease production of selected produced fluids.

In one embodiment, operating conditions may be determined by measuring at least one property of the organic-rich rock formation. The measured properties may be input into a computer executable program. At least one property of the produced fluids selected to be produced from the formation may also be input into the computer executable program. The program may be operable to determine a set of operating conditions from at least the one or more measured properties. The program may also be configured to determine the set of operating conditions from at least one property of the selected produced fluids. In this manner, the determined set of operating conditions may be configured to increase production of selected produced fluids from the formation.

Certain heater well embodiments may include an operating system that is coupled to any of the heater wells such as by insulated conductors or other types of wiring. The operating system may be configured to interface with the heater well. The operating system may receive a signal (e.g., an electromagnetic signal) from a heater that is representative of a temperature distribution of the heater well. Additionally, the operating system may be further configured to control the heater well, either locally or remotely. For example, the operating system may alter a temperature of the heater well by altering a parameter of equipment coupled to the heater well. Therefore, the operating system may monitor, alter, and/or control the heating of at least a portion of the formation.

Temperature (and average temperatures) within a heated organic-rich rock formation may vary, depending on, for example, proximity to a heater well, thermal conductivity and thermal diffusivity of the formation, type of reaction occurring, type of formation hydrocarbon, and the presence of water within the organic-rich rock formation. At points in the field where monitoring wells are established, temperature measurements may be taken directly in the wellbore. Further, at heater wells the temperature of the immediately surrounding formation is fairly well understood. However, it is desirable to interpolate temperatures to points in the formation intermediate temperature sensors and heater wells.

Figure 6:
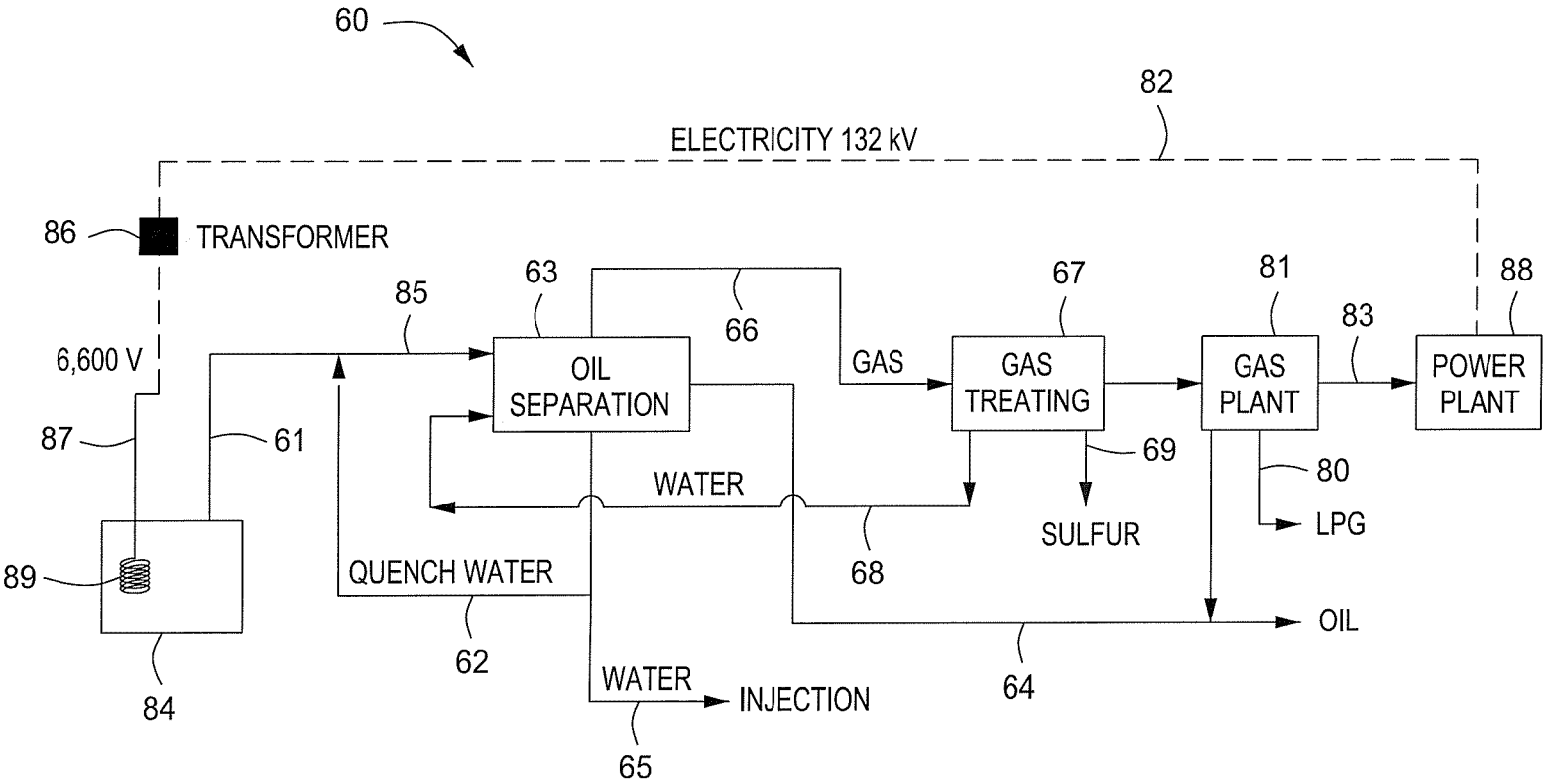
FIG. 6 is a schematic for a process flow diagram. The flow diagram shows an illustrative surface processing facility for an oil shale development.

Once fluids begin to be produced from subsurface strata, the fluids will be treated. FIG. 6 illustrates a schematic diagram of an embodiment of the production fluids processing facility 60 that may be configured to treat produced fluids 85. The fluids 85 are produced from a subsurface formation, shown schematically at 84, though a production well 61.

The subsurface formation 84 may be any subsurface formation including, for example, an organic-rich rock formation containing any of oil shale, coal, or tar sands for example. In the illustrative surface facilities 60, the produced fluids are quenched 62 to a temperature below 300° F., 200° F., or even 100° F. This serves to separate out condensable components (i.e., oil 64 and water 65).

The produced fluids 85 may include any of the produced fluids produced by any of the methods as described herein. In the case of in situ oil shale production, produced fluids contain a number of components which may be separated in the fluids processing facility 60. The produced fluids 85 typically contain water 65, noncondensable hydrocarbon alkane species (e.g., methane, ethane, propane, n-butane, isobutane), noncondensable hydrocarbon alkene species (e.g., ethene, propene), condensable hydrocarbon species composed of alkanes, olefins, aromatics, and polyaromatics among others, and non-hydrocarbon species such as CO2, CO, H2, H2S, and NH3. In a surface facility such as fluids processing facility 60, condensable components 66 may be separated from noncondensable components 64 by reducing temperature and/or increasing pressure. Temperature reduction may be accomplished using heat exchangers cooled by ambient air or available water 62. Additionally or alternatively, the hot produced fluids may be cooled by heat exchange with fluids to be injected into the formation, such as described elsewhere herein. Alternatively, the hot produced fluids may be cooled via heat exchange with produced hydrocarbon fluids previously cooled. The pressure may be increased via centrifugal or reciprocating compressors. Alternatively, or in conjunction, a diffuser-expander apparatus may be used to condense out liquids from gaseous flows. Separations may involve several stages of cooling and/or pressure changes.

In the arrangement of FIG. 6, the fluids processing facility 60 includes an oil separator 63 for separating liquids, or oil 64, from hydrocarbon vapors, or gas 66. The noncondensable vapor components 66 are treated in a gas treating unit 67 to remove water 68.

Sulfur species 69 and other acid gas components are also removed during gas treating 67. Acid gas removal may be effectuated through the use of distillation towers. Such towers may include an intermediate freezing section wherein frozen $CO_2$ and $H_{25}$ particles are allowed to form. A mixture of frozen particles and liquids fall downward into a stripping section, where the lighter hydrocarbon gases break out and rise within the tower. A rectification section may be provided at an upper end of the tower to further facilitate the cleaning of the overhead gas stream. Additional details of such a process and related processes may be found in U.S. Pat. Nos. 3,724,225; 4,511,382; 4,533,372; 4,923,493; 5,120,338; and 5,956,971.

Chemical reaction processes may also be employed to remove acid gas components. Chemical reaction processes typically involve contacting the gas stream with an aqueous amine solution at high pressure and/or low temperature. This causes the acid gas species to chemically react with the amines and go into solution. By raising the temperature and/or lowering the pressure, the chemical reaction can be reversed and a concentrated stream of acid gases can be recovered. An alternative chemical reaction process involves hot carbonate solutions, typically potassium carbonate. The hot carbonate solution is regenerated and the concentrated stream of acid gases is recovered by contacting the solution with steam. Physical solvent processes typically involve contacting the gas stream with a glycol at high pressure and/or low temperature. Like the amine processes, reducing the pressure or raising the temperature allows regeneration of the solvent and recovery of the acid gases. Certain amines or glycols may be more or less selective in the types of acid gas species removed.

Removal of hydrogen sulfide or other sulfur-containing compounds from the gas stream 66 produces a rich H2S stream 69. The rich H2S stream 69 may be further processed in, for example, a sulfur recovery plant (not shown). Alternatively, the rich H2S stream 69 may be injected into a coal seam, a deep aquifer, a substantially depleted fractured tight gas zone, a substantially depleted oil shale zone, an oil shale zone depleted of sodium minerals, or combinations thereof as part of an acid gas injection process.

The hydrogen content of a gas stream may be reduced by removing all or a portion of the hydrogen ($H_2$) or increased by removing all or a portion of the non-hydrogen species (e.g., $CO_2$, $CH_4$, etc.) Separations may be accomplished using cryogenic condensation, pressure-swing or temperature-swing adsorption, or selective diffusion membranes. If additional hydrogen is needed, hydrogen may be made by reforming methane via a classic water-shift reaction.

Preferably, the gas 66 representing the noncondensable components is further treated to remove a portion of the heavier components. Heavier components may include propane and butane. This separation is conducted in a gas plant 81 to form liquid petroleum gas (LPG) 80. The LPG 80 may be further chilled and placed into a truck or line for sale. A separated combined gas turbine feed stream is thus provided at 83.

Water 68 in addition to condensable hydrocarbons may be dropped out of the gas 66 when reducing temperature or increasing pressure. Liquid water may be separated from condensable hydrocarbons after gas treating 67 via gravity settling vessels or centrifugal separators. In the arrangement of FIG. 6, condensable fluids 68 are routed back to the oil separator 63.

At the oil separator 63, water 65 is separated from oil 64. Preferably, the oil separation 63 process includes the use of demulsifiers to aid in water separation. The water 68 may be directed to a separate water treatment facility for treatment and, optionally, storage for later re-injection.

The production fluids processing facility 60 also preferably operates to generate electrical power 82 in a power plant 88. To this end, the remaining gas 83 is used to generate electrical power 82. As noted, gas stream 83 is referred to as a gas turbine feed stream.

The composition of the gas turbine feed stream 83 may be monitored for inert or high heating value component content. For example, if the content of high heating value component gases is too high, this may be an indication that flow rate from a particular production area should be reduced. Alternatively, if the content of an inert gas component like CO2 is too low, this may be an indication that flow rate from a particular production area should be increased. One or more additional wells may be brought on line or taken off line in response to data received as a result of monitoring in order to adjust CO2 or other high heating value component content. Alternatively, a gas composition may be altered by blending the gas turbine feed stream 83 with a designated, pre-mixed gas reserve.

The electrical power 82 generated from the gas turbine feed stream 83 may be used as an energy source for heating the subsurface formation 84 through any of the methods described herein. For example, the electrical power 82 may be fed at a high voltage, for example 132,000 V, to a transformer 86 and let down to a lower voltage, for example 6,600 V, before being fed to an electrical resistance heater element 89 located in a heater well 87 in the subsurface formation 84. In this way all or a portion of the power required to heat the subsurface formation 84 may be generated from the non-condensable portion 66 of the produced fluids 85. Excess gas, if available, may be exported for sale.

In one embodiment, the generated electricity accounts for greater than 60 percent of the heat used in heating the organic-rich rock formation. In alternate embodiments, the generated electricity accounts for greater than 70, 80, or 90 percent of the heat used in heating the organic-rich rock formation. Some of the generated electricity may be sold to a third party, including for example, an electric utility. This means that excess electricity not used in the field can be fed into the power grid and sold. However, some embodiments may include buying electricity from an electricity supplier at selected off-peak demand times to satisfy power needs for resistive heating elements 89.

In connection with the pyrolyzation of heavy or solid hydrocarbons, it is desirable to increase the value of effective thermal diffusivity within the organic rich rock formation. With present heating methods, heat is generated at the individual heater wells or within fractures artificially formed between heater wells. Over time the heat travels outwardly across the formation to be pyrolyzed and produced. In this respect, for in situ pyrolysis of initially low-permeability organic-rich rock formations such as oil shale, coal, or tar sand formations, downhole heat sources largely rely on thermal conduction for heat to penetrate into the formation.

Relying primarily on thermal conduction to heat a formation has limitations. First, thermal conduction is a relatively slow process. This forces the operator to employ a close spacing between heat sources to achieve effective heating over commercially acceptable times, preferably one to six years. Moreover, thermal conduction tends to result in uneven temperature profiles. This is due to the slow propagation of heat away from a heat source and into the formation. This uneven heating can result in the temperatures near the heat sources being much above that needed for pyrolytic conversion in a reasonable timeframe. This overheating is an inefficient use of energy.

Alternatives to downhole or in situ heat sources exist. For example, radio-frequency heating can provide more rapid heating. However, radio-frequency heating may be significantly more expensive to implement than downhole heat sources. Thus, there exists a need for methods to enhance heat transfer and to provide more uniform heating for downhole heat source methods. More efficient use of input thermal energy and faster heat transfer can provide greater spacing between heater wells and enable a corresponding reduction in the required number of heat sources. This, in turn, reduces drilling costs and expedites field development.

It is proposed herein to provide a means to increase heat transfer rate from a heat source to the surrounding formation in an organic-rich rock formation. The organic-rich rock formation initially has a low-permeability. Low permeability may be, for example, 1 Darcy, 500 millidarcies, 10 millidarcies, or even 0.1 millidarcies. To enhance effective thermal diffusivity, gas (or fluid in a vapor phase) is injected into the formation undergoing heating in such a manner as to increase the rate of in situ heat transfer.

In connection with the method in its various embodiments, an organic-rich rock formation is heated using downhole or other in situ heat sources. The formation is actively heated to a pyrolysis temperature that is at least about 270° C. Heating the formation to this temperature enhances permeability. As discussed above, this is effectuated by heat-induced expansion of the rock matrix, by pyrolyzing rock into steam and/or hydrocarbon fluids, and by causing thermal fractures within the colder surrounding rock matrix. Thereafter, gas is injected into the organic-rich rock formation.

Figure 7A:
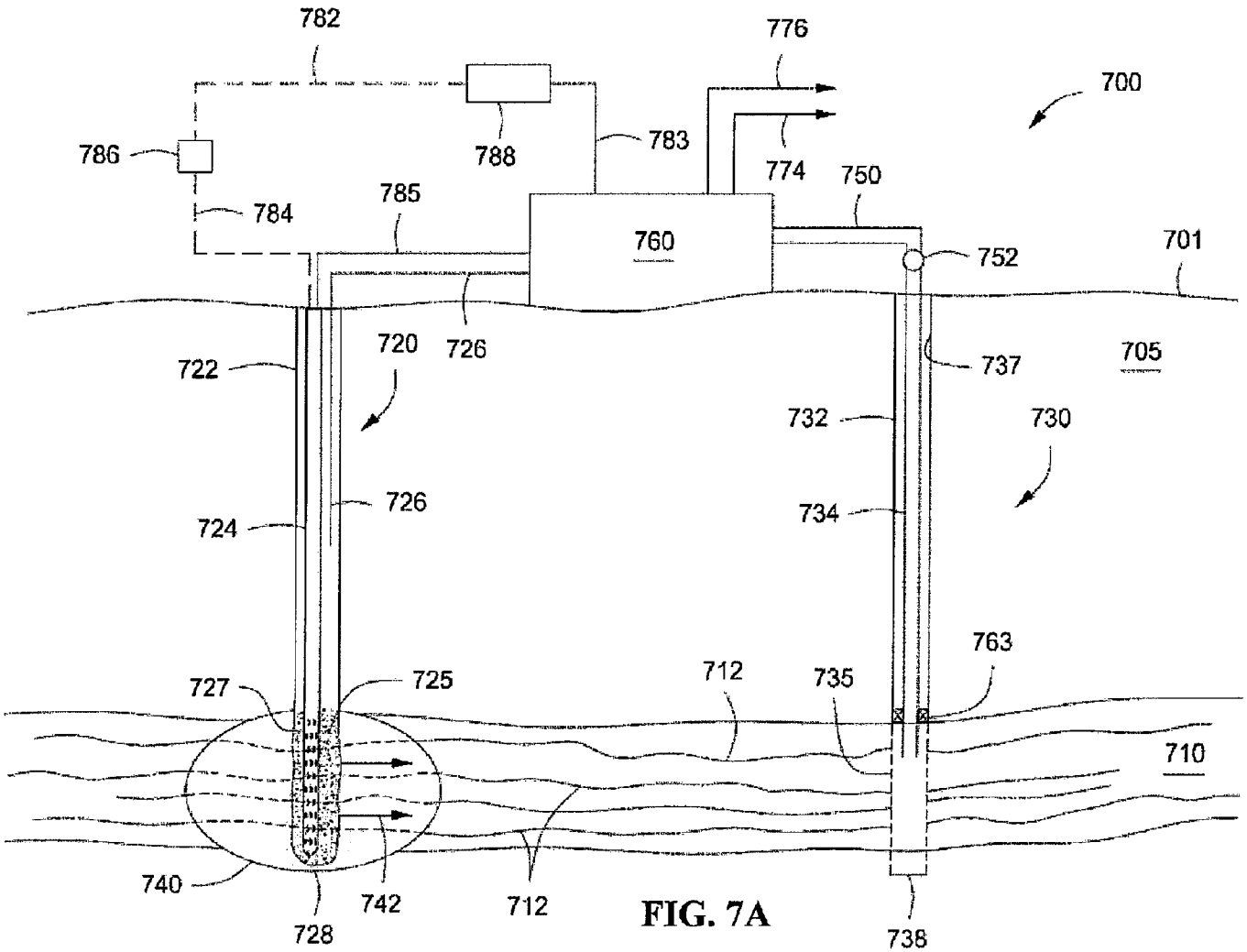
FIG. 7A is a side view of a subsurface formation comprised of organic-rich rock. The formation is being heated for the pyrolysis of formation hydrocarbons according to an exemplary method(s) described herein.
Figure 7B:
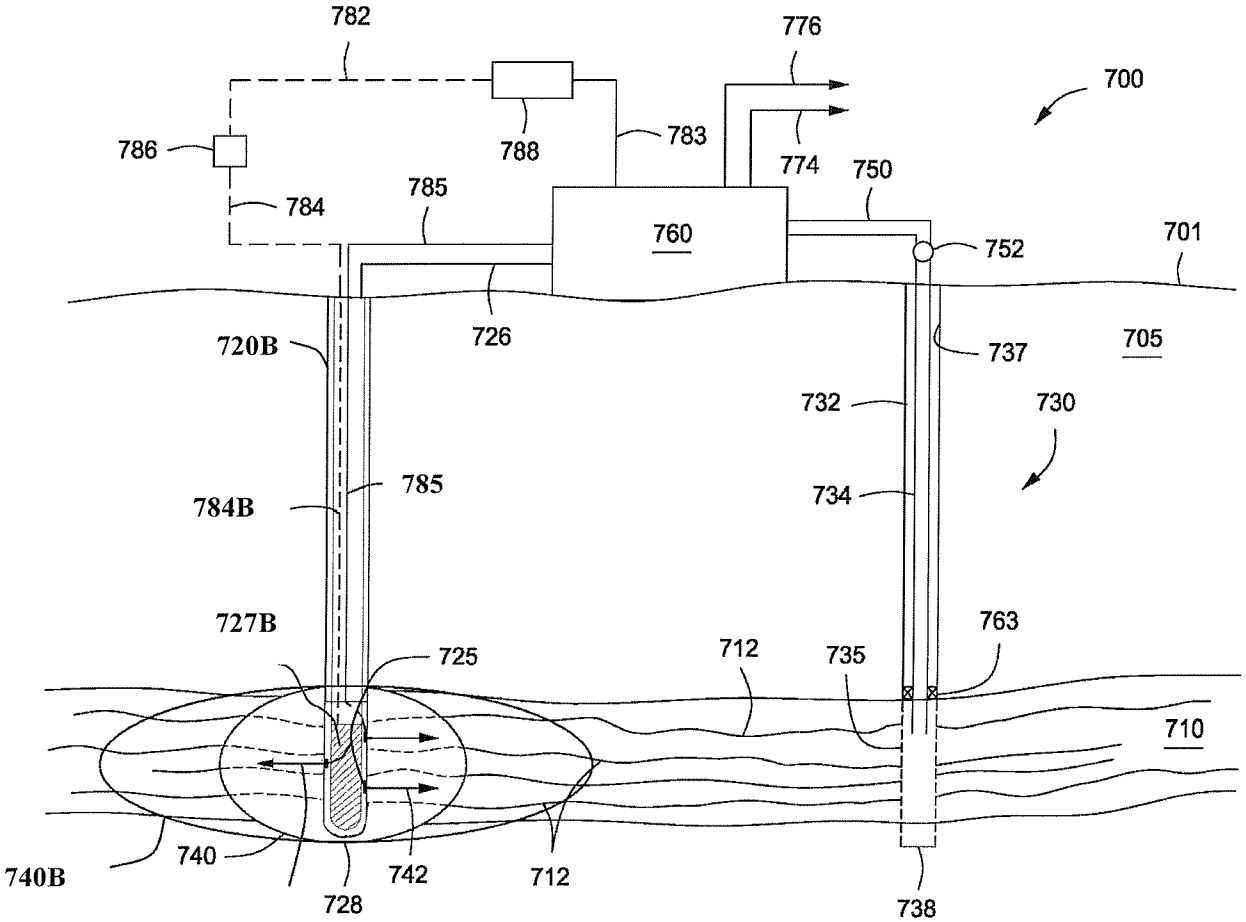
FIG. 7B is a side view of a subsurface formation comprised of organic-rich rock. The formation is being heated for the pyrolysis of formation hydrocarbons according to another exemplary method(s) described herein.

FIG. 7A is a side view of a subsurface formation comprised of organic-rich rock. The formation is being heated for the pyrolysis of formation hydrocarbons according to an exemplary method(s) described herein. FIG. 7B is a side view of a subsurface formation comprised of organic-rich rock. The gas flows through the fractures, thereby accelerating the delivery of heat across the formation. The formation is being heated for the pyrolysis of formation hydrocarbons according to another exemplary method(s) described herein.

Gas is injected in such a manner as to increase the thermal diffusivity of the formation by at least 50% over that which would occur in the absence of gas injection.

Two illustrative methods for heating a subsurface 705 and pyrolyzing formation hydrocarbons are demonstrated herein. These are presented in FIGS. 7A and 7B. In FIG. 7A, the subsurface 701 is heated by using conductive granular material 727 within a heater well 720. In FIG. 7B, the subsurface 701 is heated by using an electrically resistive metal rod within a heater well, and without granular material.

Referring generally to FIGS. 7A and 7B together, each figure presents a schematic view of a portion of a development area 700 for the production of shale oil or other hydrocarbon fluids produced as a result of exemplary in situ pyrolysis processes. The development area 700 has a surface 701 and a subsurface 705. Within the subsurface 705 is an organic-rich rock formation 710. The organic-rich rock formation 710 is preferably an oil shale formation.

The development area 700 includes a surface processing facility 760. The surface processing facility 760 is generally in accordance with the production fluids processing facility 60 of FIG. 6, and serves the primary purpose of processing production fluids received from the organic-rich rock formation 710. Production fluids are generated as a result of pyrolysis taking place in the formation 710. The surface processing facility 760 separates fluid components and delivers an oil stream 774 and a gas stream 776 for commercial sale.

The surface processing facility 760 reserves a portion of the separated gas as a gas turbine feed stream 783. The gas turbine feed stream 783 provides fuel for a gas turbine that is part of a power plant 788. In the power plant 788, the fuel is combined with an oxidant and ignited, causing the gas turbine in the power plant 788 to generate electricity 782. A transformer 786 is once again provided. The transformer 786 steps down the voltage, for example 6,600 V, and delivers an electric current 784.

In the illustrative arrangements of FIGS. 7A and 7B, electrical power is delivered from the transformer 786 into a heater well. Heater wells are seen at 720 and 720B, respectively. In FIGS. 7A and 7B, the heater wells 720, 720B provide electrically resistive heat into the organic-rich rock formation 710. A heat front 740 is thus created in the organic-rich rock formation 710. The heat front 740 heats the organic-rich rock formation 710 to a level sufficient to pyrolyze solid hydrocarbons into hydrocarbon fluids. In the case of an oil shale formation, that level is at least about 270° C.

In FIG. 7A, the heater well 720 has an electrically conductive first member 722. The electrically conductive first member 722 extends to the approximate depth of the organic-rich rock formation 710. The heater well 720 also has an electrically conductive second member 724. The electrically conductive second member 724 extends down the well 720 and substantially into the depth of the organic-rich rock formation 710.

The heater well 720 is completed as an open hole. The open hole extends substantially along the depth of the organic-rich rock formation 710 to a bottom end 728 of the well 720. A conductive granular material 727 is placed within the open hole to the bottom end 728 so as to be immediately exposed to the organic-rich rock formation 710.

In order to generate resistive heat, the electric current 784 is sent downward through the electrically conductive first member 722. The current 784 reaches the granular material 727 and then passes to the electrically conductive second member 724. The current 784 then returns to the surface 701 to form an electrical circuit. As the current 784 passes through the granular material 727, heat is resistively generated. In this respect, the granular material is designed to have a resistivity that is significantly higher than resistivities of the electrically conductive first 722 and second 724 members.

In addition to and/or in lieu of one or more features shown in FIG. 7A, FIG. 7B shows a heater well 720B having a single electrically conductive member 722B. The electrically conductive member 722B extends to the approximate depth of the organic-rich rock formation 710. The heater well 720B does not employ an electrically conductive second member, nor does it have granular material. Instead, heat is generated through the electrically resistive properties of an electrically conductive wellbore heater 727B, e.g., elongated electrically conductive heating element(s). The heat front 740 achieved and/or shown based on wellbore heater 727B in FIG. 7B can also be enhanced through the introduction of a heated fluid 742, e.g., achieving improved thermal diffusivity as shown by 740B. The wellbore 720B shown in FIG. 7B may be cased, e.g., above wellbore heater element 727B to permit the introduction of a heated fluid in targeted areas of the formation 710. Additional heated fluids, e.g., such as steam line 726 of FIG. 7A is optional.

It is understood that the heater wells 720 and 720B of FIGS. 7A and 7B are merely illustrative. Other heater well configurations as described above and/or incorporated herein by reference may be employed. These include:

- heater well configurations that involve the circulation of a hot fluid such as heated naphtha through a closed downhole loop;
- heater well configurations that utilize a downhole combustion burner, including a configuration where two wellbores are fluidly connected for the circulation of hot flue gas;
- electrically resistive heater wells where the heat is generated primarily from granular material disposed within the formation between two or more adjacent wellbores to form an electrical circuit; and
- electrically resistive heater wells where the heat is generated primarily from elongated, electrically conductive metallic members (such as a rod, a pipe, a bar, or a tubular member) in adjacent wellbores, and where an electrical circuit is formed using granular material within the formation between the adjacent wellbores to form an electrical circuit.

In addition, electrically resistive metal rods within a wellbore may be employed for heating a formation without the use of granular material.

The development area 700 also includes a production well 730. The illustrative production well 730 includes an elongated casing string 732 or other tubular member. The casing string 732 extends from the surface 701, through the organic-rich rock formation 710, and proximate a bottom 738 of the well 730. Because of the exceedingly high formation temperatures expected to be experienced in connection with the in situ pyrolysis process, heat resistant downhole equipment may need to be used. For example, a lower part 735 of the casing string 732 may need to be fabricated from ceramic.

In the arrangement of FIGS. 7A and 7B, the lower portion 735 of the casing string 732 along the organic-rich rock formation 710 is perforated. The perforations 735 allow formation fluids including pyrolysis oil and pyrolysis gas to enter the production well 730.

The production well 730 also includes a production tubing 734. The production tubing 734 carries formation fluids from the perforated portion 735 of the production well 730 up to the surface 701. A packer 763 or other sealing means may be used to seal off an annular region 737 between the production tubing 734 and the surrounding casing string 732.

One or more pumps (not shown) may optionally be used to artificially lift formation fluids to the surface 701.

Once at the surface 701, formation fluids are carried from the production well 730 to the surface processing facility 760. A flow line 750 is provided for conveying formation fluids. A temperature gauge 752 is preferably placed along the flow line 750 proximate the surface 701 to enable the operator to monitor the temperature of the formation fluids. Alternatively, the temperature gauge 752 may be disposed downhole near or below the packer 763.

It is understood that in practice, a development area for the production of pyrolysis hydrocarbon fluids will have multiple heater wells 720 and multiple production wells 730. The relative arrangement of the heater wells 720 with the production wells 730 may be in accordance with FIG. 4 or other well patterns as discussed above.

As noted, it is proposed herein to provide a means to increase the heat transfer rate within an organic-rich rock formation. As applied to the development area 700 of FIGS. 7A *and* 7B, it is desirable to improve the conveyance of heat from the heater well 720, through the formation 710, and to the production well 730. To enhance effective thermal diffusivity, gas (or fluid in a vapor phase) is injected into the formation undergoing heating in such a manner as to increase the rate of in situ heat transfer. As the heat front 740 moves from the heater well 720 and through the formation 710, permeability of the formation 710 increases. The organic-rich rock formation initially has a low-permeability. Low permeability may be, for example, 1 Darcy, 500 millidarcies, or even 1 millidarcy. As the temperature of the formation surrounding the heater well 720 increases and as permeability increases, fractures 712 will emanate from the heater well 730 into the colder surrounding rock formation 710. Eventually, cracks will open up adjacent the production well 730. At about that point, gas may be injected into the fractures 712.

The flow of gas 742 through the fractures 712 assists in the transfer of heat through the organic-rich rock formation 710. This, in turn, provides a more even heat distribution within the organic-rich rock formation 710 while increasing the rate of thermal transport. The flow of gas 742 may assist in the transfer of heat through the formation in a variety of manners. For example, in some implementations, the flow of gas may augment the heat penetration rate into the formation by supplementing the conductive heating of the formation with convective heating carried by the gas passing through heated rock or over resistance heaters en route to deeper parts of the formation. Additionally or alternatively, in some implementations, the flow of gas may directly assist in the heating of the formation, such as by being pre-heated and convectively carrying its own heat into the formation. The flow of gas 742 and its potential benefits will be better understood by a reading of this entire disclosure.

In the illustration of FIG. 7A, gas is injected from the surface processing facility 760, through a gas injection line 785, and to the heater well 720. Gas is delivered down a tubular member that defines the electrically conductive second member 724. Perforations 725 are placed in the electrically conductive second member 724 across the depth of the organic-rich rock formation 710. The perforations 725 deliver the injected gas under pressure. Gas is injected in such a manner as to increase the thermal diffusivity of the formation 710 by at least about 50% over that which would occur in the absence of gas injection. More preferably, the thermal diffusivity of the organic-rich rock formation 710 is increased by over about 100%.

It is noted that in the arrangement shown in FIG. 7A, gas is injected through a heater well 720. However, gas may be injected through separate, specifically dedicated gas injection wells. Preferably, such gas injection wells are completed at a location that is in close proximity to a corresponding heater well.

Regardless of how the gas is injected, it is preferred that the injected gas be relatively inert at in situ conditions (i.e., temperature, pressure, and chemical conditions). A suitable example is methane or natural gas. Preferably, the injected gas is a portion of the gas produced from the formation due to the pyrolysis. In some embodiments, the injected gas may comprise N2, CO2, or H2. In some embodiments, the injected gas is taken from a first stage of vapor-liquid separation in the surface facility 760. This would be, for example, a high-pressure separator. Preferably, this is done after some cooling of the produced fluids has occurred.

The heat transfer that takes place within the organic-rich rock formation 710 is a combination of convection and thermal diffusion (or heat conduction). Thermal convection within the formation is due to the flow of vapors and liquids through nonisothermal regions of the formation. The vapors and liquids may be injected components, components formed by pyrolysis, or components mobilized by increased temperature. Thermal diffusion is defined by the ratio of thermal conductivity to volumetric heat capacity. Thermal diffusivity has the SI (International Standard of Units) of m2/s, as follows:

$$\alpha = \frac{\kappa}{\rho c_p}$$

where:

$\alpha$ is thermal diffusivity $\frac{m^2}{sec}$ $k$ is thermal conductivity $\frac{W}{mK}$ $\rho$ is density $\frac{kg}{m^3}$ and $c_p$ is specific heat capacity $\frac{J}{kg \cdot K}$ The rate of thermal diffusion is dependent on the thermal diffusivity of the material being heated. Change in temperature in a system controlled by thermal diffusion may be described by the Fourier field equation:

$$\frac{\partial T}{\partial t} = \alpha \nabla^2 T$$

where:

$\alpha$ is thermal diffusivity $\frac{m^2}{sec}$ $T$ is temperature, $t$ is time, and $\nabla$ is the gradient operator, or second derivative $\frac{\partial^2 T}{\partial x^2}$. under Fick's Law.

Although the overall heat transfer in a system is caused by convection and thermal diffusion, in certain cases it is convenient to consider some or all of the convection as impacting an "effective" thermal diffusion amount. This means that convective flow in the direction of thermal diffusion can be considered as increasing the thermal diffusion rate (i.e., the thermal diffusivity). For the present invention, it is desired to inject gas so as to increase convection in the rock matrix. Gas is injected in sufficient amounts and/or at selected locations as to increase the effective thermal diffusivity within a targeted region of the formation to a value that is at least 50% over that which would occur (i.e., be observed) in the absence of gas injection.

Effective thermal diffusivity may be assessed by analyzing temperature measurements or estimates of local sites within a heated zone, and comparing them to a heat transfer model where thermal diffusion is an adjustable parameter. For convenience, this assumes that diffusion is the only mechanism transferring heat through the formation. A thermal diffusion coefficient (e.g., thermal diffusivity or thermal conductivity) of the formation is then adjusted to best match the available data. The optimized coefficient is the apparent thermal diffusivity.

In one aspect, the effective thermal diffusivity may be determined by estimating in situ temperatures for at least two points within the formation, modeling thermal behavior within the formation using a model which comprises a thermal diffusion mechanism of heat transfer, and fitting the thermal model to the in situ temperature estimates by altering a thermal diffusivity parameter in the model to obtain a value of an effective thermal diffusivity ($\alpha_2$).

In certain embodiments, a thermal diffusivity parameter value ($\alpha_2$) for a case with injected gas is compared to a value ($\alpha_1$) that is estimated or empirically determined for a case with no gas injection.

It is understood that $\alpha_1$ represents a native or first value of effective thermal diffusivity. This is the value that would be observed in situ with no gas injection. This value ($\alpha_1$) may be empirically determined in the laboratory by testing samples of oil shale or other matrix from the organic-rich rock formation. The value for the first effective thermal diffusivity ($\alpha_1$) is used as the basis for the thermal model.

It is also understood that the calculation described above for determining the adjusted or second value of effective thermal diffusivity ($\alpha_2$) is merely illustrative. Other steps may be taken, such as by acquiring two core samples, heating each of the core samples at one end so as to increase permeability and to cause micro-fracturing within the core samples, and then measuring relative temperature gradients by injecting gas (such as nitrogen, methane, air, or carbon dioxide) through the micro-fractures of one core sample but leaving the other core sample without the supplemental gas flow. Various gas flow rates may be tested on additional core samples to correlate that effect of gas flow rate on the value of effective thermal diffusivity.

To further enhance thermal diffusivity in the organic-rich rock formation 710 in the field, the operator may choose to heat the injected gas prior to injection. It is noted that in the heater well 720, the injected gas is heated as it passes through the granular material 727 (or as it passes other in situ heat sources) en route to the formation 710. As a supplement, an additional heating mechanism may be disposed within the wellbore itself. For example, the operator may run a closed-loop steam line down the heater well 720 (or down a gas injection well if a dedicated gas injection well is used). In FIG. 7A, a steam line is shown within the heater well 720 at 726. As another option, the injected gas may be heat-exchanged with production fluids in line 750 prior to injection. Regardless of the mechanism, in some implementations the injected gas may not be the primary source of heat for heating the organic-rich rock formation 710; rather an in situ heat source, such as an electric heater, remains the primary heat source and the injected gas is used simply to enhance the transfer rate of the heat into and across the formation.

Additionally or alternatively, in some implementations of the present disclosure, the injected fluid is heated and injected to become the primary heat source for maintaining the formation at a temperature of at least 270° C. For example, in some implementations, the formation may be heated by electrical resistance heaters, combustion burners, or other heating means for a time to increase the permeability of the formation as described herein. After the permeability has been increased, heated fluids may be injected to flow through the formation carrying heat energy with it. The heated fluids may first contact the formation at a temperature of at least 270° C., or at a temperature selected to maintain the formation temperature above about 270° C. In some implementations, the hot injected fluids may become the sole heat source for continuing the pyrolysis. Additionally or alternatively, the electrical resistance heaters or other heaters may continue, but at a lower heating rate, to supplement the heat energy provided by the heated injected fluids. Operators may control the temperature of the injected fluids, the volume and/or rate of injected fluids, the composition of the fluid, and the provision of supplemental heat energy, such as from resistance heaters, to optimize the economies of heating the formation.

In some embodiments the injection of gas is associated with a reduction in heat input to the formation by electrical means. For example, while gas is being injected into the formation a peak value of resistive heat input rate to the formation may be lower than a peak value of resistive heat input rate prior to the onset of gas injection. Alternatively, while gas is being injected into the formation an average value of resistive heat input rate to the formation may be lower than an average value of resistive heat input rate prior to the onset of gas injection. The averages may be calculated over times of, for example, a day, a week, a month, or a year. The resistive heat input rate may reflect a single heat source or all the heat sources within a certain area, such as a contiguous pattern or set of wells. In some embodiments, the lower values of resistive heat input rate may be zero or essentially zero during a period of gas injection.

As can be understood, the heated fluid may provide heat to the formation at a lower cost than using electrical heating, due at least in part to the reduced need for a heat-to-mechanical power conversion step. In addition, as discussed above, the injected fluid is able to carry heat into the formation through convection, which may be a faster, more uniform form of heat transfer depending on the permeability of the formation. As described herein, the heated fluid may be injected after the permeability of the formation has been increased, such as by thermal fractures and/or by production of fluids.

Depending on the heat capacity of the fluid, the amount of heat energy carried into the formation can be significant. Exemplary fluids that may be heated and injected into the formation include steam, flue gases, methane, and naphtha, among others. In some implementations it may be preferred to utilize a fluid that is highly thermally stable to reduce the formation of coke with the formation or within the well.

The injected fluid may be heated in any number of available manners, including the use of combustion burners and electric resistance heaters, which may be disposed above ground or in the formation, such as in a wellbore or in a fracture. Additionally or alternatively, the injected fluid may be heated through other conventional heat exchange methods on the surface. Increased efficiencies may be obtained by thermally coupling the heating of the injected fluid with other processes on the surface, such as the cooling of hot produced fluids and/or the cooling of hot exhaust gas from one or more processes, such as the gas turbines used for electricity generation. In addition to the other advantages that may be obtained by injected a heated fluid, the hot fluid injection may additionally aid in sweeping out viscous pyrolysis oil thereby increasing the overall recovery.

Figure 8:
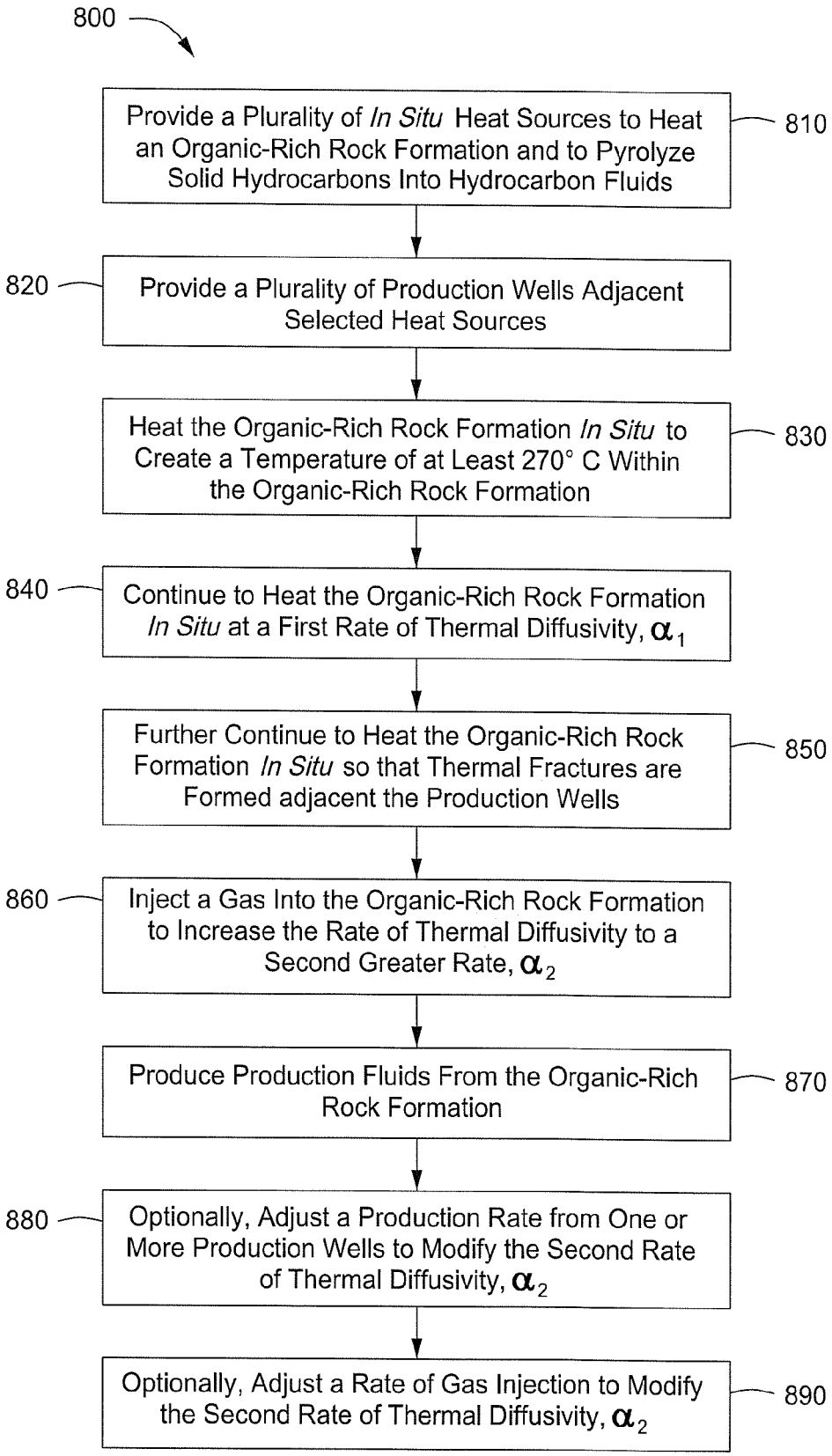
FIG. 8 is a flowchart setting out steps for a method of producing hydrocarbon fluids from an organic-rich rock formation according to one embodiment of the present methods.

FIG. 8 presents a flow chart demonstrating steps of a method 800 for producing hydrocarbon fluids from an organic-rich rock formation. The fluids are produced to a surface facility. In this method, the formation originally has very low permeability. For example, the permeability may be less than about 10 millidarcies.

The organic-rich rock formation may be, for example, a heavy hydrocarbon formation or a solid hydrocarbon formation. Particular examples of such formations include an oil shale formation, a tar sands formation or a coal formation. Particular formation hydrocarbons present in such formations may include oil shale, kerogen, coal, and/or bitumen. Solid hydrocarbon formations may comprise kerogen.

The method 800 first includes providing a plurality of in situ heat sources. This step is shown at Box 810. Each heat source is configured to generate heat within the organic-rich rock formation. The purpose for heating is to ultimately pyrolyze solid hydrocarbons into hydrocarbon fluids.

Various types of heat sources may be used. Non-limiting examples include:

- an electrical resistance heater wherein resistive heat is generated within a wellbore primarily from an elongated metallic member,
- an electrical resistance heater wherein resistive heat is generated primarily from a conductive granular material within a wellbore,
- an electrical resistance heater wherein resistive heat is generated primarily from a conductive granular material disposed within the organic-rich rock formation,
- a downhole combustion well wherein hot flue gas is circulated within a wellbore or through fluidly connected wellbores, or
- a closed-loop circulation of hot fluid through the organic-rich rock formation.

The method 800 also includes providing a plurality of production wells adjacent selected heat sources. It is understood that the pyrolysis of solid hydrocarbons such as kerogen generates hydrocarbon fluids. The hydrocarbon fluids are produced from the organic-rich rock formation as production fluids. This step is shown via Box 820. The production fluids produced during the production step 820 are transported from the organic-rich formation to the surface facility. A surface facility (such as processing facility 60 in FIG. 6) is preferably provided for separating and treating the produced fluids.

The method 800 also includes heating the organic-rich rock formation in situ. This is demonstrated in Box 830. During the heating, a temperature of at least 270° C. is created within the organic-rich rock formation proximal the heat source.

As part of the method 800, heating continues to take place in the formation. This causes heat to conduct away from the respective heat sources and through the formation. Conduction takes place at a first value of effective thermal diffusivity, al. This is shown at Box 840.

Heating of the organic-rich rock formation continues so that permeability is increased. In addition, thermal fractures are caused to be formed in the formation adjacent the production wells. This additional heating step is provided in Box 850.

The method 800 also includes injecting a gas into the organic-rich rock formation. This is shown in box 860. Injection of gas increases the value of effective thermal diffusivity within the formation to a second adjusted value, $\alpha_2$. The second adjusted value $\alpha_2$ is at least 50% greater than the first rate $\alpha_1$. More preferably, the second rate $\alpha_2$ is at least 100% greater than the first value $\alpha_1$.

In one aspect, the thermal fractures are formed adjacent the plurality of production wells before gas is injected into the oil shale formation. Injecting a gas comprises injecting a substantial portion of the gas through the thermal fractures.

Injecting a gas into the formation may involve injecting the gas through wellbores associated with the respective heat sources. In other words, those wellbores may share the dual function of being a heater well and a gas injection well. Alternatively, a plurality of dedicated gas injection wells may be formed. In this instance, each gas injection well is preferably formed closer to a wellbore associated with a heat source than to a wellbore associated with an adjacent production well.

The gas may be heated before it is injected into the organic-rich rock formation. For example, the gas may be heated at the surface using a burner or by heat-exchanging the gas with production fluids at the surface facility. Alternatively, the gas may be heated using a special downhole heater such as a closed-loop steam coil.

The method 800 additionally includes producing production fluids from the organic-rich rock formation. Production takes place through the plurality of production wells. This is provided in box 870.

The production fluids may include both a condensable hydrocarbon portion (e.g., liquid) and a non-condensable hydrocarbon portion (e.g., gas). The hydrocarbon fluids of the production fluids may additionally be produced together with non-hydrocarbon fluids. Exemplary non-hydrocarbon fluids include, for example, water, carbon dioxide ($CO_2$), hydrogen sulfide ($H_{25}$), hydrogen gas ($H_2$), ammonia ($NH_3$), and/or carbon monoxide (CO).

The produced hydrocarbon fluids may include a pyrolysis oil component (or condensable hydrocarbon component) and a pyrolysis gas component (or non-condensable component). Condensable hydrocarbons produced from the formation will typically include paraffins, cycloalkanes, mono-aromatics, and di-aromatics as components. Such condensable hydrocarbons may also include other components such as tri-aromatics and other hydrocarbon species. In some instances, the ratio of the non-condensable hydrocarbon portion to the condensable hydrocarbon portion may be greater than 700 standard cubic feet of gas per barrel of liquid. This ratio is sometimes referred to as the gas to oil ratio, or GOR. In alternate embodiments, the ratio of the non-condensable hydrocarbon portion to the condensable hydrocarbon portion may be greater than 1,000, 1,500 or 2,000 standard cubic feet of gas per barrel of liquid.

The method 800 may optionally include adjusting a production rate from one or more of the plurality of production wells. This may serve to modify the second value of effective thermal diffusivity, α2. This is shown in Box 880. In connection with this adjusting step, production may be monitored. For example, the gas production amount, composition, and/or surface temperature of fluids from at least three wells may be monitored. The wells may be production wells or observation wells (i.e., non-producing wells). The monitored information, particularly in combination with a thermal model of the formation, may be used to control the injection rate of gas into one or more gas injection wells to more uniformly heat the target formation. In certain cases, production rates from production wells may also be controlled based on the monitored information so to increase uniformity of heating. The control may be performed in real-time by tying the field measurements to a computer control system. Alternatively, the control may be performed periodically, with the calculation of the control strategy being evaluated offline.

The method 800 may also optionally include monitoring the temperature of the formation using sensors placed within wellbores associated with at least three of the plurality of production wells. Alternatively, the sensors or gauges may be placed at the wellheads associated with the production wells. The operator may then adjust an injection rate of injected gas into one or more gas injection wells so as to modify the second value of effective thermal diffusivity, α2. This is indicated at Box 890.

Figure 9:
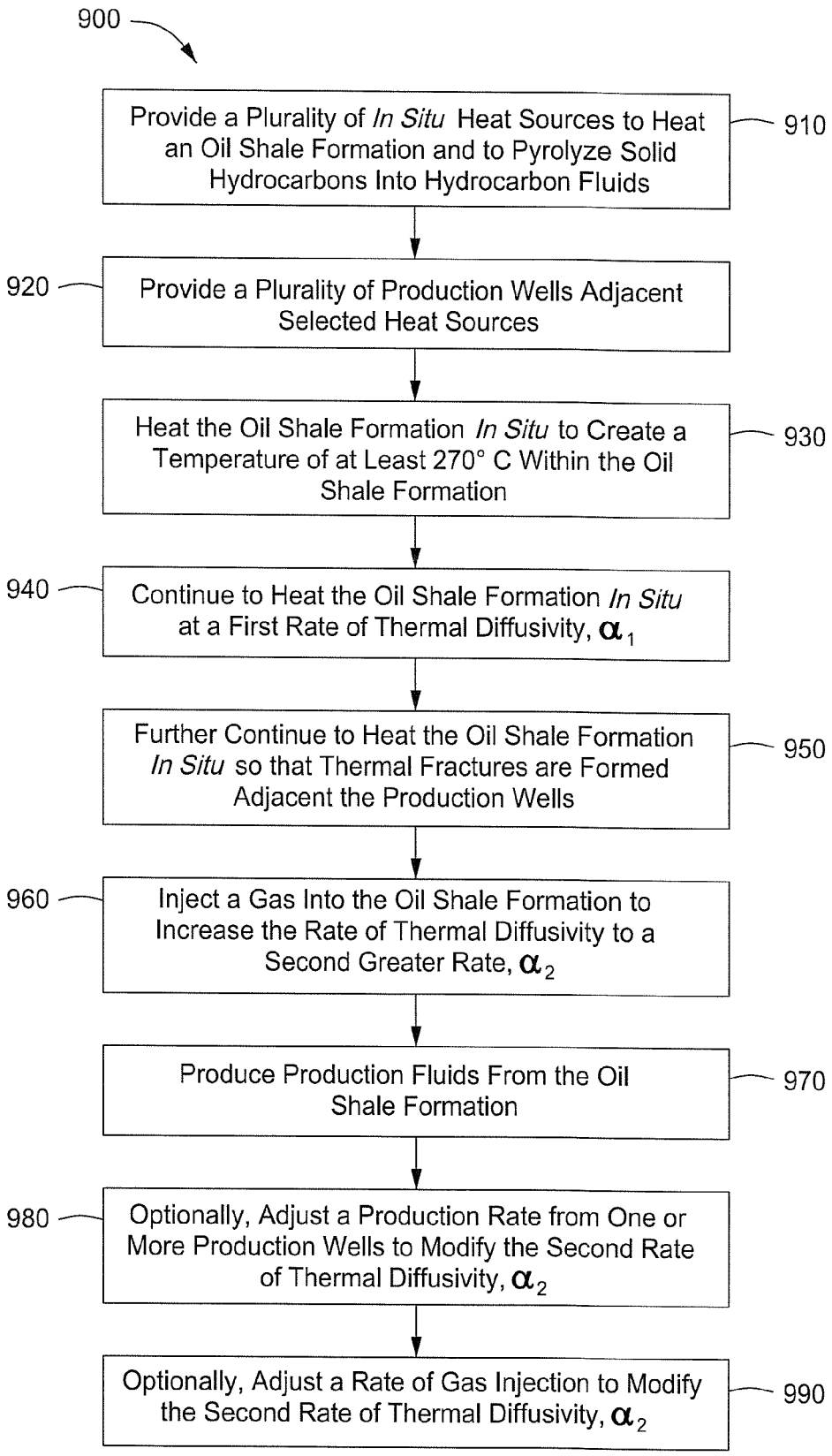
FIG. 9 is a flowchart setting out steps for a method of causing pyrolysis of formation hydrocarbons within an oil shale formation according to an alternative embodiment of the present methods.

FIG. 9 presents a flow chart demonstrating steps of a method 900 for causing pyrolysis of formation hydrocarbons within an oil shale formation. In this method, the oil shale formation originally has very low permeability. For example, the permeability may be less than about 10 millidarcies.

The method 900 first includes providing a plurality of in situ heat sources. This step is shown at Box 910. Each heat source is configured to generate heat within the oil shale formation. The purpose for heating is to ultimately pyrolyze solid hydrocarbons within the formation into hydrocarbon fluids.

The method 900 also includes providing a plurality of production wells adjacent selected heat sources. It is understood that the pyrolysis of solid hydrocarbons such as kerogen generates hydrocarbon fluids. The hydrocarbon fluids are produced from the oil shale formation as production fluids. This step is shown via Box 920. The production fluids produced during the production step 920 are transported to a surface facility. A surface facility (such as processing facility 60 in FIG. 6) is preferably provided for separating and treating the produced fluids.

The method 900 also includes heating the oil shale formation in situ. This is demonstrated in Box 930. During the heating, a temperature of at least 270° C. is created within the organic-rich rock formation proximal the heat source. Various types of heat sources may be used. Non-limiting examples are listed above.

As part of the method 900, heating continues to take place in the formation. This causes heat to conduct away from the respective heat sources and through the formation. Conduction takes place at a first value of effective thermal diffusivity, al. This is shown at Box 940.

Heating of the organic-rich rock formation continues so that permeability is increased. In addition, thermal fractures are caused to be formed in the formation adjacent the production wells. This additional heating step is provided in Box 950.

The method 900 also includes injecting a gas into the organic-rich rock formation. This is shown in box 960. Injection of gas increases the value of effective thermal diffusivity within the formation to a second value, $\alpha_2$. The second value $\alpha_2$ is at least 50% greater than the first value $\alpha_1$. More preferably, the second value $\alpha_2$ is at least 100% greater than the first value $\alpha_1$. In some aspects, thermal fractures are formed in the formation before gas is injected into the oil shale formation. Injecting a gas may comprise injecting a substantial portion of the gas through the thermal fractures. The thermal fractures may originate in the region adjacent to the heater wells and may extend through the formation in any variety of manners. In some implementations, the thermal fractures may extend into regions adjacent one or more production wells.

Injecting a gas into the formation may involve injecting the gas through wellbores associated with the respective heat sources. In other words, those wellbores share the dual function of being a heater well and a gas injection well. Alternatively, a plurality of dedicated gas injection wells may be formed. In this instance, each gas injection well is preferably formed closer to a wellbore associated with a heat source than to a wellbore associated with an adjacent production well.

The gas may be heated before it is injected into the organic-rich rock formation. For example, the gas may be heated at the surface using a burner or by heat-exchanging the gas with production fluids at the surface facility. Alternatively, the gas may be heated using a special downhole heater such as a closed-loop steam coil. The gas may be pre-heated to a temperature between about 150° C. and 270° C. In implementations where the gas is injected has a hot fluid to reduce the electrical heating requirements, the gas may be pre-heated to temperatures exceeding 270° C., such as temperatures ranging from about 270° C. to about 900° C. or from about 270° C. to about 500° C.

The method 900 may additionally include producing production fluids from the organic-rich rock formation. Production takes place through the plurality of production wells. This is provided in box 970.

The method 900 may optionally include adjusting a production rate from one or more of the plurality of production wells. This may serve to modify the second value of effective thermal diffusivity, $\alpha 2$. This is shown in Box 980.

The method 900 may also optionally include monitoring the temperature of the formation using sensors placed at the wellhead or within wellbores associated with at least three of the plurality of production wells. The operator may then adjust an injection rate of injected gas into one or more gas injection wells so as to modify the second value of effective thermal diffusivity, $\alpha 2$. This is indicated at Box 990. Controlling the injection of gas may improve heating uniformity within the formation. Increased uniformity of heating, increases heating efficiency by minimizing overheating of certain areas and underheating of others.

In one aspect, the first value of effective thermal diffusivity, $\alpha_1$, is determined by:

estimating in situ temperatures for at least two points within the oil shale formation;

modeling thermal behavior within the oil shale formation using a computer-based model which incorporates gas flow as a heat transfer mechanism in addition to thermal diffusion; and fitting the thermal model to the in situ temperature estimates by modifying a thermal diffusivity parameter in the model to obtain an effective value of thermal diffusivity ($\alpha_2$).

First and second values of effective thermal diffusivities may be determined and then a ratio calculated of an effective thermal diffusivity parameter value ($\alpha_2$) for a case with gas injection to a value ($\alpha_1$) estimated for a case with no gas injection.

In accordance with one aspect of the production processes of the present inventions, a temperature distribution within the organic-rich rock formation may be computed using a numerical simulation model. The numerical simulation model may calculate a subsurface temperature distribution through interpolation of known data points and assumptions of formation conductivity.

In accordance with some implementations, methods for producing hydrocarbon fluids from an organic-rich rock formation to a surface facility include providing at least one production well in proximity of at least one in situ heat source, each in situ heat source configured to generate heat within the organic-rich rock formation so as to pyrolyze solid hydrocarbons into hydrocarbon fluids. The at least one in situ heat source comprises an electrical resistance heater. The organic-rich rock formation is first heated in situ with the at least one in situ heat source so that a temperature of at least 270° C. is created within the organic-rich rock formation proximal the at least one heat source, so that heat moves away from the at least one heat source and through the formation so that permeability is increased and thermal fractures are caused to be formed in the formation adjacent the production wells. A hot fluid is injected, e.g., of at least 270° C., into the thermal fractures of the organic-rich rock formation after permeability has been increased through heating by the at least one in situ heat source. Production fluids are produced from the organic-rich rock formation through the at least one production well.

Some implementations may include one or more of the following features. For example, the organic-rich rock formation may include heavy hydrocarbons or solid hydrocarbons. The organic-rich rock formation may be an oil shale formation. The oil shale formation may have an initial permeability of less than about 10 millidarcies. Injecting the hot fluid into the oil shale formation may also include injecting the fluid through perforated wellbores associated with the at least one in situ heat source. The wellbores may be perforated prior to inserting an electrical resistance heater so that any fluids produced in the vicinity of the heater wellbore may be produced up through the heater wellbore to relieve surrounding pressure caused by thermal expansion and the conversion of organic rich rock into various fluids. Production fluids may be produced up through a variety of ways, including, but not limited to through an annulus or one or more separate tubing strings provided for the production of fluids through the wellbore. Injecting the hot fluid into the oil shale formation further comprises injecting the fluid through injection wellbores adjacent to wellbores associated with the at least one in situ heat source. Producing production fluids may include producing production fluids through wellbores associated with the at least one in situ heat source, and injecting the hot fluid into the oil shale formation may include injecting the hot fluid into the oil shale formation through the wellbores associated with the at least one in situ heat source after production fluids have been produced through the wellbore.

Additionally or alternatively, some implementations may include one or more of the following features. For example, the electrical resistance heater may provide one or more of the following types of heat, e.g., (i) resistive heat generated within a wellbore, (ii) resistive heat generated primarily from a conductive material within a wellbore, and/or (iii) resistive heat generated primarily from a conductive material disposed within the organic-rich rock formation. The fluid injected into the formation may comprise any combination of steam, flue gas, methane, and/or naptha. The electrical resistance heat generation rate may be controlled to zero during a period of time when injecting the heated fluid. The fluid may be heated at least partially using exhaust from a gas turbine powering electricity generation. The fluid may be heated at least partially using produced fluids. The hot fluid may be injected into the organic-rich rock formation only after production fluids are produced from at least two of the plurality of production wells. The injected fluid may include a hot gas comprising (i) nitrogen, (ii) carbon dioxide, (iii) methane, or (iv) combinations thereof. The existence of the creation of sufficient permeability may be ascertained in several ways. For example, a test injection of heated fluid may be initiated, whereby a prescribed injectivity index, e.g., a predetermined amount of fluid per change in pressure, is obtained through a test injection that would demonstrate ample permeability has been obtained. A pressure pulse test between an injection and a production point could be conducted and the results analyzed to determine apparent permeability achieved from initial heating with electrical resistance heating. A specified fraction of the estimated in situ kerogen within a certain area could be utilized as a metric to ensure that a minimum amount of fluids are produced that are indicative of ample permeability increases to support fluid flow in the formation. A specified flow rate at one or more wells during or shortly after electrical in situ heating can be utilized as a way of ascertaining if ample permeability has been achieved in the formation.

The present disclosure provides a means to increase heat transfer rate from a heat source through the surrounding formation in an organic-rich rock formation having initially low-permeability. Additionally, the inventions herein cause in situ temperatures to be more uniform over a targeted subsurface region for pyrolysis. This may provide a more efficient use of input thermal energy.

Applicant is aware that U.S. Pat. No. 7,011,154 entitled "In Situ Recovery from a Kerogen and Liquid Hydrocarbon Containing Formation" discusses the injection of gas incident to a heating operation. However, the gas is injected for the purpose of adding reactants into the formation undergoing pyrolysis. The applicant therein seeks to use some of the production wells as injection wells for the injection of steam or other process-modifying fluids to control the in situ conversion process. In this respect, applicant posits that the increased presence of hydrogen (from vaporized water or from recycled production fluids having a carbon number greater than 1) may affect product composition through in situ hydrogenation. Hydrogenation, in turn, would increase methane generation. No discussion is provided for increasing thermal diffusivity in connection with a formation heating process.

In another application, the applicant for U.S. Pat. No. 7,011,154 describes the injection of fluids to generate a pressure barrier. The pressure barrier is said to limit the migration of pyrolysis fluids outside of a target region. This may be used in conjunction with freeze wall barriers. However, no disclosure is provided for increasing thermal diffusivity in connection with a formation heating process.

The above-described processes may be of merit in connection with the recovery of hydrocarbons in the Piceance Basin of Colorado. Some have estimated that in some oil shale deposits of the Western United States, up to 1 million barrels of oil may be recoverable per surface acre. One study has estimated the oil shale resource within the nahcolite-bearing portions of the oil shale formations of the Piceance Basin to be 400 billion barrels of shale oil in place. Overall, up to 1 trillion barrels of shale oil may exist in the Piceance Basin alone.

Certain features of the present invention are described in terms of a set of numerical upper limits and a set of numerical lower limits. It should be appreciated that ranges formed by any combination of these limits are within the scope of the invention unless otherwise indicated. Although some of the dependent claims have single dependencies in accordance with U.S. practice, each of the features in any of such dependent claims can be combined with each of the features of one or more of the other dependent claims dependent upon the same independent claim or claims.

While it will be apparent that the invention herein described is well calculated to achieve the benefits and advantages set forth above, it will be appreciated that the inventions are susceptible to modification, variation and change without departing from the spirit thereof.

What is claimed is:

1. A method for producing hydrocarbon fluids from an organic-rich rock formation to a surface facility, the method comprising:

providing at least one production well adjacent at least one in situ heat source, each of the at least one in situ heat source configured to generate heat within the organic-rich rock formation so as to pyrolyze solid hydrocarbons into hydrocarbon fluids;

heating the organic-rich rock formation in situ so that a pyrolysis temperature of at least 270° C. is created within the organic-rich rock formation proximal the at least one in situ heat source, so that heat moves away from the at least one in situ heat source and through the organic-rich rock formation at a first value of effective thermal diffusivity, $\alpha_1$, and so that permeability is increased and thermal fractures are caused to be formed in the organic-rich rock formation adjacent the at least one production well;

increasing a value of effective thermal diffusivity within the organic-rich rock formation to an adjusted second value of effective thermal diffusivity, wherein the adjusted second value of effective thermal diffusivity is at least 50% greater than the first value of effective thermal diffusivity, by injecting a gas into the organic-rich rock formation, wherein the first value of effective thermal diffusivity and the adjusted second value of effective thermal diffusivity are both at the pyrolysis temperature, wherein the gas injected is not the at least one in situ heat source, and wherein the gas is injected into the organic-rich rock formation below 270° C.; and producing production fluids from the organic-rich rock formation through the at least one production well.

2. The method of claim 1, wherein the organic-rich rock formation comprises heavy hydrocarbons or solid hydrocarbons.

3. The method of claim 1, wherein the organic-rich rock formation is an oil shale formation.

4. The method of claim 1, wherein the at least one production well comprises at least two production wells and wherein gas is injected into the organic-rich rock formation only after production fluids are produced from two or more of the at least two production wells.

5. The method of claim 1, wherein the injected gas comprises hydrocarbon gas produced from the at least one production well.

6. The method of claim 1, wherein the injected gas is substantially non-reactive in the organic-rich rock formation.

7. The method of claim 6, wherein the injected gas comprises (i) nitrogen, (ii) carbon dioxide, (iii) methane, or (iv) combinations thereof.

8. The method of claim 1, further comprising:

heating the gas at the surface facility before injecting the gas into the organic-rich rock formation.

9. The method of claim 8, wherein the gas is heated either by passing the gas through a burner, or by passing the gas through a heat exchanger wherein the gas is heat-exchanged with the production fluids.

10. The method of claim 8, wherein heating the organic-rich rock formation in situ utilizes an electrical resistance heater, wherein resistive heat is generated (i) within a wellbore, (ii) primarily from a conductive material within a wellbore, or (iii) primarily from a conductive material within the organic-rich rock formation; wherein the resistive heat generation rate by the electrical resistance heater is reduced while injecting the heated gas; wherein a temperature of at least 270° C. is maintained in the organic-rich rock formation while injecting the heated gas with the reduced resistive heat generation rate; and wherein the reduced resistive heat generation rate is below a peak value of resistive heat generation prior to initiating gas injection.

11. The method of claim 10, wherein the gas comprises steam, flue gas, methane, or naptha.

12. The method of claim 10, wherein the resistance heat generation rate is zero during a period of time when injecting the heated gas.

13. The method of claim 10, wherein the gas is heated at least partially using exhaust from a gas turbine powering electricity generation.

14. The method of claim 10, wherein the gas is heated at least partially using produced fluids.

15. The method of claim 3, wherein the adjusted second value of effective thermal diffusivity value is at least 100% greater than the first value of effective thermal diffusivity.

16. The method of claim 3, wherein the oil shale formation has an initial permeability of less than about 10 millidarcies.

17. The method of claim 3, wherein thermal fractures are formed adjacent the at least one production well before gas is injected into the oil shale formation, and wherein a substantial portion of the gas is injected through the thermal fractures.

18. The method of claim 17, further comprising:

adjusting a production rate from one or more of the at least one production well so as to further modify the adjusted second value of effective thermal diffusivity.

19. The method of claim 17, wherein injecting a gas into the oil shale formation further comprises injecting the gas through wellbores associated with a respective one of the at least one in situ heat source.

20. The method of claim 17, wherein injecting a gas into the oil shale formation comprises:

forming a plurality of gas injection wells, each of the plurality of gas injection wells being formed closer to a nearest wellbore associated with one of the at least one in situ heat source than to a nearest wellbore associated with a production well.

21. The method of claim 3, wherein each of the at least one in situ heat source comprises an electrical resistance heater.

22. The method of claim 3, wherein each of the at least one in situ heat source comprises an electrical resistance heater, (i) wherein resistive heat is generated within a wellbore, (ii) wherein resistive heat is generated primarily from a conductive material within a wellbore, or (iii) wherein resistive heat is generated primarily from a conductive material within the organic-rich rock formation.

23. The method of claim 3, wherein each of the least one in situ heat source comprises (i) a downhole combustion well wherein hot flue gas is circulated within a wellbore or through fluidly connected wellbores, or (ii) a closed-loop circulation of hot fluid through the organic-rich rock formation.

24. The method of claim 3, further comprising:

estimating the temperature of the oil shale formation at two or more points in the formation;

estimating one or more thermal diffusivities in the formation using the estimated temperatures; and adjusting an injection rate of injected gas into one or more gas injection wells so as to modify the adjusted second value of effective thermal diffusivity.

25. The method of claim 24, wherein estimating the temperature comprises obtaining measurements from sensors associated with at least three of the at least one production well.

26. The method of claim 24, wherein estimating the temperature comprises obtaining measurements from sensors associated with monitoring wells, heater wells or dedicated gas injection wells.

27. A method of causing pyrolysis of formation hydrocarbons within an oil shale formation, the oil shale formation having an initial permeability of less than about 10 millidarcies, comprising:

providing a plurality of in situ heat sources, each of the plurality of in situ heat sources configured to generate heat within the oil shale formation so as to pyrolyze solid hydrocarbons into hydrocarbon fluids;

providing a plurality of production wells adjacent a selected at least one of the plurality of in situ heat sources;

heating the oil shale formation in situ so that a pyrolysis temperature of at least 270° C. is created within the oil shale formation proximal the plurality of in situ heat sources;

continuing to heat the oil shale formation in situ so that heat moves away from the respective plurality of in situ heat sources and through the oil shale formation at a first value of effective thermal diffusivity;

further continuing to heat the oil shale formation in situ so that thermal fractures are caused to be formed in the oil shale formation adjacent the plurality of production wells; and increasing a value of effective thermal diffusivity within the oil shale formation to a second value of effective thermal diffusivity, wherein the second value of effective thermal diffusivity is at least 50% greater than the first value of effective thermal diffusivity, by injecting a gas into the oil shale formation, wherein the first value of effective thermal diffusivity and the second value of effective thermal diffusivity are both at the pyrolysis temperature, wherein the gas injected is not one of the plurality of in situ heat sources and wherein the gas injected into the oil shale formation is below 270° C.

28. The method of claim 27, further comprising:

producing hydrocarbon fluids from the oil shale formation through the plurality of production wells.

29. The method of claim 28, wherein the thermal fractures are formed adjacent the plurality of production wells before gas is injected into the oil shale formation, wherein a substantial portion of the gas is injected through the thermal fractures.

30. The method of claim 29, wherein each of the plurality of in situ heat sources comprises (i) an electrical resistance heater wherein resistive heat is generated primarily from an elongated metallic member, (ii) an electrical resistance heater wherein resistive heat is generated primarily from a conductive granular material within a wellbore, (iii) an electrical resistance heater wherein resistive heat is generated primarily from a conductive granular material within the oil shale formation, (iv) a downhole combustion well wherein hot flue gas is circulated within a wellbore, or (v) a closed-loop circulation of hot fluid through the organic-rich rock formation.

31. The method of claim 30, wherein injecting a gas into the oil shale formation further comprises injecting the gas through wellbores associated with the plurality of in situ heat sources.

32. The method of claim 30, wherein injecting a gas into the oil shale formation further comprises forming a plurality of gas injection wells, each of the plurality of gas injection wells being formed closer to a wellbore associated with one of the plurality of in situ heat sources than to a wellbore associated with an adjacent producer well.

33. The method of claim 28, further comprising:

monitoring a temperature of the oil shale formation using sensors placed within wellbores associated with at least three of the plurality of production wells; and adjusting an injection rate of injected gas into one or more gas injection wells so as to modify the second value of effective thermal diffusivity, and thereby heat the oil shale formation more uniformly.

34. The method of claim 27, wherein the gas is heated at a surface to a temperature between about 150° C. and 270° C.

35. The method of claim 27, wherein the gas is heated to at least 270° C. before injecting the gas into the oil shale formation.

36. The method of claim 27, wherein heating the oil shale formation in situ utilizes an electrical resistance heater, wherein resistive heat is generated (i) within a wellbore, (ii) primarily from a conductive material within a wellbore, or (iii) primarily from a conductive material disposed within the oil shale formation; wherein the resistive heat generation rate by the electrical resistance heater is reduced while injecting the gas; wherein a temperature of at least 270° C. is maintained in the oil shale formation while injecting the gas with the reduced resistive heat generation rate; and wherein the reduced resistive heat generation rate is below a peak value of resistive heat generation prior to initiating gas injection.

37. The method of claim 30, wherein the hot fluid comprises steam, flue gas, methane, or naptha.

38. The method of claim 36, wherein the resistance heat generation rate is zero during a period of time when injecting the gas.

39. The method of claim 36, wherein the gas is heated at least partially using exhaust from a gas turbine powering electricity generation.

40. The method of claim 36, wherein the gas is heated at least partially using produced fluids.

41. The method of claim 27, wherein the injected gas comprises (i) nitrogen, (ii) carbon dioxide, (iii) methane, (iv) hydrocarbon gas produced from the production wells, (v) hydrogen, or (v) combinations thereof.

42. The method of claim 27, further comprising:

monitoring temperatures of fluids produced from at least three of the plurality of production wells; and in response to said monitoring, adjusting a rate of injection of gas into the oil shale formation.

43. The method of claim 42, further comprising:

in response to said monitoring, adjusting production rates from one or more of the plurality of production wells so as to more uniformly heat the oil shale formation.

44. The method of claim 27, wherein the second value of effective thermal diffusivity is determined by:

estimating in situ temperatures for at least two points within the oil shale formation;

modeling thermal behavior within the oil shale formation using a computer-based model which incorporates gas flow as a mechanism of heat transfer; and fitting the thermal behavior model to the in situ temperature estimates by adjusting a thermal diffusivity parameter in the thermal behavior model to obtain an adjusted value of effective thermal diffusivity.

45. The method of claim 44, further comprising:

comparing the adjusted value of effective thermal diffusivity to a value estimated or determined empirically for a case with no gas injection.

46. A system for producing hydrocarbon fluids from an organic-rich rock formation to a surface facility, the system comprising:

at least one in situ heat source, each of the at least one in situ heat source configured to generate heat within the organic-rich rock formation so as to pyrolyze solid hydrocarbons into hydrocarbon fluids and to heat the organic-rich rock formation in situ so that a pyrolysis temperature of at least 270° C. is created within the organic-rich rock formation proximal the at least one in situ heat source, so that heat moves away from the at least one in situ heat source, and so that permeability is increased;

at least one production well adjacent at least one of the at least one in situ heat source; and at least one gas injection wellbore configured to inject gas into the organic-rich rock formation in order to increase a value of effective thermal diffusivity within the organic-rich rock formation from a first value of effective thermal diffusivity to an adjusted second value, of effective thermal diffusivity, wherein the adjusted second value of effective thermal diffusivity is at least 50% greater than the first value of effective thermal diffusivity, wherein the first value of effective thermal diffusivity and the adjusted second value of effective thermal diffusivity are both at the pyrolysis temperature, wherein the gas injected is not the at least one in situ heat source and wherein the gas injected into the organic-rich rock formation is below 270° C.

47. The system of claim 46, wherein the at least one in situ heat source comprises an electrical conductive heater.

48. The system of claim 46, wherein the at least one in situ heat source comprises an electrically conductive fracture.

49. The system of claim 46, wherein the at least one in situ heat source comprises an electrically resistive wellbore heater.

50. The system of claim 49, wherein the electrically resistive wellbore heater is positioned within a wellbore, the wellbore being configured to operate as the at least one gas injection wellbore.

51. A method for producing hydrocarbon fluids from an organic-rich rock formation to a surface facility, the method comprising:

providing at least one production well adjacent at least one in situ heat source, each in situ heat source configured to generate heat within the organic-rich rock formation so as to pyrolyze solid hydrocarbons into hydrocarbon fluids;

heating the organic-rich rock formation in situ so that a pyrolysis temperature of at least 270° C. is created within the organic-rich rock formation proximal the at least one in situ heat source, so that heat moves away from the at least one in situ heat source and through the organic-rich rock formation at a first value of effective thermal diffusivity, and so that permeability is increased and thermal fractures are caused to be formed in the organic-rich rock formation adjacent the production wells;

increasing a value of effective thermal diffusivity within the organic-rich rock formation to an adjusted second value of effective thermal diffusivity, wherein the adjusted second value of effective thermal diffusivity is at least 50% greater than the first value of effective thermal diffusivity by injecting a gas into the organic-rich rock formation, wherein the first value of effective thermal diffusivity and the adjusted second value of effective thermal diffusivity are both at the pyrolysis temperature, and wherein the gas infected is not the at least one in situ heat source; and producing production fluids from the organic-rich rock formation through the at least one production well, wherein heating the organic-rich rock formation in situ utilizes an electrical resistance heater, wherein a resistive heat generation rate by the electrical resistance heater is reduced while injecting the gas, wherein a temperature of at least 270° C. is maintained in the organic-rich rock formation while injecting the gas with the resistive heat generation rate, and wherein the resistive heat generation rate is below a peak value of resistive heat generation prior to initiating gas injection.

* * * * *